US011549209B2

(12) United States Patent
Jung et al.

(10) Patent No.: US 11,549,209 B2
(45) Date of Patent: Jan. 10, 2023

(54) DRAWER AND CLOTHES TREATING MACHINE INCLUDING THE SAME

(71) Applicant: LG Electronics Inc., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 125 days.

(21) Appl. No.: 17/006,174

(22) Filed: Aug. 28, 2020

(65) Prior Publication Data

US 2021/0062393 A1 Mar. 4, 2021

(30) Foreign Application Priority Data

Aug. 29, 2019 (KR) ..... 10-2019-0106706

(51) Int. Cl.

| | |
|---|---|
| ***D06F 39/02*** | (2006.01) |
| ***D06F 37/04*** | (2006.01) |
| ***D06F 39/12*** | (2006.01) |

(52) U.S. Cl.

CPC ..... *D06F 39/022* (2013.01); *D06F 37/04* (2013.01); *D06F 39/028* (2013.01); *D06F 39/12* (2013.01)

(58) Field of Classification Search

None

See application file for complete search history.

(56) References Cited

U.S. PATENT DOCUMENTS

2012/0096903 A1* 4/2012 Kim ..... D06F 39/028 68/17 R

FOREIGN PATENT DOCUMENTS

| | | |
|---|---|---|
| EP | 2447410 | 5/2012 |
| EP | 2476792 | 7/2012 |
| KR | 1020070059432 | 6/2007 |
| KR | 100830488 | 5/2008 |
| KR | 101095403 | 12/2011 |
| KR | 101252168 | 4/2013 |
| WO | WO200244458 | 6/2002 |

OTHER PUBLICATIONS

EP Extended European Search Report in European Appln. No. 20191972.7, dated Dec. 23, 2020, 10 pages.

* cited by examiner

*Primary Examiner* — Cristi J Tate-Sims

(74) *Attorney, Agent, or Firm* — Fish & Richardson P.C.

(57) ABSTRACT

A support member and a clothes treating machine having the same are described. A support member supports a dispenser assembly, in which a drawer is inserted, from a rear side. The support member is inserted through a rear surface of a housing. A support hollow portion is formed in one side of the support member facing the dispenser assembly. A rear protrusion of the dispenser assembly is inserted into the support hollow portion. With the configuration, a rear side of the dispenser assembly is supported by the support member. Therefore, the dispenser assembly can be stably supported. Also, a support rib portion extends from an outer circumference of the support member in a lengthwise direction. Accordingly, rigidity of the support member in the lengthwise direction can be reinforced. Therefore, the support rib portion can stably support the dispenser assembly.

20 Claims, 22 Drawing Sheets

DRAWER AND CLOTHES TREATING MACHINE INCLUDING THE SAME

CROSS-REFERENCE TO RELATED APPLICATION

Pursuant to 35 U.S.C. § 119(a), this application claims the benefit of the earlier filing date and the right of priority to Korean Patent Application No. 10-2019-0106706, filed on Aug. 29, 2019, the contents of which are incorporated by reference herein in their entirety.

BACKGROUND

1. Technical Field

The present disclosure relates to a support member and a clothes treating machine having the same, and more particularly, to a support member capable of stably supporting a dispenser assembly, in which a drawer is inserted, and a clothes treating machine including the same.

2. Description of the Related Art

A clothes treating machine is an apparatus capable of washing, rinsing, dehydrating or drying clothes (laundry) using natural or chemical substances such as clothes treatment agents. A user may treat clothes by accommodating the clothes to be treated in the clothes treating machine and supplying a clothes treatment agent, and the like.

It is inconvenient to supply a proper amount of clothes treatment agents to the clothes treating machine whenever a clothes treating process is carried out. Frequent opening and closing of a drawer filled with a clothes treatment agent may cause a failure of the drawer.

Accordingly, technologies that can perform a clothes treating process several times by supplying a clothes treatment agent one time have recently been applied to clothes treating machines.

Specifically, the user may supply a clothes treatment agent in advance to a storage container provided separately in the clothing treating machine. At this time, an amount of clothes treatment agents which is enough to perform a clothes treating process several times is supplied to the storage container.

When the clothes treating machine is operated by the user, the clothes treatment agent may be supplied to a tub by a required amount depending on a set clothes treating process. Accordingly, the user does not need to supply the clothes treatment agent whenever performing the clothes treating process, so that the user's convenience can be enhanced.

The clothes treatment agent supplying method may be defined as an "automatic supplying method". That is, the clothes treatment agent is automatically supplied from a storage container according to a clothes treating process selected by the user.

However, this clothes treating process causes an increase in a weight of a drawer in which the storage container is accommodated. The drawer is inserted into a frame provided inside a housing of the clothes treating machine. Thus, as the drawer increases in weight, high pressure is applied to a coupled portion between the frame and the housing.

The clothes treating machine is operated in response to rotation of a drum. The drum may be rotated by a motor or the like. Therefore, when the clothes treating machine is operated, vibration is generated by the rotation of the drum or motor. The generated vibration may be transferred to the frame, weakening the coupling between the frame and the housing.

Korean Patent Registration No. 10-0830488 discloses a detergent supply device for a drum-type washing machine. Specifically, a detergent supply device having a structure capable of stably supporting a detergent box by forming a plurality of support ribs on a detergent box housing is disclosed.

However, this type of detergent supply device merely discloses a structure for supporting the "detergent box" itself. That is, the prior art literature has a limitation in that there is no consideration of a structure for supporting the "detergent box housing".

Korean Patent Registration No. 10-1252168 discloses a washing machine. Specifically, the prior art literature discloses a washing machine having a structure capable of providing an elastic force when detaching (separating) a detergent box, by way of providing an elastic member on a support portion formed inside a dispenser housing.

However, this type of washing machine merely discloses a structure for facilitating a detachment (separation, discharge) of the detergent box. That is, the prior art literature also has a limitation in that there is no consideration of a structure for supporting the "dispenser housing".

PRIOR ART DOCUMENTS

Patent Documents

Korean Patent Registration No. 10-0830488 (May 21, 2008)

Korean Patent Registration No. 10-1252168 (Apr. 5, 2013)

SUMMARY

The present disclosure is directed to providing a support member having a structure capable of solving the above-mentioned problems, and a clothes treating machine including the same.

Another aspect of the present disclosure is to provide a support member having a structure capable of stably supporting a dispenser assembly, which is supported by a housing, in a different direction, and a clothes treating machine including the same.

Another aspect of the present disclosure is to provide a support member having a structure that does not require an excessive structural change even though the support member is provided to support a dispenser assembly, and a clothes treating machine including the same.

Another aspect of the present disclosure is to provide a support member having a structure capable of reinforcing rigidity of the support member for supporting a dispenser assembly, and a clothes treating machine including the same.

Another aspect of the present disclosure is to provide a support member having a structure capable of stably maintaining a coupled state between the support member and a housing, and a clothes treating machine including the same.

Another aspect of the present disclosure is to provide a support member having a structure capable of facilitating a user to manipulate the support member, and a clothes treating machine including the same.

Another aspect of the present disclosure is to provide a support member having a structure capable of helping the support member coupled to a housing to be stably rotated, and a clothes treating machine including the same.

Another aspect of the present disclosure is to provide a drawer having a structure allowing a clothes treatment agent supplied to the drawer by a user to be discharged without being introduced into a storage container or the like even when the clothes treatment agent overflows, and a clothes treating machine including the same.

Another aspect of the present disclosure is to provide a clothes treating machine having a structure capable of minimizing an amount of clothes treatment agents remaining in a storage container.

Another aspect of the present disclosure is to provide a clothes treating machine having a structure capable of preventing leakage of a clothes treatment agent through a storage container by limiting a sequence or direction that the storage container is inserted into a drawer.

In order to achieve the above aspects, there is provided a support member including a support body portion extending in a lengthwise direction, a support head portion located on one end portion of the support body portion in the lengthwise direction, and a support hollow portion recessed by a predetermined distance in the lengthwise direction into another end portion of the support body portion, opposite to the one end portion in the lengthwise direction, such that a rear protrusion of a dispenser assembly is inserted therein.

The support body portion of the support member may include a first body part extending from the another end portion in the lengthwise direction by the predetermined distance, and a second body part extending from the first body part to the support head portion.

The second body part of the support member may be provided with a support space portion recessed into an outer circumference thereof by a predetermined distance.

The support space portion of the support member may be provided in plurality, spaced apart from one another by a predetermined distance, and support rib portions may be formed between the plurality of support space portions to reinforce rigidity of the support body portion.

The plurality of support space portions and support rib portions may extend in the lengthwise direction.

The support head portion of the support member may be provided with a coupling protrusion protruding from one side thereof facing the support body portion by a predetermined distance, so as to be coupled to a support member coupling portion provided on a housing of a clothes treating machine.

The coupling protrusion may include a first protrusion protruding toward the support body portion by a predetermined distance, and a second protrusion extending from an end portion of the first protrusion at a predetermined angle with respect to the first protrusion.

The support head portion of the support member may be provided with a grip protrusion protruding by a predetermined distance from another side of the support head portion opposite to the support body portion, to be gripped by a user.

The support head portion of the support member may be provided with a guide protrusion protruding by a predetermined distance from one side thereof facing the support body portion, and inserted into a support member guide hole formed on a housing of a clothes treating machine to limit a rotated distance of the support head portion and the support body portion.

A clothes treating machine may include a housing having a predetermined inner space, a tub located in the predetermined inner space, a drum rotatably disposed in the tub, a dispenser assembly accommodated in the predetermined inner space of the housing and communicating with the tub such that a clothes treatment agent is supplied into the tub, and a support member coupled through a rear surface of the housing and inserted into one side of the dispenser assembly to support the dispenser assembly. The support member may include a support body portion extending in the lengthwise direction, a support head portion located on one end portion of the support body portion in the lengthwise direction, and a support hollow portion recessed by a predetermined distance in the lengthwise direction into another end portion of the support body portion opposite to the one end portion in the lengthwise direction, and coupled to the dispenser assembly.

The dispenser assembly may include a rear protrusion protruding by a predetermined distance toward the rear surface of the housing, and the rear protrusion may be coupled to the support hollow portion of the support member in an inserting manner.

The rear protrusion and the support hollow portion may be formed to have a circular cross section, so that the rear protrusion is rotatably inserted into the support hollow portion.

The support body portion of the clothes treating machine may include a first body part extending from the another end portion in the lengthwise direction by the predetermined distance, and a second body part extending from the first body part to the support head portion. The support hollow portion may be formed inside the first body part. The second body part may be provided with a support space portion recessed by a predetermined distance into an outer circumference thereof.

The support space portion may be provided in plurality, extending in a lengthwise direction to be spaced apart from one another by a predetermined distance, and support rib portions may be formed between the plurality of support space portions to reinforce rigidity of the support body portion.

A coupling protrusion may protrude by a predetermined distance from one side of the support head portion facing the support body portion. A support member coupling portion may be provided on the rear surface of the housing so that the coupling protrusion is coupled thereto. The coupling protrusion may be coupled to the support member coupling portion when the support member is rotated by a predetermined distance after being inserted through the rear surface.

Also, the clothes treating machine may further include a drawer inserted into the dispenser assembly, accommodating the clothes treatment agent, and communicating with the tub such that the clothes treatment agent is supplied into the tub, a clothes treatment agent housing defining a predetermined inner space for accommodating the clothes treatment agent, and having an opening formed on one side thereof to communicate with the predetermined inner space. The drawer may include a drawer frame extending in the lengthwise direction and having a predetermined inner space, an inner wall located in the predetermined inner space and configured to divide the predetermined inner space into at least two spaces, and a clothes treatment agent housing accommodation part defined as a space, surrounded by the inner wall, of the divided spaces, and configured to accommodate the clothes treatment agent housing. The clothes treatment agent housing accommodation part may be provided with a protruding portion protruding from one side of the inner wall by a predetermined distance. One side of the clothes treatment agent housing facing the one side of the inner wall may be brought into contact with the protruding portion so as to be spaced apart from the one side of the inner wall when the clothes treatment agent housing is accommodated in the clothes treatment agent housing accommodation part.

The clothes treating machine may include a drawer inserted into the dispenser assembly and having a predetermined space therein, and a storage container inserted into the predetermined inner space of the drawer, extending in the lengthwise direction, and having a predetermined inner space for accommodating the clothes treatment agent. The storage container may be provided on one side thereof with a discharge inclined portion defining a surface of the one side of the storage container, extending to be inclined from one side to another side of the storage container in the lengthwise direction, so that the clothes treatment agent accommodated in the predetermined inner space of the storage container flows from the one side to the another side of the storage container in the lengthwise direction.

The storage container of the clothes treating machine may include a storage cover portion configured to cover a space of one side opposite to the discharge inclined portion. The discharge inclined portion may include first bottom surface extending to be inclined by a predetermined distance from the one side to the another side of the storage container in the lengthwise direction, and a second bottom surface connected to the first bottom surface and extending by a predetermined distance to the another side of the storage container in the lengthwise direction. A longest distance between the storage cover portion and the first bottom surface may be shorter than a shortest distance between the storage cover portion and the second bottom surface.

The clothes treating machine may further include a drawer having a predetermined inner space for accommodating the clothes treatment agent therein, inserted into the dispenser assembly, and communicating with the tub such that the clothes treatment agent is supplied into the tub. The drawer may include a drawer frame extending in a lengthwise direction and having a predetermined inner space, and a rear end portion located on one side thereof in the lengthwise direction, and having an opening to communicate with the predetermined inner space. A storage container defining an inner space for accommodating the clothes treatment agent and having a check valve protruding from the one side in the lengthwise direction by a predetermined distance may be inserted into the predetermined inner space. The rear end portion may include a partition member located on the opening and extending in a widthwise direction of the drawer frame, so as to partition the opening in a height direction of the drawer frame. The check valve may be located in a lower opening partitioned by the partition member to more protrude than the partition member toward the one side when the storage container is inserted into the predetermined inner space.

According to the present disclosure, the following effects can be achieved.

First, a dispenser assembly is supported on its front and right sides by a housing frame. A support member is inserted through a rear surface of the housing, so as to be coupled in an inserting manner to a rear protrusion formed on a rear side of the dispenser assembly.

Accordingly, the dispenser assembly can be supported even on its rear side by the support member. Therefore, the dispenser assembly can be supported more stably.

The support member is inserted through the rear surface of the housing. The housing is provided on its rear surface with a support member insertion hole for inserting the support member, and a support member coupling portion for coupling the support member.

The rear protrusion, which is coupled to the support member in the inserting manner, protrudes rearward from the dispenser assembly. The rear protrusion protrudes from a lower body portion of the dispenser assembly, so as to be inserted into the support member. The coupling is configured so as not to affect other components.

Thus, no excessive structural changes are required to support the rear side of the dispenser assembly.

Further, the support member is provided with support rib portions, and support space portions defined between the support rib portions. The support rib portions and the support space portions extend in a lengthwise direction of the support member.

The support rib portions can reinforce rigidity of the support member in the lengthwise direction.

The support member is further provided with a coupling protrusion. The coupling protrusion is engaged with the support member coupling portion formed on the lower surface of the housing as the support member is rotated. When the coupling protrusion and the support member coupling portion are coupled to each other, the coupled state is not randomly released without a separate external force.

A support head portion is located on an outer side of the rear surface of the housing. The support head portion has a larger diameter than a support body portion of the support member. Even if the support body portion is pushed downward, it does not sag downward by virtue of a contact between the support head portion and the rear surface.

Therefore, the coupling between the support member and the housing can be stably maintained.

In addition, a grip protrusion is formed on one side of the support head portion, that is, on the outer side of the rear surface of the housing. The grip protrusion extends in a radial direction of the support head portion. The user can grip the grip protrusion to rotate, insert, or detach the support member.

Therefore, the user can easily attach or detach the support member to or from the rear surface of the housing, or insert or remove the support member into or from the rear surface of the housing.

In addition, a guide protrusion protrudes from one side of the support head portion facing the dispenser assembly. The guide protrusion is inserted through a support member guide hole formed through the rear surface of the housing. The support member is rotated so that the guide protrusion can be moved inside the support member guide hole along the support member guide hole.

Therefore, the support member is not rotated in an arbitrary direction or by an arbitrary distance. As a result, the rotation of the support member coupled to the rear surface of the housing can be stably performed.

In addition, in one embodiment, the clothes treatment agent housing is accommodated in a housing accommodation part with being spaced a predetermined distance apart from the housing accommodation part. When the clothes treatment agent or fluid overflows due to excessive supply in the clothes treatment agent housing, the overflowed clothes treatment agent or fluid can be discharged through a space portion defined due to the spacing.

Therefore, the overflowed clothes treatment agent or fluid does not come into contact with the storage container or remain in the inner space of the drawer. Also, since the overflowed clothes treatment agent or fluid is supplied to a tub through the space portion, an amount of the clothing treating agent or fluid discarded can be reduced.

A discharge inclined portion is formed on a lower side of a storage container in one embodiment. The discharge inclined portion is inclined toward a rear side. A collection space portion is formed on a rearmost side of the discharge inclined portion, so that a clothes treatment agent moved to the rear side is collected therein.

A check valve is partially accommodated in the discharge inclined portion. The discharge inclined portion and an inner space of the check valve communicate with each other. The collected clothes treatment agent can be supplied to the tub through the check valve.

This may result in minimizing an amount of clothes treatment agents remaining in the storage container. Accordingly, contamination due to the residual clothes treatment agent can be prevented. Furthermore, there is no need to frequently supply the clothes treatment agent in the storage container in order to compensate for the residual amount of clothes treatment agents.

In addition, in one embodiment, a rear end portion is formed on the rear of the drawer. The rear end portion includes an opening in which a sensor portion and the check valve of the storage container are accommodated, and a partition member for partitioning the opening. The partitioned openings do not communicate with each other due to the partition member.

Therefore, when the storage container is inserted into the drawer, the sensor portion or the check valve can be inserted only in a direction and order of bypassing the partition member. In addition, when the storage container is detached from the drawer, the sensor portion or the check valve can be detached only in the direction and order of bypassing the partition member.

Accordingly, the storage container can be inserted or detached in a manner that the front side of the storage container can be kept located to be higher than the rear side. Therefore, leakage of the clothes treatment agent through a through hole formed through the front side of the storage container can be prevented.

DETAILED DESCRIPTION

Hereinafter, a clothes treating machine 10 according to an embodiment of the present disclosure will be described in detail with reference to the accompanying drawings.

In the following description, in order to clarify the features of the present disclosure, description of some components may be omitted.

1. Definition of Terms

The term "clothes treating machine" as used in the following description refers to any apparatus capable of treating clothes, such as washing or drying the clothes. In one embodiment, the clothes treating machine may be a washing machine, a dryer, or a dry-cleaning apparatus.

The term "treatment of clothes" as used in the following description refers to treatment such as washing, sterilization, bleaching, softening and drying performed on clothes.

The term "detergent" used in the following description refers to any material used to sterilize, disinfect, or remove impurities from clothing, textiles or the like. In one embodiment, the detergent may be a solid power, liquid, or the like.

The term "softener" used in the following description refers to any substance or chemical used to soften clothing, textiles, or the like.

The term "bleaching agent" used in the following description refers to any substance or chemical that decomposes and removes colored substances contained in fibers and the like by a chemical action to whiten the fibers and the like.

The term "clothes treatment agent" as used in the following description refers to any substance capable of causing a chemical or physical action to treat clothing. In one embodiment, the clothes treatment agent may be used as meaning including detergent, softener, bleach, and the like. In addition, the clothes treatment agent may be in a liquid phase.

The term "fluid" as used in the following description refers to any fluid that can be mixed with a clothes treatment agent or function as a solvent for the clothes treatment agent. In one embodiment, the fluid may be wash water, i.e., water.

Figure 6:
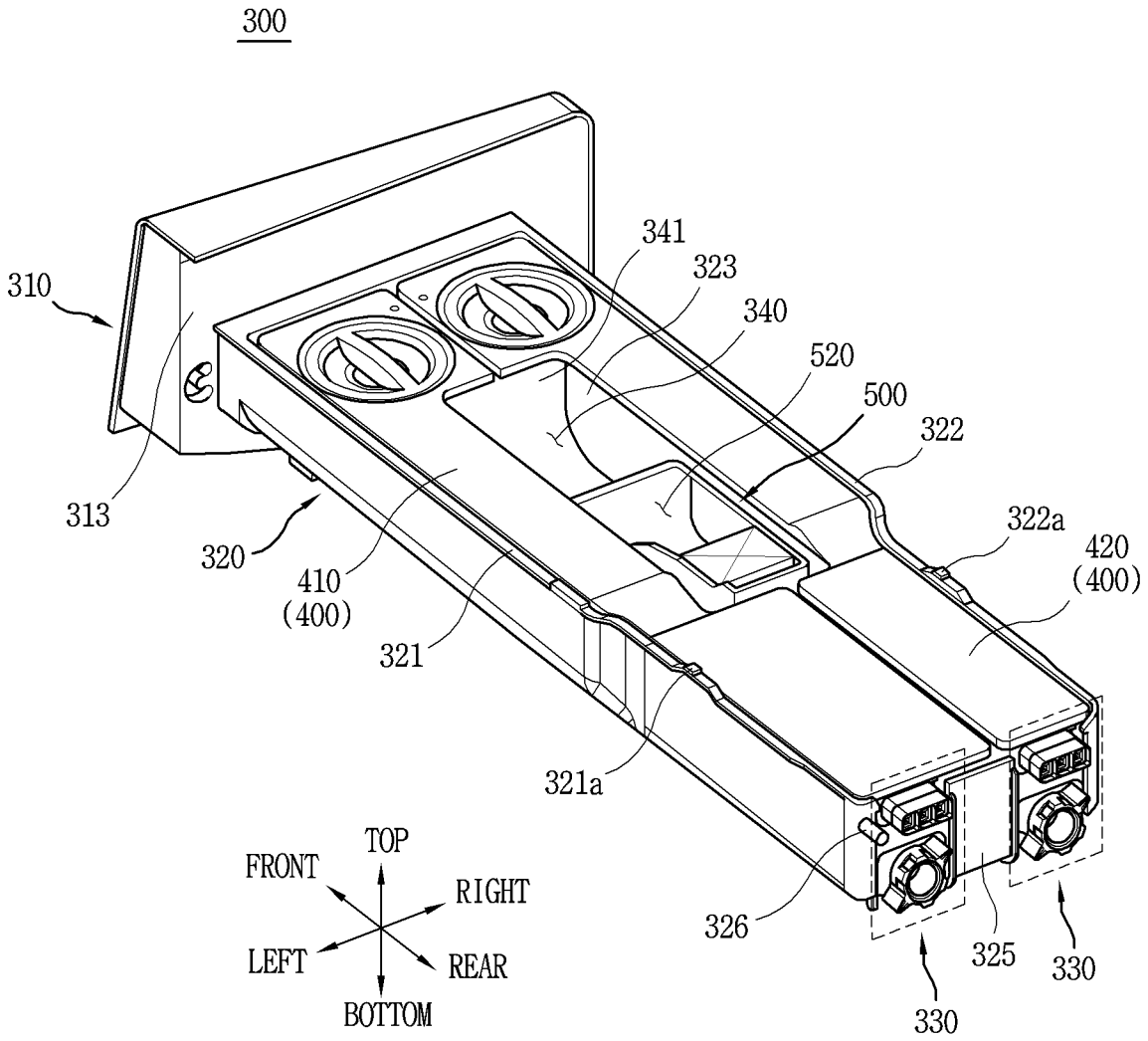
FIG. 6 is a perspective view illustrating a drawer provided in the clothes treating machine of FIG. 1, and a storage container and a clothes treatment agent housing both coupled to the drawer.
Figure 7:
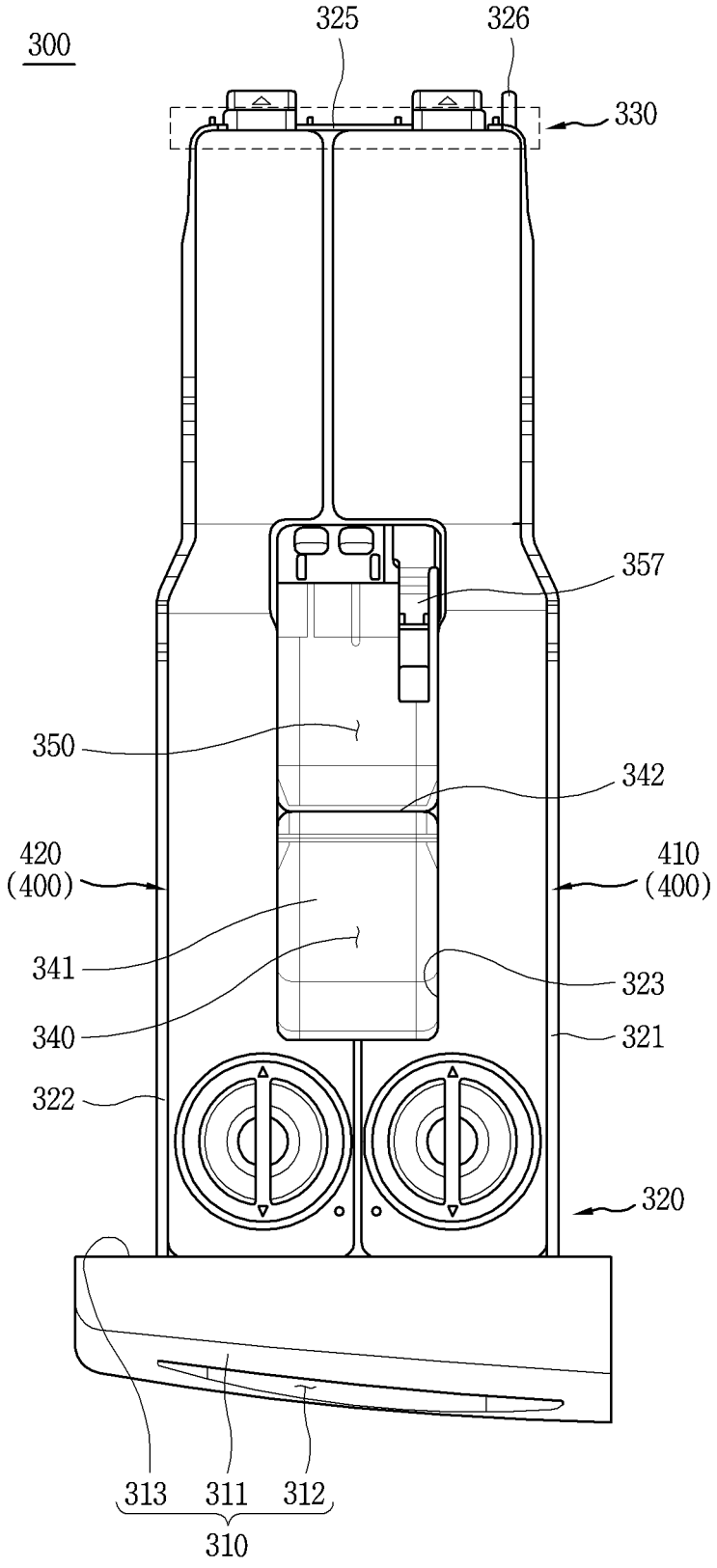
FIG. 7 is a planar view illustrating a drawer from which the clothes treatment agent housing of FIG. 6 is detached.
Figure 8:
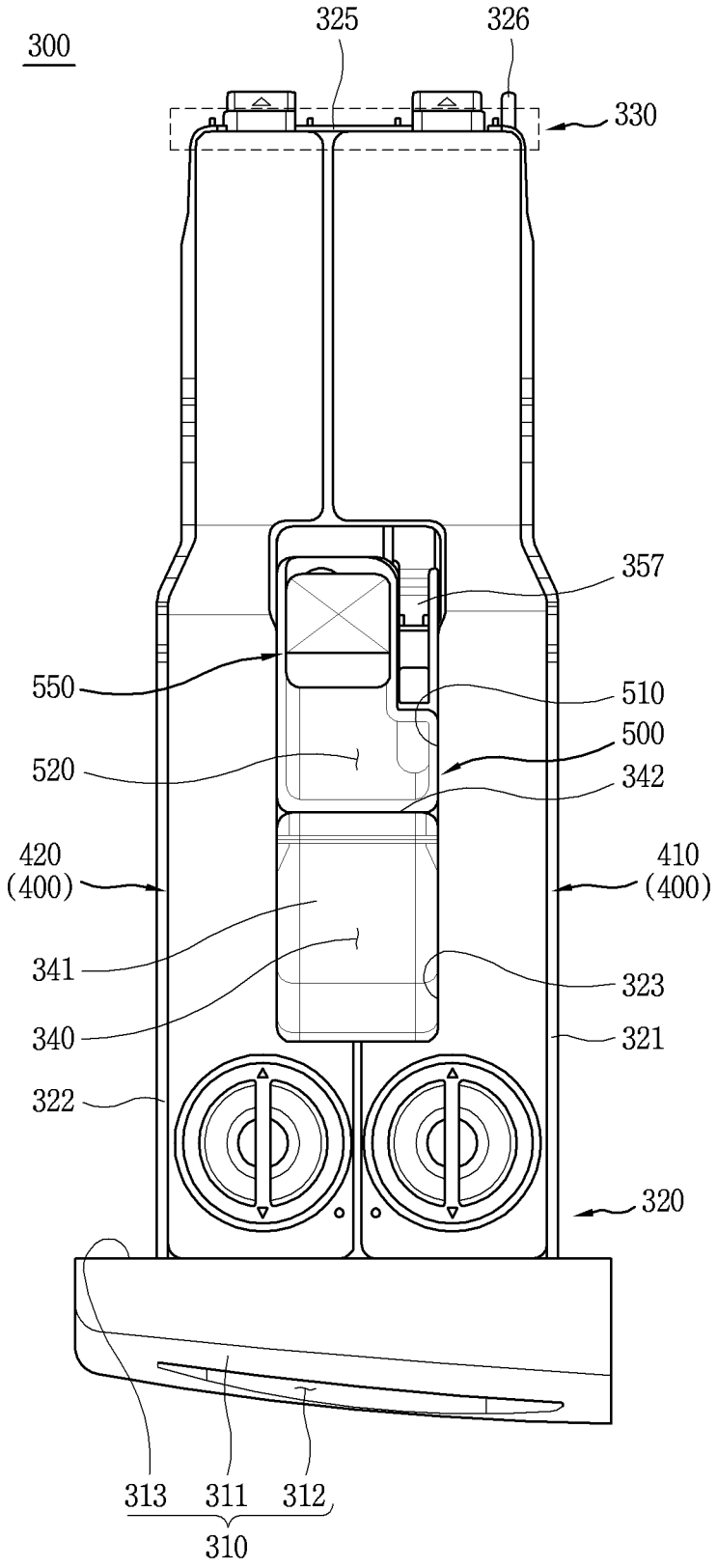
FIG. 8 is a planar view of FIG. 6.
Figure 9:
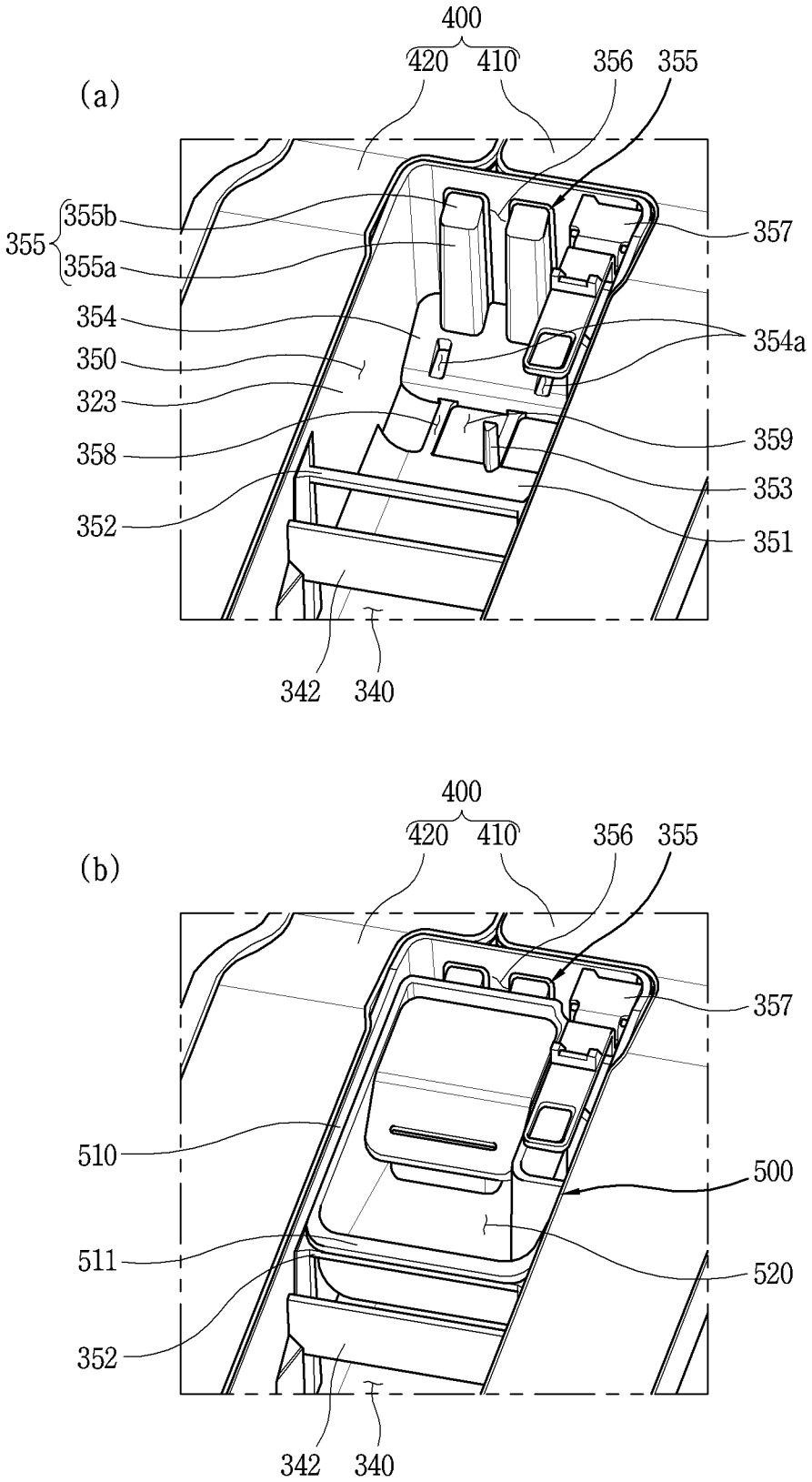
FIG. 9 is a partially-enlarged perspective view (a) illustrating a state of FIG. 7 and a partially-enlarged perspective view (b) illustrating a state of FIG. 8.

The terms "top", "bottom", "left", "right", "front" and "rear" used in the following description will be understood with reference to coordinate systems illustrated in FIGS. 1 and 6.

2. Description of Configuration of Clothes Treating Machine 10 According to Embodiment Referring to FIGS. 1 to 4, a clothes treating machine 10 according to an embodiment of the present disclosure includes a housing 100, a dispenser assembly 200, and a drawer 300.

In addition, referring to FIGS. 5 to 17, the clothes treating machine 10 according to the embodiment of the present disclosure includes a storage unit 400, a clothes treatment agent housing 500, and a support member 600.

Hereinafter, each component according to the embodiment of the present disclosure will be described in detail with reference to the accompanying drawings.

(1) Description of Housing 100

Referring to FIGS. 1 to 4, the clothes treating machine 10 according to the embodiment of the present disclosure includes the housing 100.

The housing 100 defines appearance of the clothes treating machine 10. A predetermined inner space S is formed inside the housing 100. Various components for treating clothes by the clothes treating machine 10 may be accommodated in the predetermined inner space S. For example, a compressor (not illustrated) for a clothes treating process related to heat transfer, such as a drying treatment, may be accommodated in the inner space, in addition to components to be described later.

Inside and outside of the housing 100 may communicate with each other. Accordingly, a fluid, namely, wash water in one embodiment, required for treating clothes may be introduced into the housing 100.

To this end, a hose member (not illustrated) communicating the inside and the outside of the housing 100 with each other may be provided. One side of the hose member (not illustrated) may be inserted into the housing 100 and another side of the hose member may be connected to a faucet or the like.

The inside and outside of the housing 100 may be electrically connected to each other. Accordingly, power for operating the clothes treating machine 10 can be supplied. For example, as power is supplied, a drum 171 may be rotated to treat clothes.

The housing 100 includes a housing frame 110, a front surface 120, a rear surface 130, side surfaces 140, a door unit 150, a manipulation unit 160, a tub 170, and a drum 171.

The housing frame 110 forms a framework of the housing 100. The housing frame 110 may include a top surface, the front surface 120, the rear surface 130, the side surfaces 140, and the like defining an outer surface of the housing 100.

In addition, the housing frame 110 may be coupled with the door unit 150 for a user to input clothes, etc., the manipulation unit 160 for controlling the clothes treating machine 10, and the like.

Figure 3:
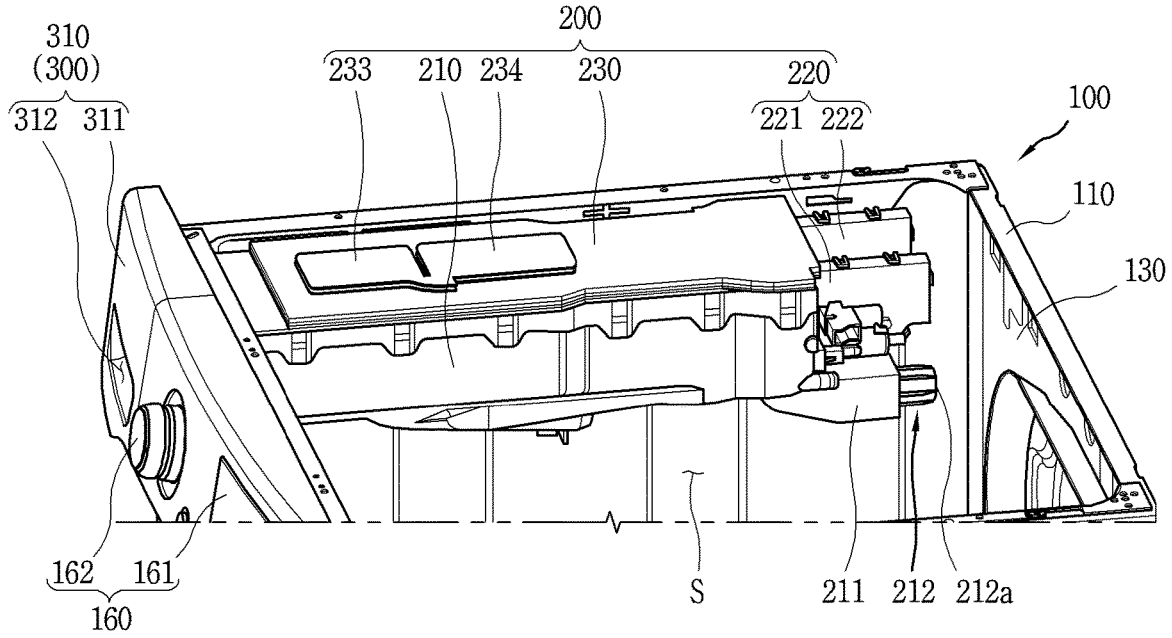
FIGS. 3 and 4 are open perspective views illustrating an inner upper side of the clothes treating machine of FIG. 1.
Figure 4:
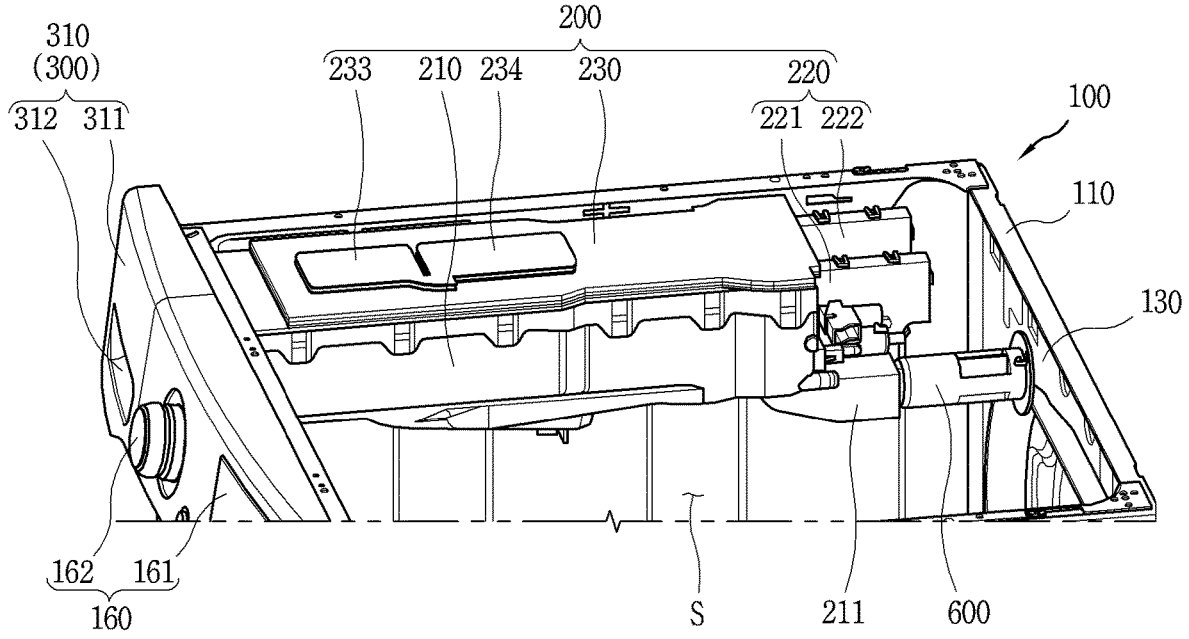
Figure 5:
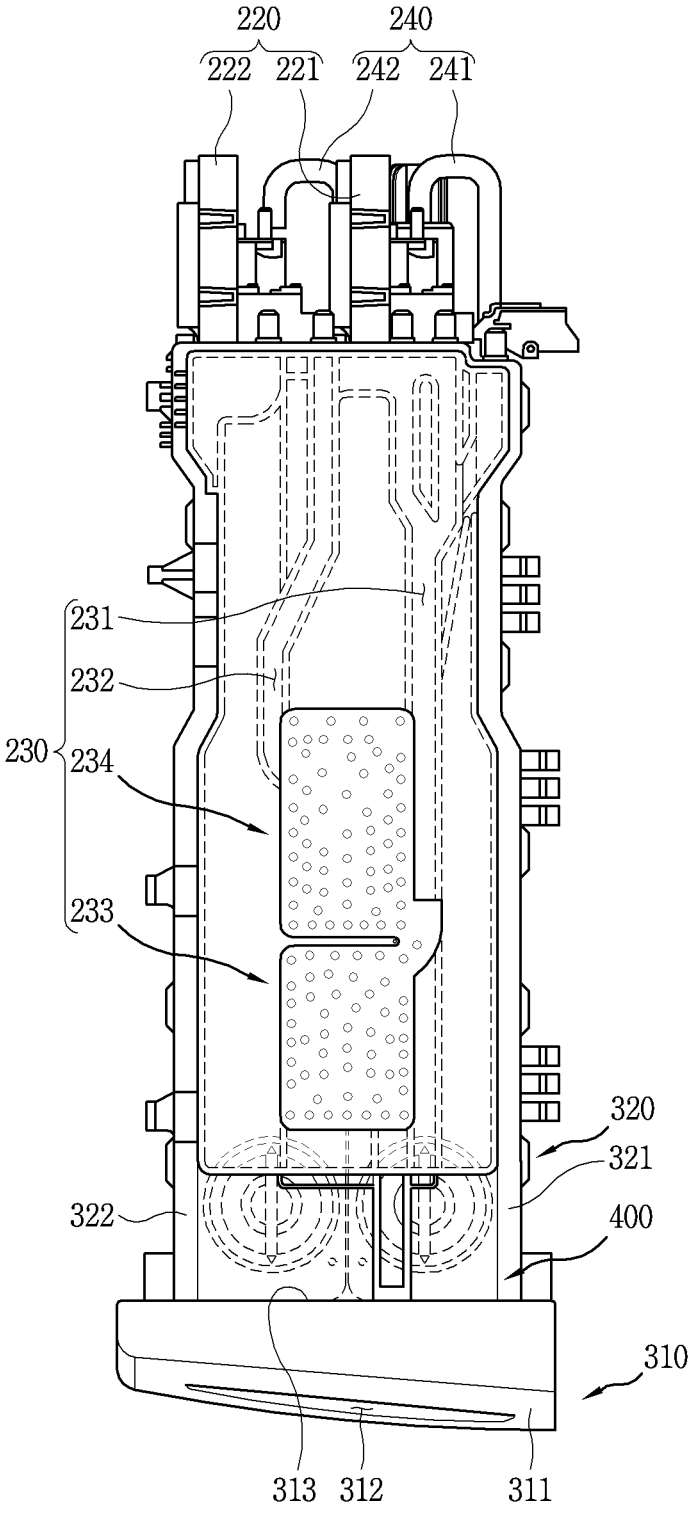
FIG. 5 is a planar view illustrating a dispenser assembly provided in the clothes treating machine of FIG. 1.

As illustrated in FIGS. 3 and 4, the housing frame 110 may defines the predetermined inner space S. That is, the housing frame 110 defines edges of the predetermined inner space S.

The top surface, the front surface 120, the rear surface 130, and the side surfaces 140 may be coupled to the housing frame 110, so that the predetermined inner space S can be defined as a closed space to be opened by the door unit 150.

The dispenser assembly 200 may be coupled to the housing frame 110. The dispenser assembly 200 is located in the predetermined inner space S. One side, namely, a right side of the dispenser assembly 200 and a part of an upper side of the dispenser assembly 200 may be fixedly coupled to the housing frame 110.

In addition, as will be described later, the clothes treating machine 10 according to the embodiment of the present disclosure includes the support member 600. The support member 600 is coupled through the rear surface 130 of the housing 100.

The support member 600 may be coupled to a rear protrusion 212 of the dispenser assembly 200. With the configuration, the dispenser assembly 200 can be stably supported. This will be described in detail later.

The front surface 120 defines one side of the housing 100, namely, the front side in the illustrated embodiment. The front surface 120 may be coupled to the housing frame 110.

The front surface 120 may be formed smaller than a space defined by the front of the housing frame 110. This results from that the manipulation unit 160 and the drawer 300 are also provided on the front of the housing 100.

An opening may be formed inside the front surface 120. The door unit 150 may be rotatably coupled to the opening.

The drawer 300 and the manipulation unit 160 are located on an upper portion of the front surface 120. In the embodiment, the drawer 300 is located on a right side, and the manipulation unit 160 is located on a left side.

The rear surface 130 defines one side of the housing 100, namely, the rear side in the illustrated embodiment. The rear surface 130 may be coupled to the housing frame 110.

The rear surface 130 is provided with a plurality of through holes. A conductor member (not illustrated) for electrically connecting an external power source and internal components of the clothes treating machine 10 may be inserted through any of the through holes. In addition, a hose member (not illustrated) for communicating an external water pipe with internal components of the clothes treating machine 10 may be inserted through any of the through holes.

In addition, heat and air may be sucked or discharged through the through holes. Accordingly, a clothes treating process related to heat transfer or a clothes treating process by air may be performed.

Figure 24:
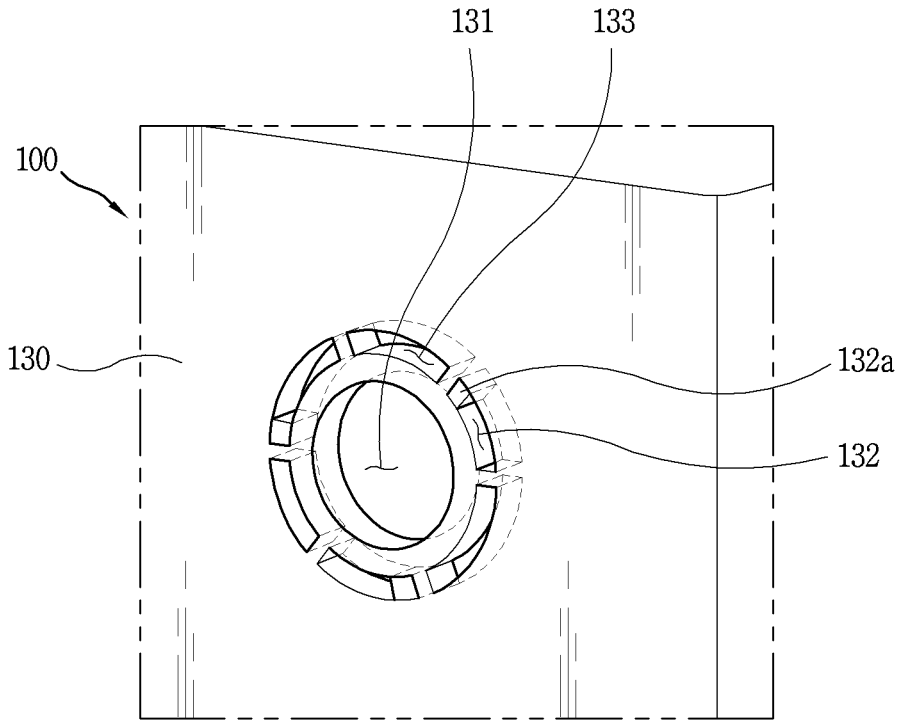
FIG. 24 is a rear perspective view illustrating a rear surface before the support member of FIG. 16 is coupled to the housing.

The rear surface 130 includes a support member insertion hole 131, a support member coupling hole 132, and a support member guide hole 133 (see FIG. 24).

A support body portion 610 of the support member 600 is coupled through the support member insertion hole 131. The support member insertion hole 131 is formed through the rear surface 130.

As will be described later, the support body portion 610 is formed to have a circular cross section, and the support member insertion hole 131 is also formed to have a circular cross section.

The support member 600 inserted into the support member insertion hole 131 may be rotated by a predetermined distance. Accordingly, a coupling protrusion 641 of the support member 600 may be fitted in the support member coupling hole 132.

The support member coupling hole 132 and the support member guide hole 133 are formed along a radially outer side of the support member insertion hole 131.

The coupling protrusion 641 of the support member 600 is inserted through the support member coupling hole 132. The support member coupling hole 132 is formed through the rear surface 130.

The support member coupling hole 132 is configured to prevent the support member 600 coupled to the rear surface 130 from being arbitrarily separated from the rear surface 130.

The coupling protrusion 641 inserted into the support member coupling hole 132 is moved in response to the rotation of the support member 600. The coupling protrusion 641 may be moved by a predetermined distance while being inserted into the support member coupling hole 132.

To this end, the support member coupling hole 132 may be formed in an arcuate shape having a predetermined length.

In the embodiment, the support member coupling hole 132 is provided in plurality spaced apart from the support member insertion hole 131 by a predetermined distance. The plurality of support member coupling holes 132 is spaced apart from one another by predetermined distances. In addition, the plurality of support member coupling holes 132 is arranged in a circumferential direction radially outside the support member insertion hole 131.

The support member guide hole 133 is located between the neighboring support member coupling holes 132. That is, the support member coupling holes 132 and the support member guide holes 133 are alternately formed along the circumferential direction radially outside the support member insertion hole 131.

In the embodiment, the support member coupling holes 132 are provided by three in number. The number of support member coupling holes 132 may change to correspond to the number of coupling protrusions 641 of the support member 600.

A support member coupling portion 132*a* is formed on one end portion of each support member coupling hole 132 in the circumferential direction. The support member coupling portion 132*a* may be engaged with the coupling protrusion 641.

That is, the coupling protrusion 641 is inserted into one side of the support member coupling hole 132 where the support member coupling portion 132*a* is not formed, and then rotated to be fitted in the support member coupling portion 132*a*.

When the coupling protrusion 641 is brought into contact with the supporting member coupling portion 132*a*, an arbitrary rotation of the support member 600 can be prevented. That is, the coupling protrusion 641 and the support member coupling portion 132*a* are not arbitrarily spaced apart from each other.

A guide protrusion 643 of the support member 600 is inserted into the support member guide hole 133. The support member guide hole 133 is formed through the rear surface 130.

The support member guide hole 133 is configured to guide the rotation of the support member 600.

The guide protrusion 643 inserted into the support member guide hole 133 is moved in response to the rotation of the support member 600. The guide protrusion 643 may be moved by a predetermined distance while being inserted in the support member guide hole 133.

To this end, the support member guide hole 133 may be formed in an arcuate shape having a predetermined length.

In the embodiment, the support member guide hole 133 is provided in plurality spaced apart from the support member insertion hole 131 by a predetermined distance. The plurality of support member guide holes 133 is spaced apart from one another by predetermined distances. In addition, the plurality of support member coupling holes 132 is arranged in a circumferential direction radially outside the support member insertion hole 131.

The support member coupling hole 132 is located between the neighboring support member guide holes 133. That is, the support member guide holes 133 and the support member coupling holes 132 are alternately formed along the circumferential direction radially outside the support member insertion hole 131.

In the embodiment, the support member guide holes 133 are provided by three in number. The number of support member guide holes 133 may change to correspond to the number of guide protrusions 643 of the support member 600.

The side surfaces 140 form both surfaces of the housing 100, namely, left and right surfaces in the embodiment. The side surfaces 140 may be coupled to the housing frame 110.

Handle portions (not illustrated) may be provided on the side surfaces 140. The user can easily move the clothes treating machine 10 by gripping the handle portions (not illustrated).

The front surface 120 and the side surfaces 140 may be configured to seal the front, left, and right sides of the clothes treating machine 10.

The door unit 150 is configured to open or close a front opening of the drum 171. When the door unit 150 is opened, the opening of the drum 171 is exposed. The user may put clothes and the like to be treated into the drum 171 through the exposed opening.

The door unit 150 is located below the manipulation unit 160 and the drawer 300. In addition, the door unit 150 is coupled to the front surface 120 to be opened and closed. Specifically, the door unit 150 is coupled to the opening formed through the front surface 120. In one embodiment, the door unit 150 may be coupled to the front surface 120 by a hinge.

The door unit 150 includes a door frame 151, a window 152, and a handle 153.

The door frame 151 defines an outer side of the door unit 150. The door frame 151 may support the window 152 from outside. In addition, the handle 153 may be disposed between the door frame 151 and the window 152. The door frame 151 may cover a part of the front surface 120.

The window 152 is located inside the door frame 151.

The window 152 is a portion that allows the user to visually recognize a state inside the drum 171. The window 152 may be formed of a transparent material. In one embodiment, the window 152 may be formed of tempered glass or the like.

The handle 153 is located between the window 152 and the door frame 151.

The handle 153 is a portion that is gripped by the user to open the door unit 150. In the embodiment, the handle 153 is disposed to be relatively adjacent to the left side of the door unit 150. The position of the handle 153 may be determined as an arbitrary position at which the user can grip the handle 153 to open the door unit 150.

A power signal for the user to operate the clothes treating machine 10 is applied to the manipulation unit 160. In addition, a control signal related to a clothes treating process is applied to the manipulation unit 160 by the user.

The manipulation unit 160 is electrically connected to each component of the clothes treating machine 10. For example, the manipulation unit 160 is electrically connected to the tub 170, the dispenser assembly 200, and the like.

A power signal and a control signal applied to the manipulation unit 160 are transmitted to each component of the clothes treating machine 10. Accordingly, the clothes can be treated according to a treatment method selected by the user.

The manipulation unit 160 is located above the front surface 120 and the door unit 150. This is to enable the user to apply a power signal and a control signal through the manipulation unit 160 without bending his/her waist.

In addition, the manipulation unit 160 is located at the left side of the dispenser assembly 200 and the drawer 300. Since the user is often a right-handed person, the manipulation unit 160 allows the user to conveniently apply a power signal and a control signal with a right hand.

The manipulation unit 160 includes a display module 161, a dial module 162, a manipulation button module 163, and an operation button module 164.

The display module 161 is configured to output a power signal and a control signal input by the user.

The display module 161 may output visualization information related to the signals. In one embodiment, the display module 161 may be configured as a liquid crystal display (LCD) or a light emitting diode (LED).

The user may recognize a clothes treating process corresponding to the input power signal and control signal through the display module 161. In addition, the user may recognize a currently-ongoing clothes treating process and a remaining time through the display module 161.

The dial module 162 is rotated by the user to receive a control signal related to a clothes treating process to be performed. In one embodiment, the clothes treating process selected by the dial module 162 may be washing, rinsing, dehydration, drying, sterilization, and the like.

The manipulation button module 163 is pressed by the user so that a control signal related to a clothes treating process to be performed is input. In one embodiment, the clothes treating process selected by the manipulation button module 163 may be additional rinsing, additional dehydration, reserved washing, and the like.

The manipulation button module 163 may include a plurality of buttons. Each button may be assigned a specific clothes treating process. That is, when the user wants to select a specific clothes treating process, the user can input a control signal by pressing at least one of the buttons.

The operation button module 164 is pressed by the user so that a power signal for applying or cutting off power to the clothes treating machine 10 is input. In addition, the operation button module 164 receives a control signal for proceeding or temporarily stopping a selected clothes treating process.

The operation button module 164 may include a plurality of buttons. A power signal may be input to any one of the buttons. Also, a control signal may be input to another button.

The tub 170 and the drum 171 are located in the predetermined inner space S of the housing 100.

The tub 170 is in communication with the dispenser assembly 200. A clothes treatment agent may be supplied from the dispenser assembly 200 to the tub 170. In addition, a fluid for washing may be supplied from the dispenser assembly 200 to the tub 170.

The drum 171 is provided inside the tub 170.

Clothes to be treated is introduced into the drum 171. When the door unit 150 is opened, an opening formed through one side of the drum 171, namely, the front side in the embodiment is opened. The user may put clothes and the like into the drum 171 through the opening.

The drum 171 is rotatably disposed in the tub 170. When a control signal for operating the clothes treating machine 10 is applied by the manipulation unit 160 or the like, the drum 171 may be rotated according to the control signal.

To this end, the tub 170 and the drum 171 may be electrically connected to the manipulation unit 160. A conductor member (not illustrated) may be provided for the electric connection.

The tub 170 and the drum 171 may be in communication with each other. The clothes treatment agent and fluid supplied to the tub 170 may flow into the drum 171. To this end, the drum 171 may be provided with a plurality of through holes (not illustrated) on an outer circumferential surface thereof, so that inside and outside of the drum 171 can communicate with each other.

Figure 1:
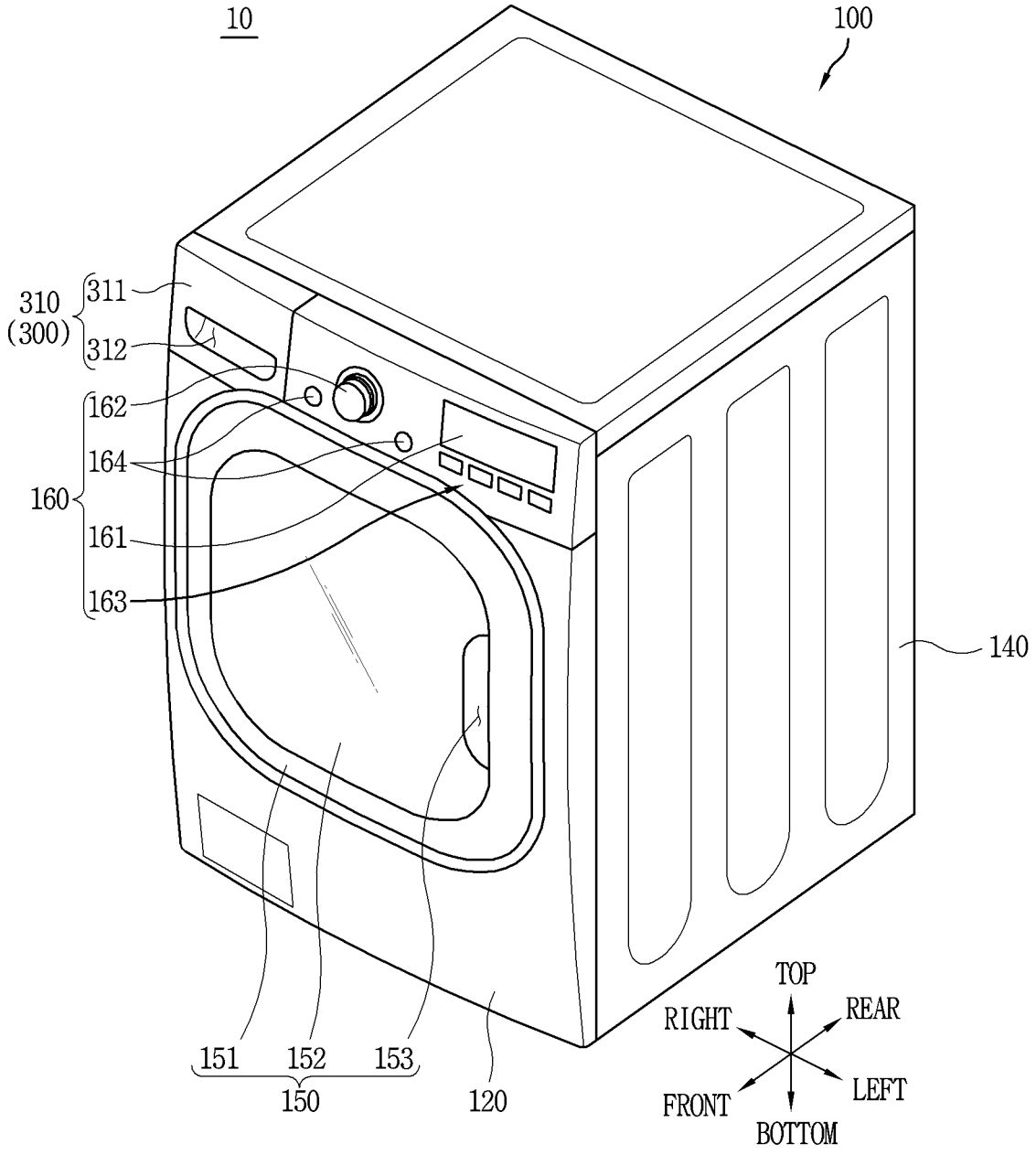
FIG. 1 is a perspective view illustrating appearance of a clothes treating machine in accordance with an embodiment of the present disclosure.
Figure 2:
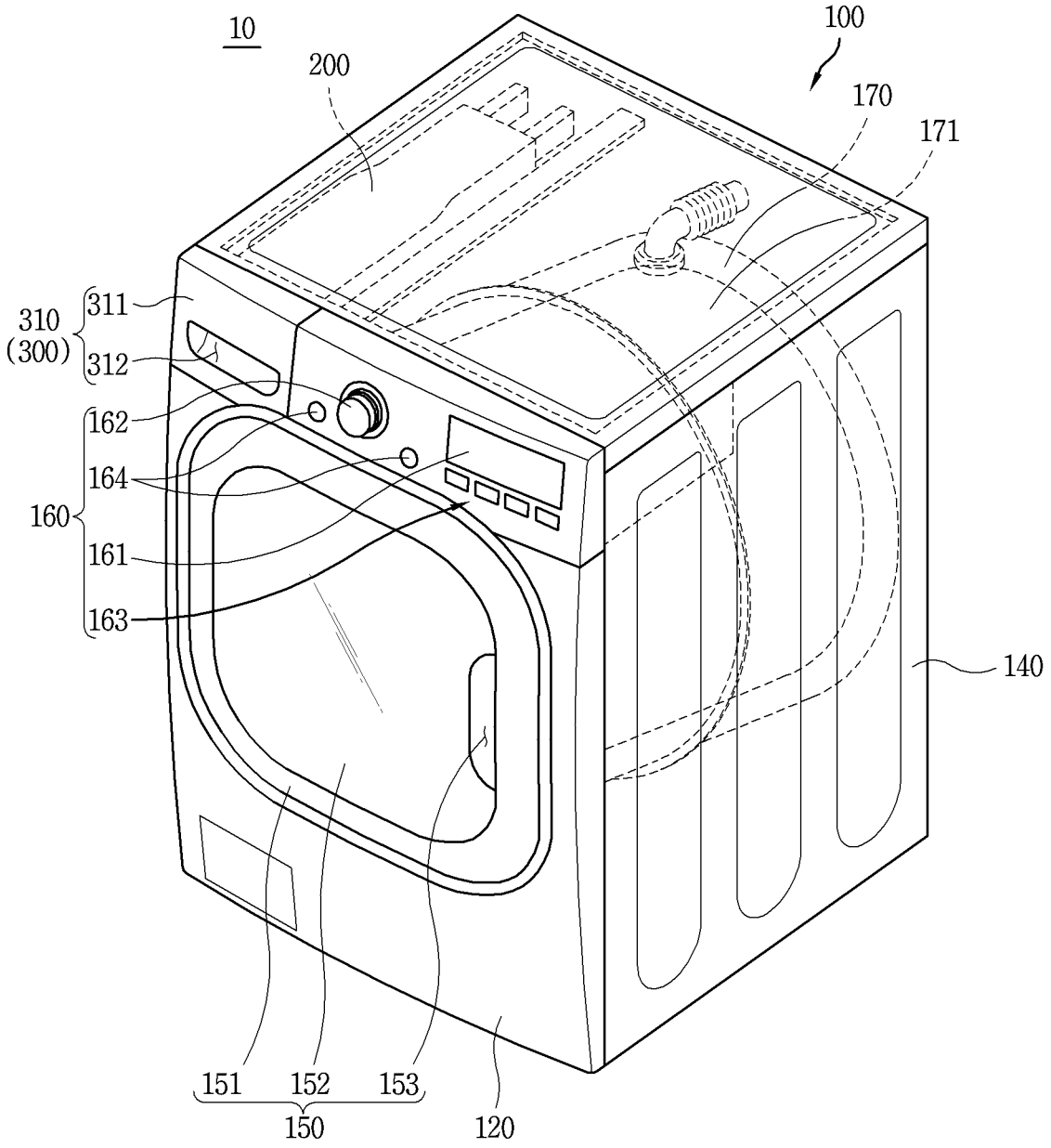
FIG. 2 is a perspective view illustrating the interior of the clothes treating machine of FIG. 1.

In the embodiment, the tub 170 and the drum 171 have a circular cross section, and extend in a lengthwise direction, that is, in a back and forth direction in FIGS. 1 and 2. That is, the tub 170 and the drum 171 have a cylindrical shape with a space formed therein.

The tub 170 and the drum 171 may have any shape capable of accommodating clothes and the like therein and treating the same.

(2) Description of Dispenser Assembly 200

Referring to FIGS. 2 to 5, the clothes treating machine 10 according to the embodiment of the present disclosure includes the dispenser assembly 200.

A predetermined space may be defined inside the dispenser assembly 200. The drawer 300 is inserted into the predetermined space.

The dispenser assembly 200 is electrically connected to the manipulation unit 160. A power signal and a control signal input through the manipulation unit 160 may be transmitted to the dispenser assembly 200.

The dispenser assembly 200 may supply the clothes treatment agent to the tub 170 according to the input power signal and control signal. In addition, the dispenser assembly 200 may supply a fluid for treating clothes to the tub 170. To this end, the dispenser assembly 200 is in communication with the tub 170.

The dispenser assembly 200 is in communication with an external fluid supply unit (not illustrated). The dispenser assembly 200 may receive the fluid from the fluid supply unit (not illustrated) according to the input power signal and control signal.

The dispenser assembly 200 is in communication with the drawer 300. The clothes treatment agent introduced into the drawer 300 may be supplied to the tub 170 together with the fluid through the dispenser assembly 200.

The dispenser assembly 200 communicates with the storage unit 400. The clothes treatment agent stored in the storage unit 400 may be supplied together with the fluid to the tub 170 through the dispenser assembly 200.

The dispenser assembly 200 is accommodated in the inner space S of the housing 100. One side, namely, a left side and an upper side of the dispenser assembly 200 may be coupled to the housing frame 110.

One side of the dispenser assembly 200, namely, a rear side in the embodiment may be supported by the support member 600. This will be described in detail later.

A predetermined space is defined in the dispenser assembly 200. In addition, an opening is formed through one side of the dispenser assembly 200, namely, the front side in the embodiment. The drawer 300 is inserted into the predetermined space through the opening.

When the drawer 300 is inserted into the predetermined space, check valves 416 and 426 of the storage unit 400 accommodated in the drawer 300 communicate with clothes treatment agent pumps 221 and 222, respectively. Accordingly, the clothes treatment agent stored in the storage unit 400 may be supplied to the tub 170 through the respective clothes treatment agent pumps 221 and 222 via the drawer 300.

The dispenser assembly 200 includes a frame unit 210, a clothes treatment agent pump unit 220, a fluid supply unit 230, and a clothes treatment agent supply unit 240.

The frame unit 210 defines an outer side of the dispenser assembly 200. In addition, the frame unit 210 forms a framework of the dispenser assembly 200.

The frame unit 210 is coupled to the housing frame 110. Specifically, in the embodiment, right and front sides of the frame unit 210 are coupled to the housing frame 110.

The frame unit 210 extends in a lengthwise direction. This results from that the drawer 300 inserted into the predetermined space of the frame unit 210 extends in the lengthwise direction.

An opening is formed through one side of the frame unit 210, namely, a front side in the embodiment. The drawer 300 may be inserted through the opening.

A predetermined space is defined inside the frame unit 210. The inserted drawer 300 is accommodated in the predetermined space.

The clothes treatment agent pump unit 220 is located at another side of the frame unit 210 opposite to the one side in the lengthwise direction, namely, at the rear side in the embodiment.

In addition, although not illustrated, the rear side of the frame unit 210 may communicate with an external fluid supply unit (not illustrated). The rear side of the frame unit 210 may also be electrically connected to the manipulation unit 160.

The fluid supply unit 230 and the clothes treatment agent supply unit 240 are provided on one side of the frame unit 210, namely, on an upper side in the embodiment.

A fluid supplied from an external fluid supply unit (not illustrated) may be supplied to the drawer 300 accommodated in the predetermined space of the frame unit 210 through the fluid supply unit 230. In one embodiment, the external fluid supply unit (not illustrated) may be a water pipe or the like.

In addition, the clothes treatment agent accommodated in the storage unit 400 may be moved into the dispenser assembly 200 by the clothes treatment agent pump unit 220. Such a clothes treatment agent may then be supplied to the tub 170 through an opening formed through a lower side of the dispenser assembly 200.

The lower side of the frame unit 210 may be in communication with the tub 170. The fluid and clothes treatment agent introduced into the drawer 300 may be supplied to the tub 170 through the frame unit 210.

The frame unit 210 includes a lower body portion 211 and a rear protrusion 212.

The lower body portion 211 is disposed on a lower side of the frame unit 210. Specifically, the lower body portion 211 protrudes rearward from one side of the frame unit 210, namely, from a rear lower side of the frame unit 210 in the embodiment.

A predetermined space may be defined inside the lower body portion 211.

The rear protrusion 212 protrudes from one side of the lower body portion 211, namely, from the rear side of the lower body portion 211 in the embodiment. In the embodiment, the rear protrusion 212 has a circular cross section. Also, a tooth portion 212*a* is provided in plurality on an outer circumference of the rear protrusion 212 in a manner of being spaced apart from one another by predetermined distances in the circumferential direction.

By forming the tooth portions 212*a*, a weight of the rear protrusion 212 can be reduced. In addition, as the tooth portions 212*a* are formed, rigidity of the rear protrusion 212 in the lengthwise direction can increase.

The rear protrusion 212 may be inserted into the support member 600.

Accordingly, both sides of the dispenser assembly 200, namely, front and right sides of the dispenser assembly 200 in the embodiment are supported by the housing frame 110. In addition, one side of the dispenser assembly 200, namely, the rear side of the dispenser assembly 200 in the embodiment is supported by the support member 600.

Accordingly, the dispenser assembly 200 can be stably supported. Furthermore, the coupled state between the dispenser assembly 200 and the housing 100 can be stably maintained.

The clothes treatment agent pump unit 220 supplies a transfer force for transferring the clothes treatment agent accommodated in the storage unit 400 to the clothes treatment agent supply unit 240.

The clothes treatment agent pump unit 220 may be provided in any shape capable of generating a transfer force for moving a fluid from one position to another.

The clothes treatment agent pump unit 220 is located on one side of the dispenser assembly 200, namely, on the rear side in the embodiment. The clothes treatment agent pump unit 220 may be provided at any position where it may not affect the insertion and removal of the drawer 300.

The clothes treatment agent pump unit 220 is in communication with the clothes treatment agent supply unit 240. The clothes treatment agent accommodated in the storage unit 400 may flow to the clothes treatment agent supply unit 240 through the clothes treatment agent pump unit 220.

The clothes treatment agent pump unit 220 communicates with the drawer 300.

The clothes treatment agent accommodated in the storage unit 400 may flow to the tub 170 sequentially via the clothes treatment agent pump unit 220, the clothes treatment agent supply unit 240, and a fluid outlet port 359 of the drawer 300.

The clothes treatment agent pump unit 220 communicates with the storage unit 400. When the storage unit 400 is accommodated in the drawer 300 and inserted into the dispenser assembly 200, check valves 416 and 426 of the storage unit 400 communicate with pump valves 224 and 225, respectively.

The clothes treatment agent pump unit 220 may be provided in plurality. In the embodiment, the clothes treatment agent pump unit 220 includes a first clothes treatment agent pump 221 provided on a rear left side, and a second clothes treatment agent pump 222 provided on a rear right side to be adjacent to the first clothes treatment agent pump 221.

The first clothes treatment agent pump 221 communicates with a first storage container 410 of the storage unit 400. The clothes treatment agent accommodated in the first storage container 410 may receive a transfer force by the first clothes treatment agent pump 221.

The first clothes treatment agent pump 221 communicates with a first clothes treatment agent flow path 241 of the clothes treatment agent supply unit 240. The clothes treatment agent discharged from the first storage container 410 may flow to the first clothes treatment agent flow path 241 by the first clothes treatment agent pump 221.

The second clothes treatment agent pump 222 communicates with the second storage container 420 of the storage unit 400. The clothes treatment agent accommodated in the second storage container 420 may receive a transfer force by the second clothes treatment agent pump 222.

The second clothes treatment agent pump 222 communicates with a second clothes treatment agent flow path 242 of the clothes treatment agent supply unit 240. The clothes treatment agent discharged from the second storage container 420 may flow to the second clothes treatment agent flow path 242 by the second clothes treatment agent pump 222.

Figure 19:
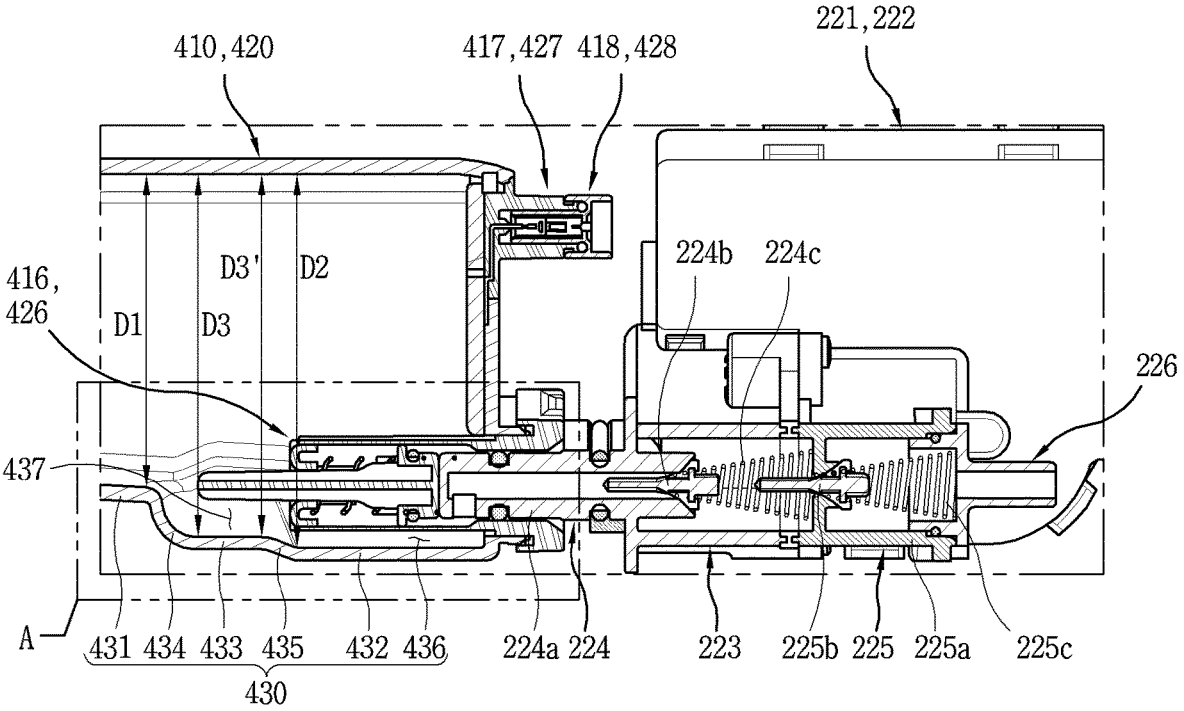
FIG. 19 is a cross-sectional view illustrating a state in which a clothes treatment agent is prevented from remaining by the structure of the storage container of FIG. 11.

Further referring to FIG. 19, the clothes treatment agent pump unit 220 includes a pump valve coupling portion 223, a primary pump valve 224, a secondary pump valve 225, and a discharge portion 226. Those components may be provided in the first clothes treatment agent pump 221 and the second clothes treatment agent pump 222, respectively.

The pump valve coupling portion 223 is a passage through which the clothes treatment agent discharged from the storage unit 400 flows into the inner space of the clothes treatment agent pump unit 220.

The pump valve coupling portion 223 is located between the primary pump valve 224 and the secondary pump valve 225.

A hollow portion is formed inside the pump valve coupling portion 223. The clothes treatment agent accommodated in the storage unit 400 may flow through the hollow portion. In addition, the primary pump valve 224 and the secondary pump valve 225 are partially accommodated in the hollow portion.

The pump valve coupling portion 223 communicates with the primary pump valve 224.

One side of the primary pump valve 224, namely, a rear side in the embodiment is partially accommodated in the pump valve coupling portion 223. An inner circumference of the one side of the pump valve coupling portion 223 facing the primary pump valve 224, namely, an inner circumference of a front side of the pump valve coupling portion 223 in the embodiment may be hermetically coupled to the primary pump valve 224.

The pump valve coupling portion 223 communicates with the secondary pump valve 225. One side of the secondary pump valve 225, namely, a front side in the embodiment is partially accommodated in the pump valve coupling portion 223.

The primary pump valve 224 and the secondary pump valve 225 may communicate with each other through the pump valve coupling portion 223.

One side of the pump valve coupling portion 223 facing the secondary pump valve 225, namely, a rear side in the embodiment is coupled to the secondary pump valve 225 having an opening. The secondary pump valve 225 may hermetically seal or close the opening. Accordingly, the flow of the clothes treatment agent is allowed or blocked.

As described above, the primary pump valve 224 is located at the front of the pump valve coupling portion 223. In addition, the secondary pump valve 225 is located at the rear side of the pump valve coupling portion 223.

That is, the clothes treatment agent pump unit 220 may allow or block the flow of the clothes treatment agent by such dual pump valves 224 and 225. This may result in preventing a leakage of the clothes treatment agent accommodated in the storage unit 400.

Each of the primary pump valve 224 and the secondary pump valve 225 may be provided in any shape that is opened or closed according to a pressure difference between one side and another side opposite to the one side. In one embodiment, the primary pump valve 224 and the secondary pump valve 225 may be provided in the form of a check valve.

The primary pump valve 224 is configured to allow or block communication between the first storage container 410 and the clothes treatment agent pump unit 220. The primary pump valve 224 may be opened or closed according to a pressure difference between the inner space of the storage container 410, 420 and the inner space of the clothes treatment agent pump unit 220.

The primary pump valve 224 is located between the storage container 410, 420 and the clothes treatment agent pump unit 220.

Specifically, one side of the primary pump valve 224, namely, the front side in the embodiment is inserted into a hollow portion of a check valve cylinder portion 416*a*, 426*a* of the check valve 416, 426. In addition, another side of the primary pump valve 224 opposite to the one side, namely, the rear side in the embodiment is accommodated in the pump valve coupling portion 223 of the clothes treatment agent pump unit 220.

The front side of the primary pump valve 224 is in contact with one side of a check valve cap portion 416*b*, 426*b* of the check valve 416, 426, namely, a rear side of the check valve cap portion in the embodiment.

When the storage container 410, 420 accommodated in the drawer 300 is coupled to the dispenser assembly 200, the primary pump valve 224 pushes the check valve cap portion 416*b*, 426*b* of the check valve 416, 426 to one side, namely, to the front side in the embodiment. Accordingly, the check valve cylinder portion 416*a*, 426*a* of the check valve 416, 426 communicates with the inner space of the storage container 410, 420.

The rear side of the primary pump valve 224 is partially accommodated in the pump valve coupling portion 223 so that their insides communicate with each other. In addition, the primary pump valve 224 is hermetically coupled to the pump valve coupling portion 223.

When the clothes treatment agent pump unit 220 is operated, a primary valve cap portion 224*b* of the primary pump valve 224 is moved to one side, namely, to the rear side in the embodiment, so that the inner space of the primary pump valve 224 and the inner space of the pump valve coupling portion 223 can communicate with each other.

With the configuration, the clothes treatment agent accommodated in the storage container 410, 420 can be introduced into the inner space of the clothes treatment agent pump unit 220.

The primary pump valve 224 includes a primary valve cylinder portion 224*a*, a primary valve cap portion 224*b*, a primary valve elastic portion 224*c*, and an inlet port 224*d*.

The primary valve cylinder portion 224*a* defines an outer side of the primary pump valve 224.

One side of the primary valve cylinder portion 224*a*, namely, a front side thereof in the embodiment is closed. Another side of the primary valve cylinder portion 224*a*, namely, a rear side thereof in the embodiment is opened. The opened rear side may be opened or closed by the primary valve cap portion 224*b*. With the configuration, the communication between the clothes treatment agent pump unit 220 and the storage container 410, 420 may be allowed or blocked.

The front side of the primary valve cylinder portion 224*a* is inserted into the hollow portion of the check valve cylinder portion 416*a*, 426*a*. At this time, a sealing member may be provided on a coupled portion between the primary valve cylinder portion 224*a* and the check valve cylinder portion 416*a*, 426*a* to prevent a leakage through the coupled portion.

The rear side of the primary valve cylinder portion 224*a* is inserted into the pump valve coupling portion 223. An outer circumferential surface of the rear side of the primary valve cylinder portion 224*a* may be hermetically coupled to an inner circumferential surface of the front side of the pump valve coupling portion 223.

The primary valve cylinder portion 224*a* extends in the lengthwise direction. In the embodiment, the primary valve cylinder portion 224*a* is formed in a cylindrical shape which has a circular cross section and extends in the lengthwise direction.

A hollow portion is formed inside the primary valve cylinder portion 224*a*. The hollow portion penetrates through the primary valve cylinder portion 224*a* in the lengthwise direction from a portion, which is spaced a predetermined distance apart from the front side, to the rear side. The clothes treatment agent accommodated in the storage container 410, 420 may flow along the hollow portion.

One side of the primary valve cylinder portion 224*a*, namely, the front side thereof in the embodiment is in contact with a rear end portion of the check valve cap portion 416*b*, 426*b* of the check valve 416, 426. When the storage container 410, 420 accommodated in the drawer 300 is inserted into the dispenser assembly 200, the primary valve cylinder portion 224*a* may push the check valve cap portion 416*b*, 426*b*.

Accordingly, an intake port 416*d*, 426*d* formed through the check valve cylinder portion 416*a*, 426*a* is opened. As a result, the inner space of the check valve cylinder portion 416*a*, 426*a* and the inner space of the storage container 410, 420 may communicate with each other.

The primary valve cap portion 224*b* is configured to allow or block the communication between the inner space of the primary valve cylinder portion 224*a* and the inner space of the pump valve coupling portion 223.

The primary valve cap portion 224*b* may be provided with a body portion having a diameter corresponding to a diameter of the opening formed on the rear side of the primary valve cylinder portion 224*a*, and extending in the lengthwise direction. When the body portion is inserted into the opening, the communication between the inside of the primary valve cylinder portion 224*a* and the inside of the pump valve coupling portion 223 may be blocked.

The primary valve cap portion 224*b* may be moved in the lengthwise direction, namely, in the back and forth direction in the embodiment.

In a state where a transfer force by the clothes treatment agent pump unit 220 is not applied, the primary valve cap portion 224*b* closes the opening formed on the rear side of the primary valve cylinder portion 224*a*.

To this end, one side of the primary valve cap portion 224*b*, namely, the rear side thereof in the embodiment is elastically supported by the primary valve elastic portion 224*c*.

In addition, when the transfer force by the clothes treatment agent pump unit 220 is applied, the primary valve cap portion 224*b* opens the opening of the primary valve cylinder portion 224*a*. That is, the primary valve cap portion 224*b* may be moved to the rear side by the transfer force which exceeds an elastic force by the primary valve elastic portion 224*c*.

The primary valve elastic portion 224*c* elastically supports the primary valve cap portion 224*b*. The primary valve elastic portion 224*c* can prevent an arbitrary movement of the primary valve cap portion 224*b* in the lengthwise direction.

The primary valve elastic portion 224*c* is located on one side of the primary valve cap portion 224*b* in the lengthwise direction, namely, on the rear side thereof in the embodiment.

One side of the primary valve elastic portion 224*c*, namely, the front side thereof in the embodiment may be in contact with the rear end portion of the primary valve cap portion 224*b*. In addition, another side of the primary valve elastic portion 224*c*, namely, the rear side thereof in the embodiment may be in contact with an inner circumference of the front side of the secondary valve cylinder portion 225*a*.

The primary valve elastic portion 224*c* may be provided in any form capable of applying a stored restored force to the primary valve cap portion 224*b* as the primary valve cap portion 224*b* is moved to the rear side. In one embodiment, the primary valve elastic portion 224*c* may be provided in the form of a coil spring.

The primary valve elastic portion 224*c* may have a predetermined elastic modulus. A value of the elastic modulus is preferably determined depending on pressure required for the clothes treatment pump unit 220 to pump the clothes treatment agent from the storage unit 400.

That is, the primary valve elastic portion 224*c* may be configured so as not to be compressed by a pressure difference between the inside of the storage unit 400 and the inside of the clothes treatment agent pump unit 220 when the clothes treatment agent pump unit 220 is not operated.

In addition, the primary valve elastic portion 224*c* may be configured to be compressed by a pressure difference between the inside of the storage unit 400 and the inside of the clothes treatment agent pump unit 220 when the clothes treatment agent pump unit 220 is operated.

The inlet port 224*d* is a path through which the clothes treatment agent sucked into the check valve cylinder portion 416*a*, 426*a* flows into the primary valve cylinder portion 224*a*. The inlet port 224*d* may be formed through an outer circumference of the primary valve cylinder portion 224*a*.

The inlet port 224*d* may be formed on the front side of the primary valve cylinder portion 224*a*. When the primary valve cylinder portion 224*a* is inserted into the first check valve cylinder portion 416*a*, the inlet port 224*d* is preferably located to communicate with the inner space of the check valve cylinder portion 416*a*, 426*a*.

Accordingly, the clothes treatment agent stored in the storage unit 400 is sucked into the inner space of the check valve cylinder portion 416*a*, 426*a* through the intake port 416*d*, 426*d*. Thereafter, the sucked clothes treatment agent may be introduced into the inner space of the primary valve cylinder portion 224*a* through the inlet port 224*d*.

The inlet port 224*d* may be located below the lowest portion of a first bottom surface 431. Accordingly, when the clothes treatment agent pump unit 220 is operated, the clothes treatment agent collected in a first collection space portion 436 may be smoothly introduced into the inlet port 224*d*.

With the configuration, an amount of clothes treatment agents remaining in the inner space of the storage container 410, 420 can be minimized.

The secondary pump valve 225 is configured to allow or block communication between the inner space of the pump valve coupling portion 223 and an inner space of the discharge portion 226. The secondary pump valve 225 may be opened or closed according to a pressure difference between the inner space of the pump valve coupling portion 223 and the inner space of the discharge portion 226.

The secondary pump valve 225 is located between the primary pump valve 224 and the discharge portion 226.

Specifically, one side of the secondary pump valve 225, namely, the front side thereof in the embodiment is coupled to the rear side of the pump valve coupling portion 223. In addition, the rear side of the secondary pump valve 225 is opened to communicate with the discharge portion 226.

When the clothes treatment agent pump unit 220 is operated, the secondary valve cap portion 225*b* of the secondary pump valve 225 is moved to one side, namely, to the rear side in the embodiment, so that the inner space of the secondary pump valve 225 and the inner space of the pump valve coupling portion 223 can communicate with each other.

In addition, the inner space of the secondary pump valve 225 and the inner space of the discharge portion 226*b* communicate with each other. Therefore, the clothes treatment agent can be introduced into the inner space of the discharge portion 226*b*.

The secondary pump valve 225 includes a secondary valve cylinder portion 225*a*, a secondary valve cap portion 225*b*, a secondary valve elastic portion 225*c*.

The secondary valve cylinder portion 225*a* defines an outer side of the secondary pump valve 225.

An opening is formed on one side of the secondary valve cylinder portion 225*a*, namely, an inner circumference of the front side thereof in the embodiment. The opening may be opened or closed by the secondary valve cap portion 225*b*.

When the opening is opened, the inner space of the primary valve cylinder portion 224*a* and the inner space of the secondary valve cylinder portion 225*a* may be in communication with each other. When the opening is closed, the inner space of the primary valve cylinder portion 224*a* and the inner space of the secondary valve cylinder portion 225*a* are not in communication with each other.

The opening of the secondary valve cylinder portion 225*a* may be opened or closed by the secondary valve cap portion 225*b*.

The front side of the secondary valve cylinder portion 225*a* is coupled to the pump valve coupling portion 223. A sealing member may be provided on a coupled portion between the secondary valve cylinder portion 225*a* and the pump valve coupling portion 223 to prevent a leakage of the clothes treatment agent through the coupled portion.

The rear side of the secondary valve cylinder portion 225*a* is coupled to the discharge portion 226. A sealing member may be provided on a coupled portion between the secondary valve cylinder portion 225*a* and the discharge portion 226 to prevent a leakage of the clothes treatment agent through the coupled portion.

The secondary valve cylinder portion 225*a* extends in the lengthwise direction. In the embodiment, the secondary valve cylinder portion 225*a* is formed in a cylindrical shape which has a circular cross section similar to the pump valve coupling portion 223 and extends in the lengthwise direction.

A hollow portion is formed inside the secondary valve cylinder portion 225*a*. The hollow portion penetrates from the front side to the rear side of the secondary valve cylinder portion 225*a*. The hollow portion communicates with the openings formed on the front and rear sides of the secondary valve cylinder portion 225*a*, respectively. The clothes treatment agent introduced into the pump valve coupling portion 223 may flow along the hollow portion.

The secondary valve cap portion 225*b* is configured to allow or block the communication between the inner space of the secondary valve cylinder portion 225*a* and the inner space of the pump valve coupling portion 223.

The secondary valve cap portion 225*b* may be provided with a body portion having a diameter corresponding to a diameter of the opening formed on the rear side of the secondary valve cylinder portion 225*a*, and extending in the lengthwise direction. When the body portion is inserted into the opening, the communication between the inside of the secondary valve cylinder portion 225*a* and the inside of the pump valve coupling portion 223 may be blocked.

The secondary valve cap portion 225*b* may be moved in the lengthwise direction, namely, in the back and forth in the embodiment.

In a state where a transfer force by the clothes treatment agent pump unit 220 is not applied, the secondary valve cap portion 225*b* closes the opening formed on the front side of the secondary valve cylinder portion 225*a*. To this end, one side of the secondary valve cap portion 225*b*, namely, the rear side thereof in the embodiment is elastically supported by the secondary valve elastic portion 225*c*.

In addition, when the transfer force by the clothes treatment agent pump unit 220 is applied, the secondary valve cap portion 225*b* opens the opening of the secondary valve cylinder portion 225*a*. That is, the secondary valve cap portion 225*b* may be moved to the rear side by the transfer force which exceeds an elastic force by the secondary valve elastic portion 225*c*.

The secondary valve elastic portion 225*c* elastically supports the secondary valve cap portion 225*b*. The secondary valve elastic portion 225*c* can prevent an arbitrary movement of the secondary valve cap portion 225*b* in the lengthwise direction.

The secondary valve elastic portion 225*c* is located on one side of the secondary valve cap portion 225*b* in the lengthwise direction, namely, on the rear side thereof in the embodiment.

One side of the secondary valve elastic portion 225*c*, namely, the front side thereof in the embodiment may be in contact with the rear end portion of the secondary valve cap portion 225*b*. In addition, another side of the secondary valve elastic portion 225*c*, namely, the rear side thereof in the embodiment may be in contact with an inner circumference of the front side of the discharge portion 226.

The secondary valve elastic portion 225*c* may be provided in any form capable of applying a stored restored force to the secondary valve cap portion 225*b* as the secondary valve cap portion 225*b* is moved to the rear side. In one embodiment, the secondary valve elastic portion 225*c* may be provided in the form of a coil spring.

The secondary valve elastic portion 225*c* may have a predetermined elastic modulus. A value of the elastic modulus is preferably determined depending on pressure required for the clothes treatment pump unit 220 to pump the clothes treatment agent from the storage unit 400.

That is, the secondary valve elastic portion 225*c* may be configured so as not to be compressed by a pressure difference between the inside of the storage unit 400 and the inside of the clothes treatment agent pump unit 220 when the clothes treatment agent pump unit 220 is not operated.

In addition, the secondary valve elastic portion 225*c* may be configured to be compressed by a pressure difference between the inside of the storage unit 400 and the inside of the clothes treatment agent pump unit 220 when the clothes treatment agent pump unit 220 is operated.

The discharge portion 226 allows the secondary pump valve 225 to communicate with the clothes treatment agent supply unit 240. The discharge portion 226 is located on one side of the secondary pump valve 225, namely, on the rear side in the embodiment.

The discharge portion 226 is coupled to the secondary pump valve 225. In the embodiment, a diameter of one end portion of the secondary pump valve 225 facing the discharge portion 226 is larger than a diameter of the discharge portion 226 facing the secondary pump valve 225.

Therefore, the discharge portion 226 can be inserted into the one end portion of the secondary pump valve 225. A sealing member for preventing an arbitrary leakage of the clothes treatment agent may be provided on a portion where the discharge portion 226 and the secondary pump valve 225 are coupled to each other.

A hollow portion is formed inside the discharge portion 226. The hollow portion communicates with the inner space of the secondary valve cylinder portion 225*a*.

Specifically, the hollow portion and the inner space of the secondary valve cylinder portion 225*a* may be communicated or blocked as the secondary valve cap portion 225*b* is moved in the lengthwise direction, namely, in the back and forth direction in the embodiment.

The clothes treatment agent supply unit 240 is connected to another side of the discharge portion 226 in the lengthwise direction, namely, to the rear side of the discharge portion 226 in the embodiment. The clothes treatment agent supply unit 240 is provided with an inner space in which the clothes treatment agent flows.

The hollow portion of the discharge portion 226 may communicate with the inner space of the clothes treatment agent supply unit 240. The clothes treatment agent introduced into the discharge portion 226 may flow into the tub 170 through an opening formed through a lower side of the dispenser assembly 200 via the clothes treatment agent supply unit 240.

The fluid supply unit 230 supplies a fluid to the drawer 300. The fluid supply unit 230 may communicate with an external fluid supply unit (not illustrated). For the communication, a hose member (not illustrated) may be provided.

The fluid supply unit 230 is located above the frame unit 210. Also, the fluid supply unit 230 may communicate with the drawer 300. With the configuration, wash water may flow down to the drawer 300 by gravity even without receiving a separate transfer force.

The fluid introduced into the fluid supply unit 230 may flow to the tub 170 through the opening formed through the lower side of the dispenser assembly 200 via the drawer 300.

During the flow, the clothes treatment agent may be dissolved in the fluid.

The fluid supply unit 230 includes a first fluid flow path 231, a second fluid flow path 232, a first fluid discharge portion 233, and a second fluid discharge portion 234.

The first fluid flow path 231 allows the first fluid discharge portion 233 to communicate with an external fluid supply unit (not illustrated). Specifically, the first fluid flow path 231 is a path through which a fluid introduced from the external fluid supply unit (not illustrated) flows toward the first fluid discharge portion 233.

The second fluid flow path 232 allows the second fluid discharge portion 234 to communicate with the external fluid supply unit (not illustrated). Specifically, the second fluid flow path 232 is a path through which a fluid introduced from the external fluid supply unit (not illustrated) flows toward the second fluid discharge portion 234.

The first fluid discharge portion 233 allows the first fluid flow path 231 to communicate with the drawer 300. The fluid reaching the first fluid discharge portion 233 through the first fluid flow path 231 may be introduced into the drawer 300 through the first fluid discharge portion 233.

The first fluid discharge portion 233 may be formed in a flat plate shape having a predetermined area. In addition, a plurality of through holes may be formed through one side of the first fluid discharge portion 233 facing the drawer 300.

Therefore, the fluid introduced into the first fluid discharge portion 233 may be uniformly injected into the drawer 300.

The second fluid discharge portion 234 allows the second fluid flow path 232 to communicate with the drawer 300. The fluid reaching the second fluid discharge portion 234 through the second fluid flow path 232 may be introduced into the drawer 300 through the second fluid discharge portion 234.

The second fluid discharge portion 234 may be formed in a flat plate shape having a predetermined area. In addition, a plurality of through holes may be formed through one side of the second fluid discharge portion 234 facing the drawer 300.

Therefore, the fluid introduced into the second fluid discharge portion 234 may be uniformly injected into the drawer 300.

In the embodiment, the first fluid discharge portion 233 is located at the front side, compared with the second fluid discharge portion 234. In addition, the first fluid discharge portion 233 may have the same area as an area of a manual introduction part 340.

Also, the second fluid discharge portion 234 may have the same area as an area of a housing accommodation part 350 or a clothes treatment agent housing 500.

The clothes treatment agent supply unit 240 is a passage through which the clothes treatment agent accommodated in the storage unit 400 flows toward the opening located on the lower side of the frame unit 210.

As will be described later, the clothes treatment agent to be automatically supplied may be accommodated in the storage unit 400. The clothes treatment agent supply unit 240 allows the clothes treatment agent pump unit 220 to communicate with a lower space and the opening of the frame unit 210, so that the clothes treatment agent can be supplied to the tub 170.

Specifically, one end portion of the clothes treatment agent supply unit 240 communicates with the discharge portion 226. In addition, another end portion of the clothes treatment agent supply unit 240 communicates with a space which is defined as the lower space of the frame unit 210, namely, an inner surface of the lower side of the frame unit 210 is spaced a predetermined distance apart from the drawer 300.

The clothes treatment agent supply unit 240 may be provided in any form capable of communicating two or more different members.

In addition, the clothes treatment agent supply unit 240 may be formed of a material that can be changed in shape to some extent for facilitating the discharge portion 226 to communicate with the inner space of the frame unit 210. In one embodiment, the clothes treatment agent supply unit 240 may be provided with a hose member formed of a flexible material.

The clothes treatment agent accommodated in the storage unit 400 may be supplied to the lower space of the frame unit 210 through the clothes treatment agent supply unit 240 by the clothes treatment agent pump unit 220.

The clothes treatment agent supply unit 240 includes a first clothes treatment agent flow path 241 and a second clothes treatment agent flow path 242.

The first clothes treatment agent flow path 241 allows the discharge portion 226 provided on the first clothes treatment agent pump 221 to communicate with the lower space of the frame unit 210. The first clothes treatment agent flow path 241 may supply the clothes treatment agent accommodated in the first storage container 410 into the lower space.

The second clothes treatment agent flow path 242 allows the discharge portion 226 provided on the second clothes treatment agent pump 222 to communicate with the lower space of the frame unit 210. The clothes treatment agent accommodated in the second storage container 420 may be supplied to the lower space through the second clothes treatment agent flow path 242.

(3) Description of Drawer 300

Hereinafter, with reference to FIGS. 6 to 10, the drawer 300 provided in the clothes treating machine 10 according to the embodiment of the present disclosure will be described in detail.

The drawer 300 is filled with a clothes treatment agent, a fluid and the like for treating the clothes accommodated in the drum 171.

The user may expose the drawer 300 inserted in the dispenser assembly 200 by a predetermined distance using a grip portion 310. Thereafter, the user may put or fill the clothes treatment agent for treating clothes into the drawer 300.

In addition, the clothes treatment agent accommodated in the storage unit 400 may be automatically supplied to the drawer 300. This is achieved by the clothes treatment agent pump unit 220 and the clothes treatment agent supply unit 240 provided in the dispenser assembly 200.

The drawer 300 may be inserted into the inner space of the dispenser assembly 200. Specifically, the drawer 300 may be inserted into the inner space of the dispenser assembly 200 through an opening formed through the front side of the dispenser assembly 200.

When the drawer 300 is inserted into the dispenser assembly 200, the grip portion 310 provided on one side of the drawer 300, namely, on the front side of the drawer 300 in the embodiment is exposed to outside. The user may grip the grip portion 310 to expose the drawer 300 by a predetermined distance or detach it from the dispenser assembly 200.

A predetermined space is defined in the drawer 300. The storage unit 400 may be accommodated in the predetermined space. A clothes treatment agent to be automatically supplied for performing a clothes treating process is accommodated in the storage unit 400.

When the drawer 300 is inserted into the dispenser assembly 200, the check valve 416, 426 provided on one side of the storage unit 400 inserted into the drawer 300, namely, on the rear side of the storage unit 400, comes in contact and communicates with the primary pump valve 224.

With the configuration, the drawer 300 and the dispenser assembly 200 communicate with each other. Also, the dispenser assembly 200 communicates with the tub 170.

Accordingly, the clothes treatment agent accommodated in the storage unit 400 may be supplied to the tub 170 through the check valve 416, 426.

The drawer 300 extends in the lengthwise direction, namely, in the back and forth direction in the embodiment. The shape of the drawer 300 may change depending on the shape of the storage unit 400 inserted into the dispenser assembly 200 and the drawer 300.

The drawer 300 may be inserted into the dispenser assembly 200 in a sliding manner. Also, the drawer 300 may be slid out of the dispenser assembly 200 to be exposed by a predetermined distance or completely detached.

For a stable sliding movement of the drawer 300, guide members (not illustrated) may be provided on both sides of the drawer 300, namely, on left and right sides of the drawer 300 in the embodiment.

The drawer 300 includes a grip portion 310, a drawer frame 320, a rear end part 330, a manual introduction part 340, and a housing accommodation part 350.

The grip portion 310 is a part that a user grips to insert the drawer 300 into the dispenser assembly 200 or to pull the drawer 300 out of the dispenser assembly 200.

The grip portion 310 is located on one side of the drawer 300 in the lengthwise direction, namely, on the front side of the drawer 300 in the embodiment. When the drawer 300 is inserted into the dispenser assembly 200, the grip portion 310 is located above the front surface 120. In addition, the drawer 300 is located on a left side of the manipulation unit 160, which is for convenience of the user, as described above.

The grip portion 310 includes a front surface 311, a handle groove 312, and a rear surface 313.

The front surface 311 defines one side of the grip portion 310, namely, the front side of the grip portion 310 in the embodiment. When the drawer 300 is inserted into the dispenser assembly 200, the front surface 311 is exposed to the outside of the clothes treating machine 10.

Also, the front surface 311 is a part brought into direct contact with the user's body. Therefore, the front surface 311 is preferably formed seamlessly to prevent an occurrence of a safety accident.

The handle groove 312 is a space in which the user puts his/her fingers to grip the grip portion 310. The handle groove 312 is recessed by a predetermined distance into the front surface 311.

In the embodiment, the handle groove 312 extends in the left and right direction. This is to facilitate the fingers except for a thumb to be inserted into the groove.

The rear surface 313 defines one side of the grip portion 310, namely, the rear side of the grip portion 310 in the embodiment. When the drawer 300 is inserted into the dispenser assembly 200, the rear surface 313 may be brought into contact with the housing frame 110.

The drawer frame 320 is coupled to the rear surface 313. Accordingly, it may be said that the rear surface 313 supports the drawer frame 320.

The drawer frame 320 forms a framework of the drawer 300. The drawer frame 320 extends in the lengthwise direction, namely, in the back and forth direction in the embodiment.

One side of the drawer frame 320 in the lengthwise direction, namely, the front side thereof in the embodiment is coupled to the rear surface 313.

Another side of the drawer frame 320 in the lengthwise direction, namely, the rear side thereof in the embodiment communicates with the clothes treatment agent supply unit 220. Also, the rear side of the drawer frame 320 may be electrically connected to the manipulation unit 160.

A predetermined space is defined inside the drawer frame 320. The storage unit 400 may be detachably inserted into the space.

The drawer frame 320 includes a first outer wall 321, a second outer wall 322, an inner wall 323, a bottom portion 324, and a rear wall 325.

The first outer wall 321 defines an outer circumference of one side of the drawer frame 320 in the lengthwise direction, namely, an outer circumference of a left side in the embodiment. The first outer wall 321 extends in the lengthwise direction.

One side of the first outer wall 321 in the lengthwise direction, namely, the front side thereof in the embodiment extends up to the rear surface 313. Another side of the first outer wall 321 in the lengthwise direction, namely, the rear side in the embodiment may extend up to the rear wall 325.

The first outer wall 321 may be configured by a plurality of planes. That is, the first outer wall 321 may include a first plane adjacent to the grip portion 310, a second plane extending rearward at a predetermined angle with respect to the first plane, and a third plane extending rearward at a predetermined angle with respect to the second plane.

The second outer wall 322 is located at one side opposite to the first outer wall 321, namely, at a right side of the first outer wall 321 in the embodiment. The first outer wall 321 is spaced apart from the second outer wall 322 by a predetermined distance.

The second outer wall 322 defines an outer circumference of one side of the drawer frame 320 in the lengthwise direction, namely, an outer circumference of a right side in the embodiment. Since structure and function of the second outer wall 322 are the same as those of the first outer wall 321, repeated description will be omitted.

A first step portion 321*a* and a second step portion 322*a* may be formed respectively on one surface of the first outer wall 321 and one surface of the second outer wall 322, namely, their upper surfaces in the embodiment. The step portions 321*a* and 322*a* prevent the drawer 300 from sagging downward when the drawer 300 is exposed by a predetermined distance.

To this end, each step portion 321*a* and 322*a* may be formed at the same position in the lengthwise direction. In addition, each step portion 321*a* and 322*a* may protrude upward by a predetermined distance.

A predetermined space is defined between the first outer wall 321 and the second outer wall 322 by being surrounded by the first outer wall 321 and the second outer wall 322. The space is divided to define a manual introduction part 340 and a housing accommodation part 350.

As described above, the first outer wall 321 and the second outer wall 322 may be configured by a plurality of planes. The plurality of planes may extend from the front to rear sides at predetermined angles with respect to one another.

Accordingly, the space surrounded by the first outer wall 321 and the second outer wall 322 has different widths in the left and right direction, namely, in the back and forth direction.

In the illustrated embodiment, a space surrounded by the first planes of the respective outer walls 321 and 322 has the widest width, a space surrounded by the second planes has a smaller width than the widest width, and a space surrounded by the third planes has the smallest width.

That is, the width of the space decreases from the front to the rear of the drawer 300. This is to facilitate the drawer 300 to be pushed in and drawn out.

Each of the first outer wall 321 and the second outer wall 322 extends in the lengthwise direction, namely, in the back and forth direction in the embodiment.

One end portion of each of the first outer wall 321 and the second outer wall 322 in the lengthwise direction, namely, a front end portion in the embodiment may come in contact with the grip portion 310.

Another end portion of each of the first outer wall 321 and the second outer wall 322, namely, a rear end portion in the embodiment may extend up to the rear end part 330. The rear end portions of the first outer wall 321 and the second outer wall 322 may be located to surround openings 332 in a widthwise direction, namely, in the left and right direction in the embodiment.

Figure 10:
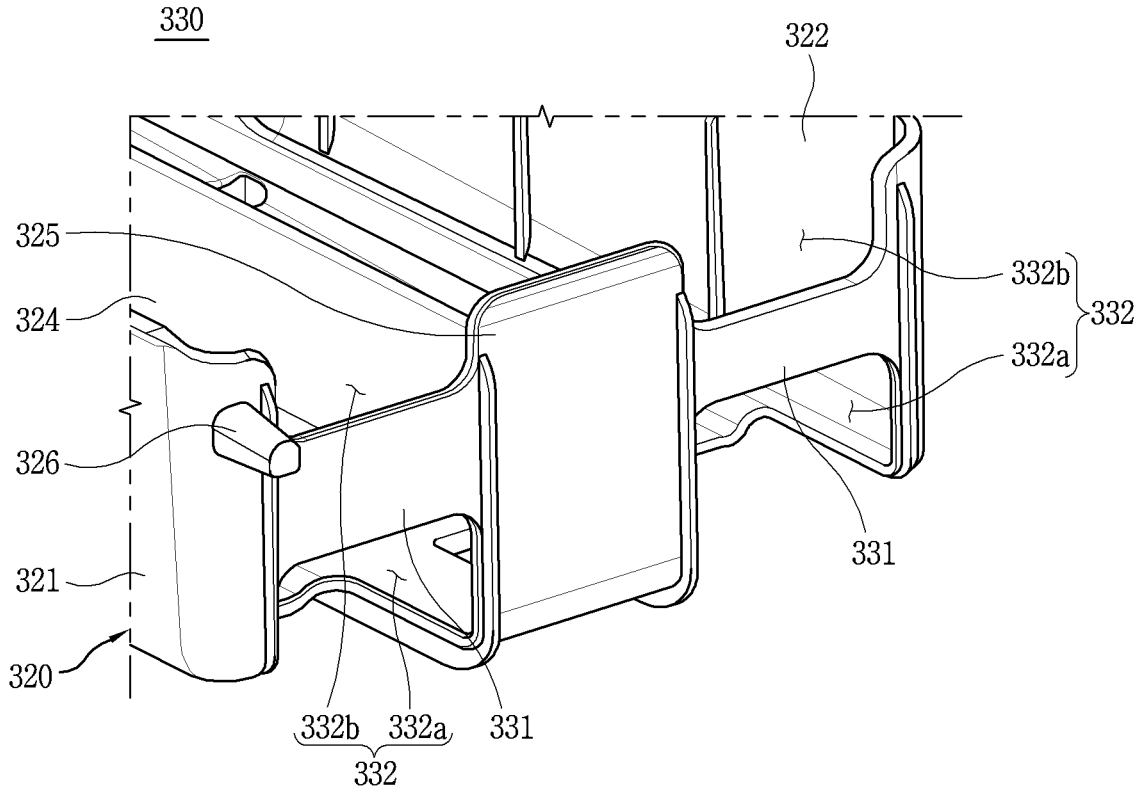
FIG. 10 is a partially-enlarged perspective view illustrating a rear side of the drawer of FIG. 6.
Figure 11:
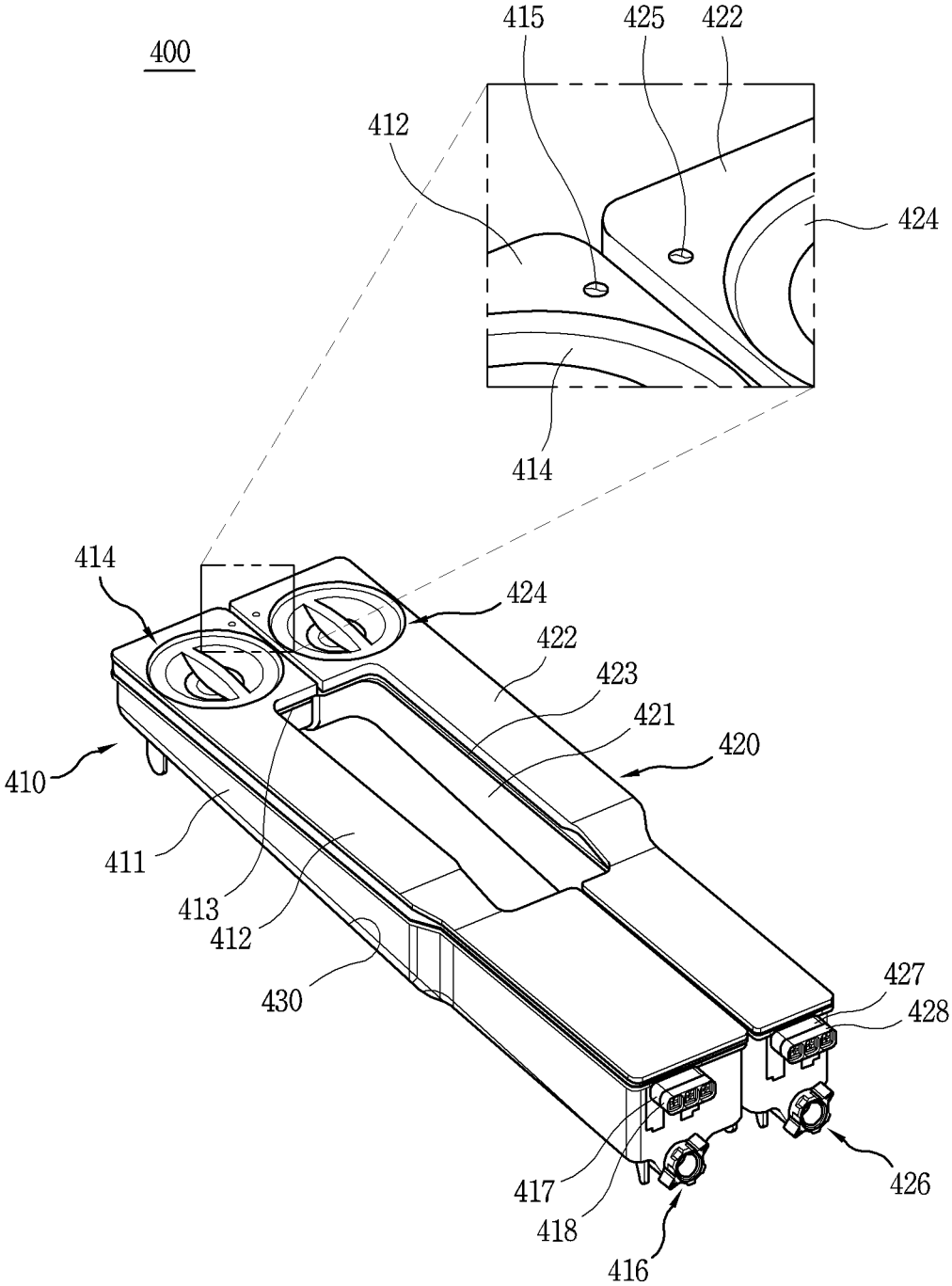
FIG. 11 is a perspective view illustrating the storage container coupled to the drawer of FIG. 6.
Figure 12:
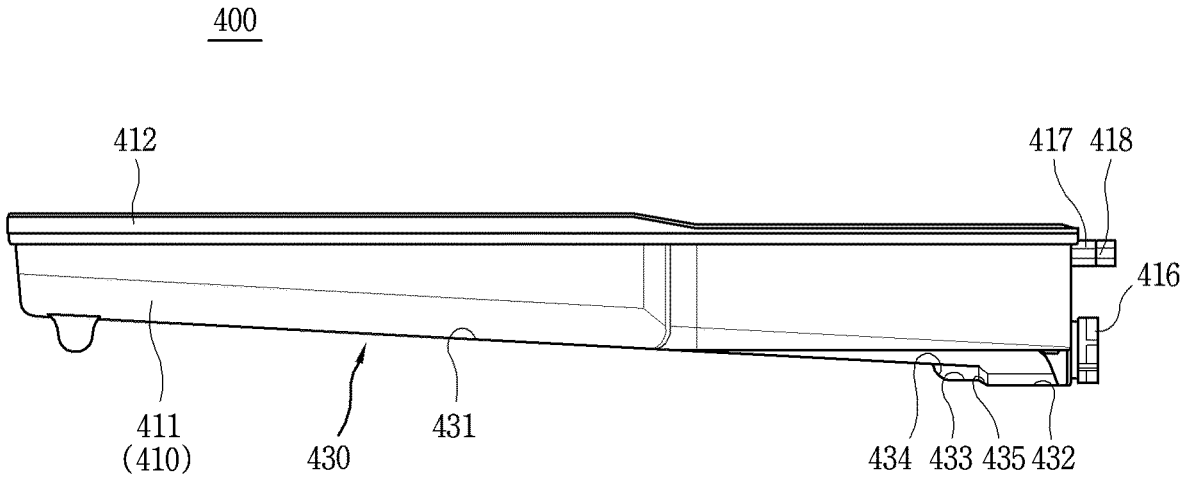
FIG. 12 is a left view of the storage container of FIG. 11.
Figure 13:
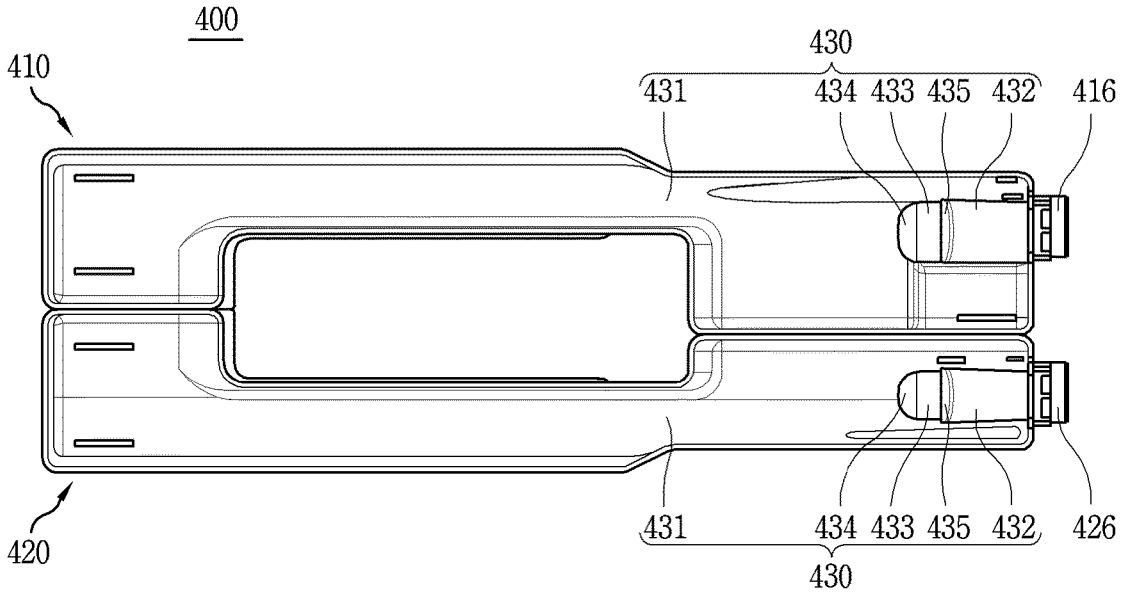
FIG. 13 is a bottom view of the storage container of FIG. 11.
Figure 14:
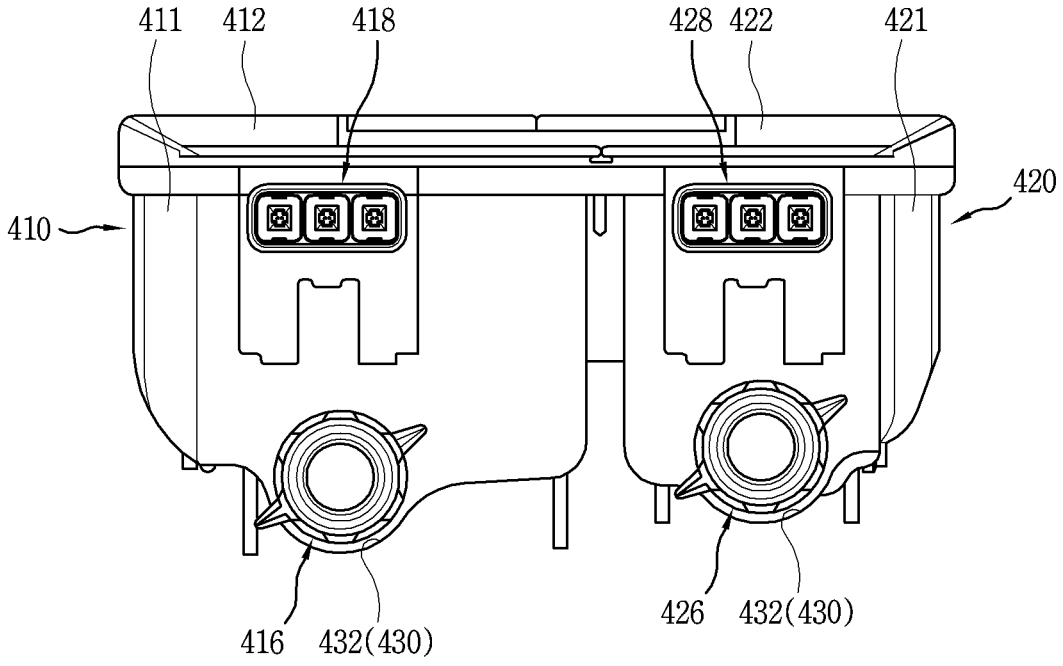
FIG. 14 is a rear view of the storage container of FIG. 11.
Figure 15:
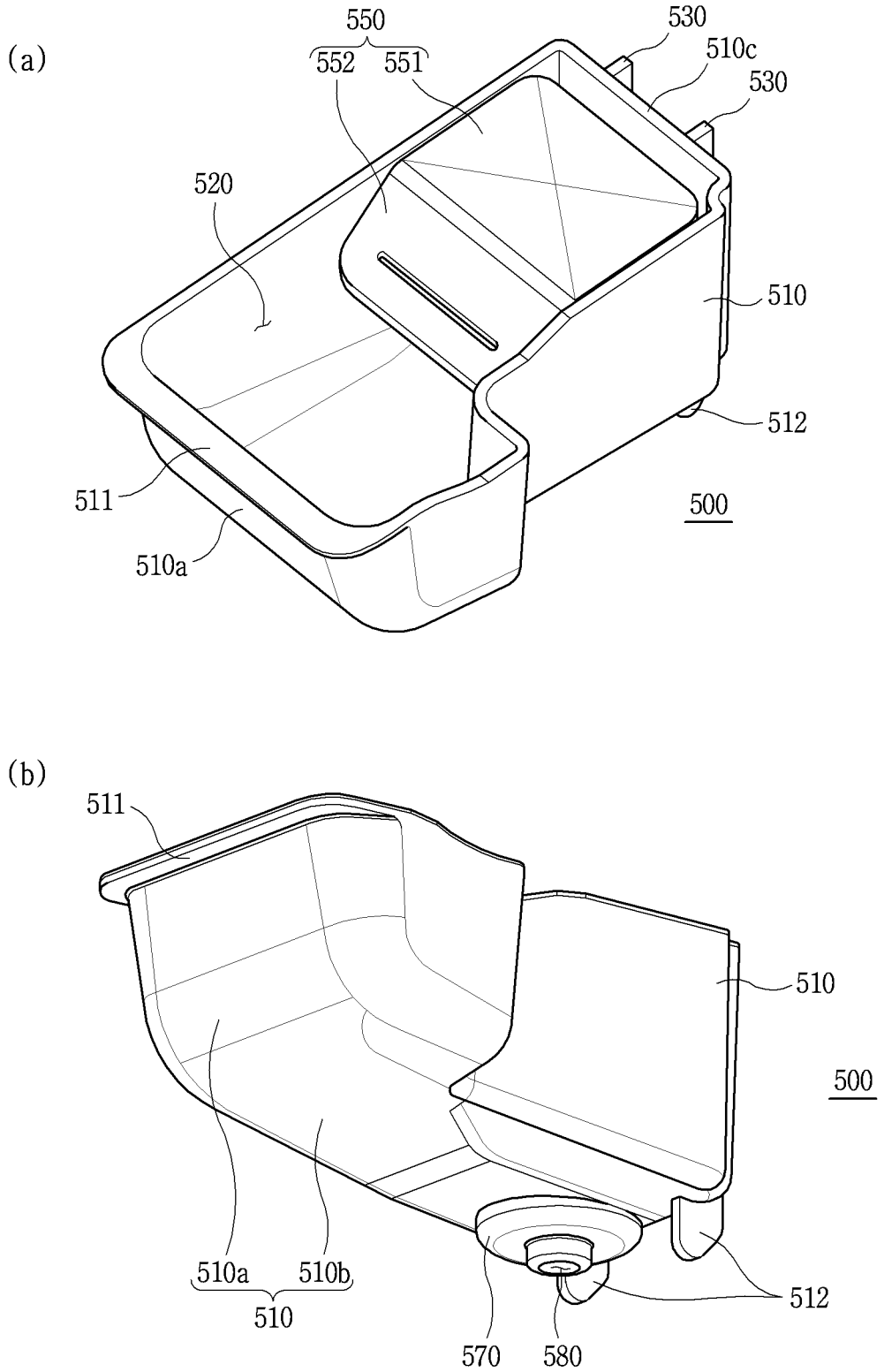
FIG. 15 is a forward perspective view (a) and a reverse perspective view (b) of the clothes treatment agent housing coupled to the drawer of FIG. 6.

The another end portions of the first outer wall 321 and the second outer wall 322, namely, their rear end portions in the embodiment may be bent to be rounded toward each other (see FIG. 10).

The bent portions may partially support the rear end portion of the storage unit 400. The rear wall 325 is located in a space defined between the bent portions.

Spaces defined between the bent portions and the rear wall 325 may be defined as openings 332 constituting the rear end part 330 of the drawer 300.

The bent portions may be connected to the rear wall 325 by a partition member 331. That is, the one end portion of the first outer wall 321 and the one end portion of the second outer wall 322 facing the rear wall 325 may be connected by the partition member 331.

In other words, the partition member 331 extends from the rear end portion of the first outer wall 321 toward the rear end portion of the second outer wall 322.

A distance-limiting protrusion 326 may be formed on the bent portion. In the embodiment, the distance-limiting protrusion 326 protrudes from an upper side of the bent portion of the first outer wall 321 by a predetermined distance.

The distance-limiting protrusion 326 may be brought into contact with the clothes treatment agent pump unit 220 and the like when the drawer 300 is inserted into the dispenser assembly 200, thereby limiting an insertion distance.

Therefore, when the drawer 300 is inserted into the dispenser assembly 200, the distance by which the check valve 416, 426 is moved by the primary pump valve 224 can be adjusted appropriately.

The inner wall 323 is located to be spaced a predetermined distance apart from the first outer wall 321 and the second outer wall 322 in the space surrounded by the first outer wall 321 and the second outer wall 322. The inner wall 323 divides the space surrounded by the first outer wall 321 and the second outer wall 322 into two or more spaces.

That is, the space between the first outer wall 321 and the second outer wall 322 may be divided into an inner space surrounded by the inner wall 323, and an outer space surrounded by the first outer wall 321, the second outer wall 322, and the inner wall 323. That is, the outer space may be formed to surround the inner wall 323.

The inner space of the divided spaces may be defined as the housing accommodation part 350. That is, the clothes treatment agent housing 500 is detachably accommodated in the inner space.

The outer space of the divided spaces may be defined as an accommodation portion for the storage unit 400. That is, the storage unit 400 is detachably accommodated in the outer space.

As will be described later, the storage unit 400 includes a first storage container 410 and a second storage container 420. Accordingly, the first storage container 410 and the second storage container 420 may be accommodated in the outer space defined in the widthwise direction of the housing accommodation part 350, namely, in the left and right sides of the housing accommodation part 350 in the embodiment.

When the storage unit 400 is accommodated in the outer space, each surface of the storage unit 400 may come in contact with the first outer wall 321, the second outer wall 322, and the inner wall 323. Therefore, the storage unit 400 may not be moved arbitrarily after being inserted into the outer space.

The inner wall 323 may be configured by a plurality of planes. In the embodiment, the inner wall 323 includes first plane portions disposed to face each other in the left and right direction, second plane portions disposed to face each other in the lengthwise direction, and third plane portions connecting the first plane portions and the second plane portions and each formed to be rounded.

The inner wall 323 may extend in the lengthwise direction, namely, in the back and forth direction in the embodiment. That is, the first plane portion may be longer than the second plane portion in length.

The inner space surrounded by the inner wall 323 may be further divided into a manual introduction part 340 and a housing accommodation part 350. The manual introduction part 340 and the housing accommodation part 350 may be partitioned by a partition plate 342.

The inner wall 323 may be lower than a storage body portion 411, 421 of the storage unit 400. That is, a storage cover portion 412, 422 of the storage unit 400 inserted in the outer space may be configured to partially cover an upper side of the inner wall 323.

With the configuration, the clothes treatment agent injected into the manual introduction part 340 is not introduced into a space between the storage unit 400 and the inner wall 323. The user can easily detach the storage unit 400 by gripping such a part of the storage cover portion 412, 422.

The bottom portion 324 defines one side of the drawer frame 320, namely, a lower side in the embodiment. The bottom portion 324 may support the storage unit 400 accommodated in the outer space from a lower side.

Of the bottom portion 324, the inner space surrounded by the inner wall 323 may be defined by an inclined portion 341 and a lower surface 351. In particular, a fluid outlet port 359 is formed through the lower surface 351, so that the inner space and the lower space of the dispenser assembly 200 can communicate with each other.

The bottom portion 324 extends from one side to another side in the lengthwise direction, namely, from the front to the rear in the embodiment. The bottom portion 324 may extend at a predetermined tilt. This is because a lower surface of the storage body portion 411, 421 of the storage unit 400 is formed to be inclined.

As the bottom portion 324 extends to be inclined, the clothes treatment agent accommodated in the storage unit 400 may naturally move from the front to the rear.

The rear wall 325 defines an outer circumference of one side of the drawer frame 320 in the lengthwise direction, namely, an outer circumference of the rear side in the embodiment. The rear wall 325 supports the rear side of the storage unit 400 accommodated in the outer space.

The rear wall 325 may extend from the bottom portion 324. Specifically, the rear wall 325 may extend from one end portion of the bottom portion 324, namely, from a rear end portion in the embodiment at a predetermined angle with respect to the bottom portion 324. In one embodiment, the predetermined angle may be a right angle.

The rear wall 325 may be disposed to be spaced apart from the first outer wall 321 and the second outer wall 322 by a predetermined distance. Specifically, the openings 332 are formed between the rear wall 325 and the first and second outer walls 321 and 322, respectively. A sensor portion 417, 427 and the check valve 416, 426 provided at the storage unit 400 protrude rearward by a predetermined distance through the opening 332.

The rear wall 325 may be connected to the first outer wall 321 and the second outer wall 322, respectively, through the partition member 331. The partition member 331 may divide the opening 332 into a check valve opening **332*a* and a sensor opening 332*b***.

The rear end part 330 is a portion where one side of the storage unit 400 inserted in the drawer 300, namely, the rear side of the storage unit 400 in the embodiment, communicates with the outside of the drawer 300. The sensor portion 417, 427 and the check valve 416, 426 provided on the rear side of the storage unit 400 are exposed to the outside through the rear end part 330.

The rear end part 330 is located on one side of the drawer frame 320 in the lengthwise direction, namely, on the rear side in the embodiment.

The check valve 416, 426 communicates with the clothes treatment agent pump unit 220 through an exposed portion of the storage unit 400. Also, the sensor portion 417, 427 provided at the storage unit 400 may be electrically connected to an external control unit (not illustrated) through the exposed portion of the storage unit 400.

The rear end part 330 may be located between the bent portions of the first outer wall 321 and the second outer wall 322. That is, the rear end part 330 is located on one side of the drawer frame 320 in the lengthwise direction, namely, on the rear side in the embodiment.

The rear end part 330 includes a partition member 331 and an opening 332.

The partition member 331 connects the bent portions of the first outer wall 321 and the second outer wall 322 to the rear wall 325. The partition member 331 may be provided in plurality.

Further, the partition member 331 is located in the opening 332. The partition members 331 partition the opening 332 formed between the first outer wall 321 and the rear wall 325 and the opening 332 formed between the second outer wall 322 and the rear wall 325 in a height direction, namely, in an up and down direction in the embodiment.

In one embodiment, the partition member 331 may partition the opening 332 into at least two parts in the height direction.

In the embodiment, the partition member 331 partitions the opening 332 into the lower check valve opening **332*a* and the upper sensor opening 332*b***.

The partition member 331 extends in the widthwise direction of the drawer frame 320. In one embodiment, the partition member 331 may connect the first outer wall 321, the second outer wall 322, and the rear wall 325.

Accordingly, rigidity of the structure on the rear side of the drawer frame 320 can be reinforced.

In addition, the partition member 331 may partition the opening 332 into the check valve opening **332*a* and the sensor opening 332*b* so as to limit a direction of inserting or separating the storage unit 400**.

In the embodiment, the partition member 331 is configured as a plate extending in the left and right direction. Alternatively, the partition member 331 may be provided in the form of a rod or the like extending in the left and right direction.

The opening 332 is a space where the check valve 416, 426 and the sensor portion 417, 427 are exposed to the outside. The opening 332 is formed open. The opening 332 allows the inner space of the drawer frame 320 to communicate with the outside.

The openings 332 are formed as the space between the first outer wall 321 and the second outer wall 322 spaced apart from each other is divided by the rear wall 325. That is, the openings 332 are formed between the first outer wall 321 and the rear wall 325 and between the second outer wall 322 and the rear wall 325, respectively.

Each of the openings 332 may be divided into the check valve opening 332*a* and the sensor opening 332*b* by the corresponding partition member 331.

The check valve opening 332*a* is a space through which the check valve 416, 426 is inserted. The pump valve 224, 225 of the clothes treatment agent pump unit 220 can be coupled to communicate with the check valve 416, 426 through the check valve opening 332*a*.

The check valve opening 332*a* is located below the sensor opening 332*b*. This is because the check valve 416, 426 is located on the lower side of the rear of the storage unit 400.

The sensor opening 332*b* is a space through which the sensor portion 417, 427 and a sealing portion 418, 428 configured to cover the sensor portion 417, 427 are inserted. An external control unit (not illustrated) may be electrically connected to the sensor portion 417, 427 through the sensor opening 332*b*.

The sensor opening 332*b* is located above the check valve opening 332*a*. This is because the sensor portion 417, 427 is located on an upper side of the rear of the storage unit 400.

When the check valve 416, 426 is inserted into the check valve opening 332*a*, the check valve 416, 426 more protrudes toward the rear side than the partition member 331.

Similarly, when the sensor portion 417, 427 is inserted into the sensor opening 332*b*, the sensor portion 417, 427 more protrudes toward the rear side than the partition member 331.

The opening 332 may be partitioned into the check valve opening 332*a* and the sensor opening 332*b* by the partition member 331. As the check valve 416, 426 is exposed to the outside, the direction of inserting and separating the storage unit 400 can be limited.

That is, the sensor portion 417, 427 is first inserted into the sensor opening 332*b*, and then the check valve 416, 426 is inserted into the check valve opening 332*a*. Conversely, the check valve 416, 426 is first separated from the check valve opening 332*a*, and then the sensor portion 417, 427 is separated from the sensor opening 332*b*. This will be described in detail later.

The manual introduction part 340 is a space in which the clothes treatment agent is directly (manually) introduced by the user. One side of the manual introduction part 340, namely, an upper side thereof in the embodiment may be opened so that the user can put the clothes treatment agent in the manual introduction part 340 through the opened portion.

The clothes treatment agent may be filled in the manual introduction part 340 for each clothes treating process.

The manual introduction part 340 may be defined as a part of the inner space surrounded by the inner wall 323. That is, the manual introduction part 340 is defined as a space formed in a front part of the inner space.

The manual introduction part 340 includes an inclined portion 341 and a partition plate 342.

The inclined portion 341 defines a lower surface of the manual introduction part 340. The inclined portion 341 is formed to be inclined toward one side in the lengthwise direction, namely, toward the rear side in the embodiment.

Therefore, the clothes treatment agent supplied to the manual introduction part 340 can flow to the rear side along the inclined portion 341.

The partition plate 342 partitions the inner space surrounded by the inner wall 323. The inner space may be divided into the manual introduction part 340 and the housing accommodation part 350.

In the embodiment, the partition plate 342 is configured as a plate extending in the width direction of the inner wall 323. The partition plate 342 may be provided in any form that allows the user to recognize a boundary between the manual introduction part 340 and the housing accommodation part 350.

The partition plate 342 is spaced apart from the inclined portion 341 by a predetermined distance. That is, a predetermined space is defined between the partition plate 342 and the inclined portion 341. The clothes treatment agent supplied to the manual introduction part 340 can flow to the housing accommodation part 350 through the predetermined space.

The housing accommodation part 350 is located at the rear side of the manual introduction part 340. The manual introduction part 340 may communicate with the housing accommodation part 350.

Therefore, the clothes treatment agent supplied to the manual introduction part 340 can flow to the housing accommodation part 350. The clothes treatment agent introduced into the housing accommodation part 350 may flow out of the drawer 300 through the fluid outlet port 359.

The clothes treatment agent housing 500 is accommodated in the housing accommodation part 350. Specifically, the clothes treatment agent housing 500 is accommodated in the housing accommodation part 350 in a manner of being spaced a predetermined distance apart from a rear surface and the lower surface 351 of the housing accommodation part 350.

The housing accommodation part 350 is defined by dividing the inner space surrounded by the inner wall 323. Specifically, the housing accommodation part 350 may correspond to a space excluding the manual introduction part 340 from the spaces which are defined by dividing the inner space by the partition plate 342.

The housing accommodation part 350 communicates with the manual introduction part 340. The clothes treatment agent supplied to the manual introduction part 340 can flow to the housing accommodation part 350.

The housing accommodation part 350 communicates with the outside of the drawer 300. The clothes treatment agent supplied to the clothes treatment agent housing 500 and the clothes treatment agent supplied to the manual introduction part 340 may be supplied to the tub 170 together with a fluid.

The housing accommodation part 350 is located at one side of the manual introduction part 340, namely, at the rear side of the manual introduction part 340 in the embodiment.

The housing accommodation part 350 includes a lower surface 351, a support rod 352, a support pin 353, a support boss portion 354, a protruding portion 355, a space portion 356, a drop prevention member 357, a discharge space portion 358, and a fluid outlet port 359.

The lower surface 351 defines one surface of the housing accommodation part 350, namely, a bottom of the housing accommodation part 350 in the embodiment.

The lower surface 351 may extend from the inclined portion 341. That is, the lower surface 351 may be continuously (or integrally) formed with the inclined portion 341. The clothes treatment agent moved along the inclined portion 341 may also flow along the lower surface 351.

The lower surface 351 may extend at a predetermined angle with respect to the inclined portion 341. Preferably, the lower surface 351 is formed to be inclined toward one side of the lower surface 351 in the lengthwise direction, namely, to the rear side in the embodiment.

The fluid outlet port 359 is formed through the lower surface 351. Specifically, the fluid outlet port 359 may be formed through the lower surface 351 at a position biased toward the rear side of the lower surface 351.

The support pin 353 protrudes from the lower surface 351 by a predetermined distance.

The support boss portion 354 protrudes by a predetermined distance from one side of the lower surface 351 opposite to the grip portion 310, namely, from the rear side of the lower surface 351 in the embodiment. Specifically, the support boss portion 354 protrudes from the lower surface 351 by a predetermined distance so as to have a predetermined tilt with respect to the lower surface 351.

The support rod 352 is positioned at a predetermined distance from the inner wall 323 of one side, namely, from the rear second plane portion of the inner wall 323 in the illustrated embodiment. The support rod 352 is located inside the housing accommodation part 350.

When the clothes treatment agent housing 500 is accommodated in the housing accommodation part 350, a support protrusion surface 511 of the clothes treatment agent housing 500 is seated on the support rod 352. Accordingly, the front side of the clothes treatment agent housing 500 can be stably supported by the support rod 352.

The support rod 352 may extend to cross the housing accommodation part 350 in the width direction. That is, the support rod 352 extends between the second plane portions facing each other among those plane portions of the inner wall 323.

In the embodiment, the support rod 352 is cylindrical, but may alternatively have any shape on which the support protrusion surface 511 can be seated.

The support pin 353 supports the lower side of the accommodated clothes treatment agent housing 500. The support pin 353 protrudes from the lower surface 351 by a predetermined distance.

The support pin 353 may be biased toward the rear side in the lengthwise direction of the housing accommodation part 350. That is, the support pin 353 may be located closer to the second plane portion, which is located at the rear among those plane portions of the inner wall 323, than to the support rod 352.

When the clothes treatment agent housing 500 is accommodated in the housing accommodation part 350, a second portion 510*b* of an outer surface 510 of the clothes treatment agent housing 500 is seated on the support pin 353 in a contact manner. Accordingly, the lower side of the clothes treatment agent housing 500 can be stably supported by the support pin 353.

Protruding portions 355 are formed on an upper side of the support boss portion 354. Accordingly, the space portion 356 defined between the protruding portions 355 is also located on the upper side of the support boss portion 354.

In addition, the fluid output port 359 is formed at one side of the support boss portion 354, namely, at the front side in the embodiment.

One surface of the support boss portion 354, namely, an upper surface thereof in the embodiment is formed to be inclined. Specifically, the one surface of the support boss portion 354 is formed such that a height of one side thereof facing the fluid outlet port 359 is lower than a height of another side facing the second plane portion, which is located at the rear among those plane portions of the inner wall 323.

Accordingly, when the clothes treatment agent accommodated in the clothes treatment agent housing 500 overflows, it may flow toward the fluid outlet port 359 along the upper surface of the support boss portion 354.

An alignment pin insertion groove 354*a* is recessed in the support boss portion 354. An alignment pin 512 of the clothes treatment agent housing 500 is inserted and seated in the alignment pin insertion groove 354*a*.

The alignment pin insertion groove 354*a* is recessed by a predetermined distance into one surface of the support boss portion 354, namely, into the upper surface of the support boss portion 354 in the embodiment. In the embodiment, the alignment pin insertion groove 354*a* is provided by two spaced apart from each other by a predetermined distance.

A recessed distance of each alignment pin insertion groove 354*a* and a spaced distance between the plurality of alignment pin insertion grooves 354*a* may change depending on a protruded distance of each alignment pin 512 and a spaced distance between the alignment pins 512.

As the alignment pins 512 are inserted into the alignment pin insertion grooves 354*a*, the clothes treatment agent housing 500 seated on the support boss portion 354 does not fluctuate in the left and right direction.

The protruding portion 355 is configured such that the clothes treatment agent housing 500 is spaced a predetermined distance apart from the inner wall 323 surrounding the housing accommodation part 350. Such spacing results in defining the space portion 356.

The protruding portion 355 protrudes by a predetermined distance from one side of the inner wall 323 surrounding the housing accommodation part 350, namely, from the second plane portion located at the rear in the embodiment. Further, a lower side of the protruding portion 355 comes in contact with the support boss portion 354.

In the embodiment, the protruding portion 355 includes a first surface 355*a* brought into contact with the spacing protrusion 530 of the clothes treatment agent housing 500. The first surface 355*a* extends in the up and down direction. A lower end portion of the first surface 355*a* may extend to come in contact with the upper surface of the support boss portion 354.

A second surface 355*b* of the protruding portion 355 extends from an upper end portion of the first surface 355*a* to one side of the inner wall 323 at a predetermined angle. The second surface 355*b* is formed to be inclined toward the clothes treatment agent housing 500. That is, the second surface 355*b* is formed such that a front side thereof is higher than a rear side.

Accordingly, when the clothes treatment agent accommodated in the clothes treatment agent housing 500 overflows, it may flow toward the fluid outlet port 359 along the second surface 355*b*.

In the embodiment, the protruding portion 355 is provided in plurality. The plurality of protruding portions 355 are spaced apart from each other by a predetermined distance. Positions and a spaced distance of the protruding portions 355 may change depending on positions and a spaced distance of spacing protrusions 530 of the clothes treatment agent housing 500.

The space portion 356 is a space in which the clothes treatment agent overflowed from the clothes treatment agent housing 500 flows. The space portion 356 may correspond to a space which is defined as the plurality of protruding portions 355 are spaced apart from each other.

Alternatively, the space portion 356 may correspond to a space which is defined as the clothes treatment agent housing 500 and the rear second plane portion of the inner wall 323 are spaced apart from each other due to at least one of the protruding portion 355 or the spacing protrusion 530.

The space portion 356 communicates with the discharge space portion 358. The clothes treatment agent introduced into the space portion 356 may flow to the discharge space portion 358.

With the configuration, the clothes treatment agent overflowed from the clothes treatment agent housing 500 flows into the rear space portion 356. Therefore, the overflowed clothes treatment agent does not flow into the outer space located at one side of the housing accommodation part 350, namely, at the rear side in the embodiment.

Accordingly, contamination or spoiling of appearance, which may occur as the clothes treatment agent remains in the drawer frame 320 and in the storage unit 400, can be prevented. This will be described in detail later.

The drop prevention member 357 limits a distance by which the drawer 300 is drawn out of the dispenser assembly 200.

Specifically, when the drawer 300 is inserted into the dispenser assembly 200, a stopping jaw protruding from one side of the drop prevention member 357, namely, from a rear side in the embodiment, is engaged with the dispenser assembly 200.

Therefore, when the drawer 300 is slid out of the dispenser assembly 200 without a separate operation, the drawn-out distance of the drawer 300 is limited by the stopping jaw.

When the user desires to completely detach the drawer 300, a portion of one side of the drop prevention member 357, namely, the front side in the embodiment, may be pressed or pulled, so that the engaged state between the stopping jaw and the dispenser assembly 200 can be released.

Accordingly, when the user desires to put the clothes treatment agent, the drawn-out distance of the drawer 300 is limited, result in enhancing the user's convenience and preventing a safety accident.

The discharge space portion 358 is a space in which the clothes treatment agent is collected to be supplied to the tub 170. The discharge space portion 358 may be defined as a space surrounded by the inner wall 323, the lower surface 351, and the support boss portion 354.

The clothes treatment agent accommodated in the storage unit 400 may be introduced into the discharge space portion 358 through the clothes treatment agent supply unit 240.

The clothes treatment agent supplied to the manual introduction part 340 or the clothes treatment agent housing 500 may also be introduced into the discharge space portion 358.

The fluid supplied through the fluid supply unit 230 also flows into the discharge space portion 358 through the manual introduction part 340 and the clothes treatment agent housing 500.

That is, various materials for treating clothes and a fluid for dissolving the materials may be introduced into the discharge space portion 358.

The discharge space portion 358 communicates with the tub 170. The clothes treatment agent and the fluid introduced into the discharge space portion 358 may flow toward the tub 170 through the fluid outlet port 359 formed through the lower side of the discharge space portion 358.

The lower surface 351 defining a front lower side of the discharge space portion 358 is formed to be inclined toward the fluid outlet port 359. Accordingly, the clothes treatment agent supplied through the manual introduction part 340 and the clothes treatment agent housing 500 flows from the discharge space portion 358 toward the fluid outlet port 359.

In addition, an upper surface of the support boss portion 354 formed on the rear side of the housing accommodation part 350 is also inclined toward the fluid outlet port 359. Accordingly, the clothes treatment agent which has been overflowed from the clothes treatment agent housing 500 and introduced into the space portion 356 can also be moved toward the fluid outlet port 359.

The fluid outlet port 359 is a path through which the clothes treatment agent and the fluid collected in the discharge space portion 358 are supplied to the tub 170. The fluid outlet port 359 may be formed in a shape of a through hole.

The fluid outlet port 359 communicates with the tub 170. For the communication, a hose member (not illustrated) may be provided.

The fluid outlet port 359 communicates with the discharge space portion 358. The fluid outlet port 359 is formed through the lower side of the discharge space portion 358. Accordingly, the clothes treatment agent and the fluid collected in the discharge space portion 358 flow toward the fluid outlet port 359.

(4) Description of Storage Unit 400

Hereinafter, with reference to FIGS. 11 to 14, the storage unit 400 provided in the clothes treating machine 10 according to the embodiment of the present disclosure will be described in detail.

The storage unit 400 accommodates and stores a clothes treatment agent required to carry out a clothes treating process. The clothes treatment agent stored in the storage unit 400 may be in a liquid phase.

The clothes treatment agent accommodated in the storage unit 400 may be automatically supplied to the tub 170 according to a clothes treating process input by the user through the manipulation unit 160. Accordingly, the clothes treatment agent accommodated in the storage unit 400 may be referred to as an "automatically-supplied clothes treatment agent".

The storage unit 400 extends in the lengthwise direction. The storage unit 400 may be formed in a shape corresponding to the dispenser assembly 200 and the drawer 300.

The storage unit 400 is accommodated in the drawer 300. Specifically, the storage unit 400 is inserted into the predetermined space defined inside the drawer frame 320.

The storage unit 400 may be inserted at a predetermined angle with respect to the drawer 300 in the lengthwise direction. Specifically, one side of the storage unit 400 facing the rear end part 330 is inserted first, and another side of the storage unit 400 facing the grip portion 310 is inserted later.

That is, the rear side of the storage unit 400 is first inserted into the rear end part 330 formed on the rear side of the drawer 300. Then, the front side of the storage unit 400 may be inserted into the front side of the drawer 300.

The storage unit 400 may be separated or detached from the drawer 300 at a predetermined angle with respect to the drawer 300 in the lengthwise direction. Specifically, the another side of the storage unit 400 facing the grip portion 310 is separated first, and the one side of the storage unit 400 facing the rear end part 330 is separated later.

That is, the front side of the storage unit 400 is first separated from the front side of the drawer 300. Then, the rear side of the storage unit 400 may be separated from the rear side and the rear end part 330 of the drawer 300.

The storage unit 400 may be provided in plurality. In the embodiment, the storage unit 400 includes a first storage container 410 and a second storage container 420. The clothes treatment agent may be accommodated in each of the storage containers 410 and 420.

In particular, detergent or softener may be accommodated in each of the storage containers 410 and 420. This results from the fact that detergent or softener is most frequently used to perform the clothes treating process.

The storage unit 400 communicates with the dispenser assembly 200. When the drawer 300 with the storage unit inserted therein is pushed into the dispenser assembly 200, the check valve 416, 426 provided on the rear side of the storage unit 400 communicate with the clothes treatment agent pump unit 220. Accordingly, the clothes treatment agent stored in the storage unit 400 may be supplied to the tub 170 via the drawer 300 by means of the clothes treatment agent pump unit 220.

The storage unit 400 inserted in the drawer 300 is surrounded by the outer walls 321 and 322 and the inner wall 323 of the drawer frame 320. The rear side of the storage unit 400 is partially surrounded by the rear wall 325.

The storage unit 400 includes a first storage container 410, a second storage container 420 and a discharge inclined portion 430.

The first storage container 410 and the second storage container 420 each store the clothes treatment agent therein. The stored clothes treatment agent may be supplied to the tub 170 through the clothes treatment agent pump unit 220. The first storage container 410 and the second storage container 420 are located adjacent to each other in a state accommodated in the drawer 300.

A predetermined space is defined inside each of the first storage container 410 and the second storage container 420. The clothes treatment agent is accommodated in each of the spaces.

In one embodiment, one of detergent and softener may be accommodated inside the first storage container 410 and another may be accommodated inside the second storage container 420.

In one embodiment, the detergent may be accommodated in the first storage container 410. In the embodiment, the first storage container 410 is formed to have a larger volume than the second storage container 420. This results from the fact that a larger amount of detergent is required than softener during a general clothes treating process. In the embodiment, the softener may be accommodated in the second storage container 420.

The first storage container 410 and the second storage container 420 according to the exemplary embodiment of the present disclosure have the same or like structure and function to each other, except for the fact that the first storage container 410 and the second storage container 420 accommodate different types of clothes treatment agents and have partially different shapes.

Therefore, the first storage container 410 and the second storage container 420 will be described together to avoid redundant description.

The first storage container 410 and the second storage container 420 may be accommodated in a space defined in the drawer frame 320. In the embodiment, the first storage container 410 is accommodated in a space formed in a left side of the drawer frame 320 (see FIG. 6). Also, the second storage container 420 is accommodated in a space defined in a right side of the drawer frame 320.

The first storage container 410 includes a first storage body portion 411, a first storage cover portion 412, a first detachment/attachment protrusion 413, a first storage cap portion 414, and a first through hole 415, a first check valve 416, a first sensor portion 417, and a first sealing portion 418.

Likewise, the second storage container 410 includes a second storage body portion 421, a second storage cover portion 422, a second detachment/attachment protrusion 423, a second storage cap portion 424, and a second through hole 425, a second check valve 426, a second sensor portion 427, and a second sealing portion 428.

The storage body portions 411 and 421 define spaces in which the clothes treatment agent is accommodated. The storage body portions 411 and 421 extend in the lengthwise direction, namely, in the back and forth direction in the embodiment.

The storage cover portions 412 and 422 are located on upper sides of the storage body portions 411 and 421. In one embodiment, the storage body portions 411 and 421 and the storage cover portions 412 and 422 may be integrally formed with each other. That is, the storage body portions 411 and 421 and the storage cover portions 412 and 422 may be coupled so as not to be arbitrarily separated from each other.

The detachment/attachment protrusions 413 and 423 protrude between the storage body portions 411 and 421 and the storage cover portions 412 and 422. The user can easily detach the storage containers 410 and 420 by gripping the detachment/attachment protrusions 413 and 423.

The discharge inclined portions 430 are formed on lower sides of the storage body portions 411 and 421, respectively. The clothes treatment agent accommodated in the inner spaces of the storage body portions 411 and 421 may flow to the rear side along the discharge inclined portions 430.

The check valves 416 and 426 are provided on the rear sides of the storage body portions 411 and 421, respectively. The inner spaces of the storage body portions 411 and 421 may communicate with the clothes treatment agent pump unit 220 by the check valves 416 and 426.

The storage body portions 411 and 421 are provided on the rear sides thereof with the sensor portions 417 and 427 and the sealing portions 418 and 428 configured to seal the sensor portions 417 and 427. Information related to a remaining amount of clothes treatment agents accommodated in the storage body portions 411 and 421 may be transmitted to a control unit (not illustrated) through the sensor portions 417 and 427.

The storage body portions 411 and 421 extend in the lengthwise direction, namely, in the back and forth direction in the embodiment. Widths of the storage body portions 411 and 421 in the left and right direction in the embodiment may be different in the lengthwise direction.

That is, each of the storage body portions 411 and 421 may be divided along the lengthwise direction into one side facing the grip portion 310, another side facing the rear end part 330, and still another side located between the one side and the another side.

The one side of each of the storage body portions 411 and 421, namely, the front side in the embodiment, is formed to have a wider width than the still another side of the storage body portion 411, 421 brought into contact with the inner wall 323 in the lengthwise direction.

Also, the another side of the storage body portion 411, 421, namely, the rear side in the embodiment, is formed to have a wider width than the still another side of the storage body portion 411, 421.

That is, the storage body portion 411, 421 is formed such that the width of the still another side is narrower than the widths of the one side and the another side.

Therefore, even if the storage containers 410 and 420 are brought into contact with each other at the one side and the another side thereof, the storage containers 410 and 420 are spaced apart from each other at the still another sides thereof. The housing accommodation part 350 may be located in a space defined as the still another sides of the storage containers 410 and 420 are spaced apart from each other.

That is, when the storage containers 410 and 420 are accommodated in the space defined to surround the inner wall 323 of the spaces of the drawer frame 320, the housing accommodation part 350 is located between the still another sides of the storage containers 410 and 420. Accordingly, the storage containers 410 and 420 may be disposed to surround the housing accommodation part 350 at the outside of the housing accommodation part 350.

In one embodiment, the still another side of each storage container 410 and 420 may be in contact with an outer side of the inner wall 323 extending in the lengthwise direction.

Each of the storage cover portions 412 and 422 is located on one side of each of the storage body portions 411 and 421, namely, on the upper side in the embodiment. The storage cover portions 412 and 422 are configured to cover the storage body portions 411 and 421, respectively. That is, the storage cover portions 412 and 422 function as covers of the storage body portions 411 and 421.

The storage cover portions 412 and 422 extend in the lengthwise direction, namely, in the back and forth direction in the embodiment. The shape of the storage cover portions 412 and 422 may correspond to the shape of the storage body portions 411 and 421.

The storage cap portions 414 and 424 are provided on the front sides of the storage cover portions 412 and 422, respectively. The storage cap portions 414 and 424 are configured to seal openings (not illustrated) formed on the front sides of the storage cover parts 412 and 422, respectively.

The user can open the storage cap portion 414, 424 and supply the clothes treatment agent through the opening (not illustrated). In one embodiment, the storage cap portions 414 and 424 may be configured to be coupled to or separated from the storage cover portions 412 and 422 in a rotating manner.

The through holes 415 and 425 are formed in a penetrating manner at the front sides of the storage cap portions 414 and 424, respectively, on the storage cover portions 412 and 422. The through holes 415 and 425 allow inside and outside of the storage body portions 411 and 421 to communicate with each other, so as to maintain the balance of pressure inside the storage body portions 411 and 421.

Specifically, when the clothes treatment agent accommodated in the storage body portions 411 and 421 is discharged through the clothes treatment agent pump unit 220, negative pressure is formed inside the storage body portions 411 and 421.

Therefore, a discharge process is not smoothly carried out when it is desired to discharge the clothes treatment agent for the next clothes treating process. In addition, when the user wants to open the storage cap portions 414 and 424 in order to additionally supply the clothes treatment agent, it is difficult to detach the storage cap portions 414 and 424 due to internal pressure of the storage body portions 411 and 421.

Therefore, the through holes 415 and 425 communicate the inside and outside of the storage body portions 411 and 421, so as to balance the internal pressure of the storage body portions 411 and 421 and atmospheric pressure. Accordingly, the internal pressure of the storage body portions 411 and 421 can be maintained to be the same as the atmospheric pressure, despite the outflow of the clothes treatment agent.

The through holes 415 and 425 may be formed in any shape capable of communicating the inside and outside of the storage body portions 411 and 421. In one embodiment, the through holes 415 and 425 may be formed to have a circular cross section.

The through holes 415 and 425 may be located adjacent to each other. That is, the first through hole 415 may be located on one side of the first storage cover portion 412 adjacent to the second storage container 420. Likewise, the second through hole 425 may be located on one side of the second storage cover portion 422 adjacent to the first storage container 410.

The storage unit 400 according to the embodiment of the present disclosure is configured such that the front side thereof where the through holes 415 and 425 are formed rises upward when the storage unit 400 is attached to or detached from the drawer 300. Accordingly, the clothes treatment agent is not discharged through the through holes 415 and 425. This will be described in detail later.

The check valves 416 and 426 are configured to allow or block the communication between the inner spaces of the storage body portions 411 and 421 and the clothes treatment agent pump unit 220. By virtue of the communication, the clothes treatment agent accommodated in the inner spaces of the storage body portions 411 and 421 can be discharged to the outside.

In the embodiment, the check valves 416 and 426 are located on rear lower sides of the storage body portions 411 and 421, respectively. The check valves 416 and 426 protrude outward from the rear surfaces of the storage body portions 411 and 421, respectively, by a predetermined distance. This may result in that the storage containers 410 and 420 can be inserted into the space of the drawer 300 only from their rear sides.

When the storage containers 410 and 420 inserted in the drawer 300 are coupled to the clothes treatment agent pump unit 220, the primary pump valves 224 are insertedly coupled to the check valves 416 and 426, respectively. At this time, the primary pump valves 224 are in contact with the check valves 416 and 426 to push forward the check valves 416 and 426 by a predetermined distance.

Accordingly, the intake ports 416*d* and 426*d* formed on the outer circumferences of the check valves 416 and 426 and the inlet ports 224*d* formed on the outer circumferences of the respective primary pump valves 224 communicate with the inner spaces of the storage body portions 411 and 421.

On the contrast, when the storage containers 410 and 420 that have been inserted in the drawer 300 are separated from the clothes treatment agent pump unit 220, each check valve 416 and 426 is moved to the rear side by the predetermined distance due to an elastic restored force. Accordingly, the inner spaces of the storage body portions 411 and 421 and the outside which have communicated with each other are blocked from each other.

Accordingly, even if the storage containers 410 and 420 are removed, the clothes treatment agent does not leak through the check valves 416 and 426.

The check valves 416 and 426 may be provided in any form that limits an arbitrary fluid to flow in only one direction and allows or restricts the flow of the fluid. In one embodiment, the check valves 416 and 426 may be configured as lift check valves.

Figure 20:
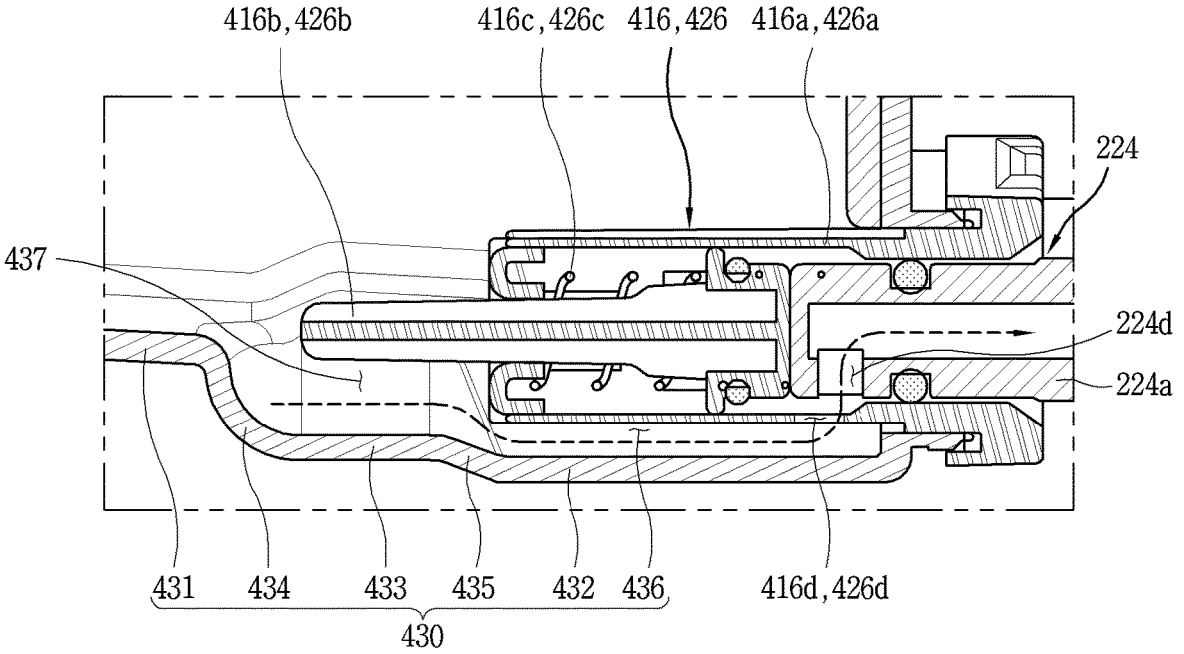
FIG. 20 is an enlarged cross-sectional view of a part A of FIG. 19.

In the embodiment, the check valves 416 and 426 each include a check valve cylinder portion 416*a*, 426*a*, a check valve cap portion 416*b*, 426*b*, a check valve elastic portion 416*c*, 426*c*, and an intake port 416*d*, 426*d* (see FIG. 20).

The check valve cylinder portion 416*a*, 426*a* forms the body of the check valve 416, 426. The check valve cylinder portion 416*a*, 426*a* is formed to extend in the lengthwise direction. In the embodiment, the check valve cylinder portion 426*a*, 426*a* is formed in a cylindrical shape which has a circular cross section and extends in the lengthwise direction.

A space portion is defined inside the check valve cylinder portion 416*a*, 426*a*. The space portion extends from one end to another end of the check valve cylinder portion 416*a*, 426*a* in the lengthwise direction.

That is, the space portion is formed through the check valve cylinder portion 416*a*, 426*a* in the lengthwise direction. The space portion may allow the inner space of the storage body portion 411, 421 to communicate with the inner space of the primary valve cylinder portion 224*a* through the intake port 416*d*, 426*d*.

The space portion is formed to have a diameter equal to or larger than a diameter of the primary valve cylinder portion 224*a*. The primary valve cylinder portion 224*a* is inserted into one side of the space portion in the lengthwise direction, namely, into the rear side in the embodiment.

The primary valve cylinder portion 224*a* may be moved in the lengthwise direction, namely, in the back and forth direction in the embodiment, in the state inserted in the space portion.

A through hole is formed through the front side of the check valve cylinder portion 416*a*, 426*a*. One side of the check valve cap portion 416*b*, 426*b*, namely, the front end portion thereof in the embodiment is inserted into the through hole.

The intake port 416*d*, 426*d* is formed on the outer circumference of the check valve cylinder portion 416*a*, 426*a*. The space portion, the inner space of the storage body portion 411, 421, and the inner space of the primary valve cylinder portion 224*a* communicate with one another through the intake port 416*d*, 426*d*.

The check valve cap portion 416*b*, 426*b* extends in the lengthwise direction. The check valve cap portion 416*b*, 426*b* may include a first part having the smallest diameter, a second part having a larger diameter than the first part and extending from the first part, and a third part covering a rear end portion of the second part.

The first part is coupled through an opening formed through the front side of the check valve cylinder portion 416*a*, 426*a*. Further, the third part is configured to close an opening formed through the rear side of the check valve cylinder portion 416*a*, 426*a*.

The check valve cap portion 416*b*, 426*b* is moved in the lengthwise direction, namely, in the back and forth direction in the embodiment, so as to allow or block the communication of the space portion, the inner space of the storage body portion 411, 421, and the primary valve cylinder portion 224*a*.

That is, when the check valve cap portion 416*b*, 426*b* is moved forward by a predetermined distance, the intake port 416*d*, 426*d* communicates with the inlet port 224*d*.

The forward movement of the check valve cap portion 416*b*, 426*b* may be achieved by being pushed by the primary pump valve 224.

In addition, when the check valve cap portion 416*b*, 426*b* is moved rearward by a predetermined distance, the intake port 416*d*, 426*d* and the inlet port 224*d* is blocked from each other. Furthermore, when the check valve cap portion 416*b*, 426*b* is moved to the rear side by a predetermined distance, the rear end portion of the check valve cap portion 416*b*, 426*b* hermetically seals the rear opening of the check valve cylinder portion 416*a*, 426*a*.

The rearward movement of the check valve cap portion 416*b*, 426*b* is achieved by an elastic restoring force stored in the check valve elastic portion 416*c*, 426*c*.

The check valve elastic portion 416*c*, 426*c* is compressed due to the forward movement of the check valve cap portion 416*b*, 426*b* so as to store the elastic restoring force. The check valve cap portion 416*b*, 426*b* is moved rearward by a predetermined distance by the stored elastic restoring force. Accordingly, the rear opening of the check valve cylinder portion 416*a*, 426*a* can be closed.

When the check valve cap portion 416*b*, 426*b* is moved forward by a predetermined distance by the primary pump valve 224, the check valve elastic portion 416*c*, 426*c* is compressed. This is a state in which the storage container 410, 420 accommodated in the drawer 300 is coupled to the clothes treatment agent pump unit 220.

When the coupled state between the storage container 410, 420 and the clothes treatment agent pump unit 220 is released, that is, when the drawer 300 is drawn out of the dispenser assembly 200, the check valve elastic portion 416*c*, 426*c* is restored to its original shape. During this process, the check valve cap portion 416*b*, 426*b* is moved rearward by the stored elastic restoring force, so as to close the rear opening of the check valve cylinder portion 416*a*, 426*a*.

The check valve elastic portion 416*c*, 426*c* may be provided in any form capable of storing the elastic restoring force as its shape is deformed, and transferring the stored elastic restoring force to another member as it returns the original shape. In one embodiment, the check valve elastic portion 416*c*, 426*c* may be configured as a coil spring.

The check valve elastic portion 416*c*, 426*c* is located between the front end of the check valve cylinder portion 416*a*, 426*a* and the check valve cap portion 416*b*, 426*b*. The check valve elastic portion 416*c*, 426*c* may be coupled through the first and second parts of the check valve cap portion 416*b*, 426*b*.

The intake port 416*d*, 426*d* allows the inner space of the check valve cylinder portion 416*a*, 426*a* to communicate with the inner space of the storage body portion 411, 421.

The clothes treatment agent accommodated in the inner space of the storage body portion 411, 421 may be introduced into the inner space of the check valve cylinder portion 416*a*, 426*a* through the intake port 416*d*, 426*d*. The introduced clothes treatment agent may flow into the inner space of the primary valve cylinder portion 224*a*.

The intake port 416*d*, 426*d* may be formed in any shape through which at least two spaces communicate with each other. In one embodiment, the intake port 416*d*, 426*d* may be formed in the form of a through hole.

The intake port 416*d*, 426*d* is formed on the circumference of the check valve cylinder portion 416*a*, 426*a*. Preferably, the intake port 416*d*, 426*d* may be formed on one side of the check valve cylinder portion 416*a*, 426*a* facing the discharge inclined portion 430, namely, on the lower side of the check valve cylinder portion 416*a*, 426*a* in the embodiment.

As the intake port 416*d*, 426*d* is formed on the lower side of the check valve cylinder portion 416*a*, 426*a*, an amount of clothes treatment agents remaining inside the storage body portion 411, 421 can be minimized. This will be described in detail later.

In addition, the intake port 416*d*, 426*d* is biased to one side of the check valve cylinder portion 416*a*, 426*a* in the lengthwise direction, namely, to the rear side in the embodiment. The check valve cap portion 416*b*, 426*b* may be moved forward until the intake port 416*d*, 426*d* is located at the rear side of the check valve cap portion 416*b*, 426*b*.

By the movement of the check valve cap portion 416*b*, 426*b*, the intake port 416*d*, 426*d* is located in a space defined at the rear side of two spaces partitioned by the check valve cap portion 416*b*, 426*b*.

The primary valve cylinder portion 224*a* is inserted into the space defined at the rear side. In addition, the space communicates with the inlet port 224*d*.

Accordingly, the inner space of the storage body portion 411, 421 and the inner space of the check valve cylinder portion 416*a*, 426*a* may communicate with the inner space pf the primary valve cylinder portion 224*a*. The clothes treatment agent accommodated in the storage body portion 411, 421 may flow into the inner space of the primary valve cylinder portion 224*a* by the communication.

The sensor portion 417, 427 is configured to sense an amount of clothes treatment agents accommodated in the inner space of the storage body portion 411, 421.

The sensor portion 417, 427 is located on one side of the storage container 410, 420, namely, on the rear side of the storage container 410, 420 in the embodiment. Specifically, the sensor portion 417, 427 is located on the rear upper side of the storage body portion 411, 421.

The sensor portion 417, 427 protrudes outward, namely, rearward in the embodiment, from the storage body portion 411, 421 by a predetermined distance.

Although not illustrated, the sensor portion 417, 427 may include a plurality of terminals (not illustrated) on one side wall of the storage body portion 411, 421, namely, on a rear wall in the embodiment. The plurality of terminals (not illustrated) may be located at different heights to sense a surface of the clothes treatment agent accommodated inside the storage body portion 411, 421.

In the embodiment, the sensor portion 417, 427 includes three terminal spaces. This is because three terminals (not illustrated) are provided. The number of terminal spaces provided in the sensor portion 417, 427 may change depending on the number of terminals (not illustrated).

The sensor portion 417, 427 is electrically connected to an external control unit (not illustrated). Information related to a remaining amount of clothes treatment agents detected by the sensor portion 417, 427 may be transmitted to the control unit (not illustrated). To this end, a plurality of connectors (not illustrated) may be electrically connected to the sensor portion 417, 427.

The sensor portion 417, 427 may be sealed by the sealing portion 418, 428.

The sealing portion 418, 428 is provided on an outer side of the sensor portion 417, 427. The sealing portion 418, 428 is configured to seal the sensor portion 417, 427. By means of the sealing portion 418, 428, the fluid or clothes treatment agent does not flow into the sensor portion 417, 427. Accordingly, the electrical connection state between the sensor portion 417, 427 and the external control unit (not illustrated) can be smoothly maintained.

An opening may be formed through one side of the sealing portion 418, 428 facing the sensor portion 417, 427. The sensor portion 417, 427 may be electrically connected to the external control unit (not illustrated) through the opening.

The sealing portion 418, 428 may be formed of an insulating material. In one embodiment, the sealing portion 418, 428 may be formed of rubber, synthetic resin, or a silicone material.

When the storage container 410, 420 is accommodated in the drawer 300, the partition member 331 is disposed between the check valve 416, 426 and the sensor portion 417, 427. Accordingly, the check valve 416, 426 is caught by the partition member 331, thereby limiting a direction of inserting and separating the storage container 410, 420.

The discharge inclined portion 430 defines one side of the storage body portion 411, 421, namely, a lower surface in the embodiment.

The discharge inclined portion 430 may allow the clothes treatment agent accommodated in the inner space of the storage container 410, 420 to flow toward the check valve 416, 426 located at the rear side.

In addition, collection space portions 436 and 437 are formed in one side of the discharge inclined portion 430 in the lengthwise direction, namely, in the rear side in the embodiment. The collection space portions 436 and 437 are located in the rearmost and lower sides of the discharge inclined portion 430.

The clothes treatment agent collected in the collection space portions 436 and 437 may flow into the inner space of the check valve 416, 426 through the intake port 416*d*, 426*d*. Accordingly, the amount of clothes treatment agents remaining inside the storage container 410, 420 can be minimized.

The discharge inclined portion 430 extends in the lengthwise direction, namely, in the back and forth direction in the embodiment. That is, the discharge inclined portion 430 extends from one side of the storage container 410, 420 in the lengthwise direction, namely, from the front side in the embodiment, to another side in the lengthwise direction, namely, to the rear side in the embodiment.

The discharge inclined portion 430 extends in the lengthwise direction at a predetermined inclination. In other words, a vertical distance between the discharge inclined portion 430 and the storage cover portion 412, 422 increases from the front side to the rear side.

The clothes treatment agent may flow in the discharge inclined portion 430.

Hereinafter, the discharge inclined portion 430 will be described in detail with reference to FIG. 19.

The discharge inclined portion 430 includes a first bottom surface 431, a second bottom surface 432, a third bottom surface 433, a first joint surface 434, a second joint surface 435, and a first collection space portion 436, and a second collection space portion 437.

The first bottom surface 431 defines the front side of the discharge inclined portion 430. The first bottom surface 431 may be defined as a portion having the shortest vertical distance from the storage cover portion 412, 422.

The first bottom surface 431 extends from the front to the rear with a predetermined inclination. That is, a distance between the front side of the first bottom surface 431 and the storage cover portion 412, 422 is shorter than a distance between the rear side of the first bottom surface 431 and the storage cover portion 412, 422. Accordingly, the clothes treatment agent accommodated in the storage container 410, 420 may flow to the rear side along the first bottom surface 431.

The second bottom surface 432 is located at the rear side of the first bottom surface 431. In addition, the second bottom surface 432 defines the rearmost side of the discharge inclined portion 430. That is, the second bottom surface 432 is located on an opposite side of the grip portion 310.

The second bottom surface 432 extends in the lengthwise direction with a predetermined angle with the first bottom surface 431. In one embodiment, the second bottom surface 432 may extend horizontally.

The second bottom surface 432 is located lower than the first bottom surface 431. That is, the shortest distance D2 between the second bottom surface 432 and the storage cover portion 412, 422 is longer than the longest distance D1 between the first bottom surface 431 and the storage cover portion 412, 422.

The second bottom surface 432 may be rounded in the lengthwise direction. That is, the second bottom surface 432 may have a shape of a semicircular column that is convex downward and extends in the lengthwise direction. Accordingly, the clothes treatment agent introduced into the second bottom surface 432 may be collected in the downwardly-convex portion.

The check valve 416, 426 is located adjacent to the second bottom surface 432. Specifically, the check valve 416, 426 is located with being spaced apart from the second bottom surface 432 by a predetermined distance. The check valves 416 and 426 is spaced apart from the second bottom surface 432 by the predetermined distance in a direction facing the storage cover portion 412, 422, namely, in an upward direction in the embodiment.

The third bottom surface 433 may be located between the first bottom surface 431 and the second bottom surface 432.

That is, one side of the third bottom surface 433, namely, the front side thereof in the lengthwise direction, is connected to one side of the first bottom surface 431 in the lengthwise direction, namely, to the rear side in the embodiment.

In addition, another side of the third bottom surface 433 in the lengthwise direction, namely, the rear side thereof in the embodiment is connected to one side of the second bottom surface 432 in the lengthwise direction, namely, to the front side in the embodiment.

Alternatively, the third bottom surface 433 may not be formed in the discharge inclined portion 430. That is, the first bottom surface 431 and the second bottom surface 432 may be directly connected to each other.

That is, one side of the third bottom surface 432 in the lengthwise direction, namely, the front side thereof in the embodiment may be connected to one side of the first bottom surface 431 in the lengthwise direction, namely, to the rear side in the embodiment.

The third bottom surface 433 continuously connects the first bottom surface 431 and the second bottom surface 432. The third bottom surface 433 may be located between the first bottom surface 431 and the second bottom surface 432.

The third bottom surface 433 may extend away from the first bottom surface 431, namely, to the rear side in the embodiment at a predetermined inclination with respect to the first bottom surface 431. In one embodiment, the third bottom surface 433 may extend horizontally.

The third bottom surface 433 is located lower than the first bottom surface 431. That is, the longest distance D1 between the first bottom surface 431 and the storage cover portion 412, 422 is shorter than the shortest distance D3 between the third bottom surface 433 and the storage cover portion 412, 422.

The third bottom surface 433 is located higher than the second bottom surface 432. That is, the shortest distance D2 between the second bottom surface 432 and the storage cover portion 412, 422 is longer than a longest distance D3' between the third bottom surface 433 and the storage cover portion 412, 422.

The third bottom surface 433 may be rounded in the lengthwise direction. That is, the third bottom surface 433 may have a shape of a semicircular column that is convex downward and extends in the lengthwise direction. Accordingly, the clothes treatment agent introduced into the third bottom surface 433 may be collected in the downwardly-convex portion.

The first bottom surface 431 and the third bottom surface 434 may be continuously connected to each other by the first joint surface 434.

That is, the first joint surface 434 extends from one side of the first bottom surface 431, namely, from a rear end in the embodiment, to one side of the third bottom surface 433, namely, to a front end in the embodiment.

The first joint surface 434 may extend at a predetermined angle with respect to the first bottom surface 431. In one embodiment, the first joint surface 434 may extend so that a distance up to the storage cover portion 412, 422 is increased as it is farther away from the first bottom surface 431.

Also, the second joint surface 434 may extend at a predetermined angle with respect to the third bottom surface 433. In one embodiment, the first joint surface 434 may extend so that a distance up to the storage cover portion 412, 422 is decreased as it is farther away from the third bottom surface 433.

In one embodiment, the first joint surface 434 may be formed to be downwardly or forwardly convex to have a cross section in a curved shape.

The first joint surface 434 is preferably formed to be inclined from the front side to the rear side, so that the clothes treatment agent does not stay. That is, the front end of the first joint surface 434 connected to the first bottom surface 431 is preferably higher in height than the rear end of the first joint surface 434 connected to the third bottom surface 433.

Accordingly, the clothes treatment agent flowing along the first bottom surface 431 may flow toward the third bottom surface 433 via the first joint surface 434.

A space partially surrounded by the third bottom surface 433 may be defined as the second collection space portion 437. In another embodiment, the definition may extend so that the second collection space portion 437 may also be defined as a space partially surrounded by the third bottom surface 433 and the first joint surface 434.

The second bottom surface 432 and the third bottom surface 435 may be continuously connected to each other by the second joint surface 435.

That is, the second joint surface 435 extends from one side of the third bottom surface 433, namely, from a rear end in the embodiment, to one side of the second bottom surface 432, namely, to a front end in the embodiment.

The second joint surface 435 may extend at a predetermined angle with respect to the third bottom surface 433. In one embodiment, the second joint surface 435 may extend so that a distance up to the storage cover portion 412, 422 is increased as it is farther away from the third bottom surface 433.

Also, the second joint surface 435 may extend at a predetermined angle with respect to the second bottom surface 432. In one embodiment, the second joint surface 435 may extend so that a distance up to the storage cover portion 412, 422 is increased as it is farther away from the second bottom surface 432.

In one embodiment, the second joint surface 435 may be formed to be downwardly or forwardly convex to have a cross section in a curved shape.

The second joint surface 435 is preferably formed to be inclined from the front side to the rear side, so that the clothes treatment agent does not stay. That is, the front end of the second joint surface 435 connected to the third bottom surface 433 is preferably higher in height than the rear end of the second joint surface 435 connected to the second bottom surface 432.

Accordingly, the clothes treatment agent flowing along the first bottom surface 431 and the third bottom surface 433 may flow toward the third bottom surface 433 via the second joint surface 435.

A space partially surrounded by the second bottom surface 432 may be defined as the first collection space portion 436. In another embodiment, the definition may extend so that the first collection space portion 436 may also be defined as a space partially surrounded by the second bottom surface 432 and the second joint surface 435.

The first collection space portion 436 is a space where the clothes treatment agent flowing along the first bottom surface 431 and the third bottom surface 433 is finally collected.

The first collection space portion 436 may be defined as a space partially surrounded by the second bottom surface 432. That is, the first collection space portion 436 is a space formed on one side of the second bottom surface 432 facing the storage cover portion 412, 422, namely, on an upper side thereof in the embodiment.

The first collection space portion 436 may also be defined as a space partially surrounded by the second joint surface 435. That is, the first collection space portion 436 is a space formed on one side of the second joint surface 435 facing the storage cover portion 412, 422, namely, on the upper side in the embodiment.

The first collection space portion 436 communicates with a space partially surrounded by the first bottom surface 431, the third bottom surface 433, and the first joint surface 434.

Accordingly, the clothes treatment agent accommodated in the storage container 410, 420 flows toward the first collection space portion 436 along the first bottom surface 431, the first joint surface 434, and the third bottom surface 433.

The check valve 416, 426 is located in the first collection space portion 436. Specifically, one end portion of the check valve 416, 426 in the lengthwise direction is located in the first collection space portion 436.

The intake port 416*d*, 426*d* of the check valve 416, 426 is located in the first collection space portion 436. By the arrangement, the first collection space portion 436 and the inner space of the check valve cylinder portion 416*a*, 426*a* may communicate with each other.

As described above, the inner space of the check valve cylinder portion 416*a*, 426*a* communicates with the inner space of the primary valve cylinder portion 224*a* through the inlet port 224*d*.

With the configuration, the clothes treatment agent collected in the first collection space portion 436 can flow into the inner space of the primary valve cylinder portion 224*a*. Accordingly, the amount of clothes treatment agents remaining inside the storage container 410, 420 can be minimized.

The process in which the clothes treatment agent flows along the discharge inclined portion 430 inside the storage container 410, 420 will be described later.

The second collection space portion 437 is a space in which the clothes treatment agent flowing along the second bottom surface 432 is primarily collected.

The second collection space portion 437 may be defined as a space partially surrounded by the third bottom surface 433. That is, the second collection space portion 437 is a space formed on one side of the third bottom surface 433 facing the storage cover portion 412, 422, namely, on an upper side thereof in the embodiment.

The second collection space portion 437 may also be defined as a space partially surrounded by the first joint surface 434. That is, the second collection space portion 436 is a space formed on one side of the first joint surface 434 facing the storage cover portion 412, 422, namely, on the upper side in the embodiment.

The second collection space portion 437 may be defined as a space partially surrounded by the first bottom surface 431. In addition, the second collection space portion 437 communicates with the first collection space portion 436.

Accordingly, the clothes treatment agent accommodated in the storage container 410, 420 can flow to the second collection space portion 437 along the first bottom surface 431. In addition, the clothes treatment agent introduced into the second collection space portion 437 can flow toward the first collection space portion 436.

As described above, the third bottom surface 433 may not be provided in the discharge inclined portion 430. That is, the first bottom surface 431 and the second bottom surface 432 may be directly connected to each other. The first bottom surface 431 and the second bottom surface 434 may be connected to each other by the first joint surface 434 in an inclined manner.

The clothes treatment agent accommodated in the storage container 410, 420 can flow along the first bottom surface 431 and the first joint surface 434 so as to be introduced into the first collection space portion 436.

(5) Description of Clothes Treatment Agent Housing 500

Hereinafter, the clothes treatment agent housing 500 provided in the clothes treating machine 10 according to the embodiment of the present disclosure will be described in detail, with reference to FIGS. 21 to 22.

A clothes treatment agent which is manually supplied by the user to perform a clothes treating process is supplied into the clothes treatment agent housing 500. That is, the clothes treatment agent is supplied into the clothes treatment agent housing 500 each time a clothes treating process is performed.

A fluid for dissolving the clothes treatment agent is also supplied into the clothes treatment agent housing 500. The fluid may be supplied through the second fluid discharge portion 234 of the fluid supply unit 230.

The clothes treatment agent housing 500 may be detachably accommodated in the housing accommodation part 350 of the drawer 300.

An opening 520 is formed through an upper side of the clothes treatment agent housing 500. The user can manually supply the clothes treatment agent into the clothes treatment agent housing 500 through the opening 520. In addition, the fluid supplied from the fluid supply unit 230 may also be supplied through the opening 520.

A predetermined space is defined inside the clothes treatment agent housing 500. The supplied clothes treatment agent or fluid may stay in the predetermined space. When an amount of clothes treatment agents or fluids staying in the predetermined space exceeds a predetermined reference value, the clothes treatment agent or fluid may be discharged to the outside through a discharge passage 580.

The clothes treatment agent housing 500 is formed such that a length in the back and forth direction (i.e., the lengthwise direction) is longer than a width in the left and right direction in the embodiment. The shape of the clothes treatment agent housing 500 may change depending on the shape of the housing accommodation part 350.

The clothes treatment agent housing 500 includes an outer circumferential surface 510, an opening 520, a spacing protrusion 530, a siphon portion 540, a siphon cover portion 550, a siphon coupling portion 560, and a collecting portion 570, and a discharge passage 580.

The outer circumferential surface 510 defines an outer surface of the clothes treatment agent housing 500.

In the embodiment, the outer circumferential surface 510 includes a first part 510*a* extending by a predetermined distance to be inclined in a direction from the front side to the rear side of the clothes treatment agent housing 500, a second part 510*b* extending rearward from the first part 510*a* at a predetermined angle with respect to the first part 510*a*, and a third part 510*c* extending upward from the second part 510*b* at a predetermined angle with respect to the second part 510*b*.

The outer circumferential surface 510 may be formed in a downwardly-concave shape by the first to third parts 510*a*, 510*b*, and 510*c*.

That is, the first part 510*a* and the second part 510*b* are formed to be inclined toward the discharge passage 580 from the front side of the space in the clothes treatment agent housing 500. In addition, the third part 510*c* is formed to be inclined toward the discharge passage 580 from the rear side of the space in the clothes treatment agent housing 500.

Accordingly, the clothes treatment agent or fluid supplied in the inner space of the clothes treatment agent housing 500 may flow to the discharge passage 580 along inner surfaces of the first to third parts 510*a*, 510*b*, and 510*c*.

A support protrusion surface 511 protrudes from one side of the first part 510*a* of the outer circumferential surface 510, namely, from an upper side in the embodiment, by a predetermined distance. The support protrusion surface 511 may protrude at a predetermined angle with respect to the outer circumferential surface 510.

In one embodiment, the support protrusion surface 511 may horizontally protrude or may protrude to be inclined toward a front lower side or a front upper side.

When the clothes treatment agent housing 500 is accommodated in the housing accommodation part 350, the support protrusion surface 511 is seated on the support rod 352. Therefore, the front side of the clothes treatment agent housing 500 can be stably supported in a state of being spaced apart from the lower surface 351 by a predetermined distance.

Furthermore, a forward movement of the clothes treatment agent housing 500 can be limited as the first part 510*a* of the outer circumferential surface 510 is brought into contact with the support rod 352. Therefore, the clothes treatment agent housing 500 can be stably maintained at a predetermined position.

An alignment pin 512 protrudes from one side of the third part 510*c* of the outer circumferential surface 510, namely, from a lower side in the embodiment, by a predetermined distance.

When the clothes treatment agent housing 500 is accommodated in the housing accommodation part 350, the alignment pin 512 is inserted into an alignment pin insertion groove 354*a* of the housing accommodation part 350.

The alignment pin 512 is formed to be longer in the back and forth direction than in the left and right direction. That is, the alignment pin 512 is formed to have a horizontal cross section in a rectangular shape in which a length of a pair of sides facing each other is longer than a length of another pair of sides.

Accordingly, when the alignment pin 512 is inserted into the alignment pin insertion groove 354*a*, the movement of the clothes treatment agent housing 500 in the left and right direction is limited. Therefore, the clothes treatment agent housing 500 can be stably maintained at a predetermined position.

The alignment pin 512 may be provided in plurality. In the embodiment, the alignment pin 512 is provided by two, which are spaced apart from each other by a predetermined distance. The shape, number, and position of the alignment pin 512 may change depending on the shape, number, and position of the alignment pin insertion groove 354*a*.

The opening 520 is a portion through which the clothes treatment agent supplied by the user or the fluid supplied from the fluid supply unit 230 is introduced. The opening 520 is formed through the upper side of the clothes treatment agent housing 500.

The opening 520 may be surrounded by an inner surface of the outer circumferential surface 510. That is, the opening 520 may be defined as a space surrounded by the inner surfaces of the first to third parts 510*a*, 510*b*, and 510*c* of the outer circumferential surface 510.

The opening 520 may be partially covered by the siphon cover portion 550. In the embodiment, the siphon cover portion 550 is configured to cover a part of a rear side of the opening 520.

The opening 520 communicates with the outside. The user can directly supply the clothes treatment agent through the opening 520.

The opening 520 communicates with the fluid supply unit 230. The fluid discharged from the fluid supply unit 230 may be introduced into the inner space of the fluid supply unit 230 through the opening 520.

The opening 520 communicates with the inner space of the clothes treatment agent housing 500. The clothes treatment agent or fluid supplied through the opening 520 may flow to the collecting portion 554 via the inner space of the clothes treatment agent housing 500. The clothes treatment agent or fluid collected in the collecting portion 554 may be discharged through the discharge passage 580 via the siphon portion 540.

The spacing protrusion 530 is provided so that one side of the inner wall 323 surrounding the housing accommodation part 350 is spaced a predetermined distance apart from the clothes treatment agent housing 500. Specifically, the spacing protrusion 530 allows the inner wall 323 of the rear side in the embodiment to be spaced the predetermined distance apart from the rear side of the clothes treatment agent housing 500.

The spacing protrusion 530 protrudes from the third part 510*c* of the outer circumferential surface 510 by a predetermined distance. The spacing protrusion 530 extends from an upper side of the third part 510*c* by a predetermined distance (see FIG. 21).

One side of the spacing protrusion 530, namely, the rear side thereof in the embodiment, is brought into contact with the first surface 355*a* of the protruding portion 355. Accordingly, the third part 510*c* of the outer circumferential surface 510 of the clothes treatment agent housing 500 and the rear side of the inner wall 323 are spaced apart from each other by a distance corresponding to the sum of a protruded distance of the protruding portion 355 and a protruded distance of the spacing protrusion 530.

A space defined by the spacing between the clothes treatment agent housing 500 and the rear side of the inner wall 323 may be defined as the space portion 356. The fluid or clothes treatment agent overflowed from the inner space of the clothes treatment agent housing 500 may flow into the discharge space portion 358 through the space portion 356.

Accordingly, the overflowed fluid or clothes treatment agent does not flow to the storage unit 400.

The spacing protrusion 530 may be provided in plurality. In the embodiment, the spacing protrusion 530 is provided by two, which are spaced apart from each other by a predetermined distance. The number and spaced distance of the spacing protrusions 530 may change depending on the number and spaced distance of the protruding portions 355.

The spacing protrusion 530 may be formed in a plate shape having a small thickness relative to a width or length. Accordingly, a space occupied by the spacing protrusion 530 in the space portion 356 in the widthwise direction, namely, in the left and right direction in the embodiment, can be minimized.

The spacing protrusion 530 includes a first spacing surface 531, a second spacing surface 532, and a third spacing surface 533.

The first spacing surface 531 defines an upper surface of the spacing protrusion 530. The first spacing surface 531 extends rearward from the upper side of the third part 510*c* of the outer circumferential surface 510 at a predetermined angle with respect to the third part 510*c*. In one embodiment, the first spacing surface 531 may extend perpendicular to the third part 510*c*.

The second spacing surface 532 defines a rear surface of the spacing protrusion 530. The second spacing surface 532 extends downward from a rear end portion of the first spacing surface 531 at a predetermined angle with respect to the first spacing surface 531. In one embodiment, the second spacing surface 532 may extend at an acute or right angle with respect to the first spacing surface 531.

The second spacing surface 532 comes in contact with at least part of the first surface 355*a* of the protruding portion 355.

The third spacing surface 533 defines a lower surface of the spacing protrusion 530. The third spacing surface 533 extends forward from a lower end portion of the second spacing surface 532 at a predetermined angle with respect to the second spacing surface 532. The third spacing surface 533 may extend up to the third part 510*c*. In one embodiment, the third spacing surface 533 may extend at a right angle or an obtuse angle with respect to the second spacing surface 532.

Figure 21:
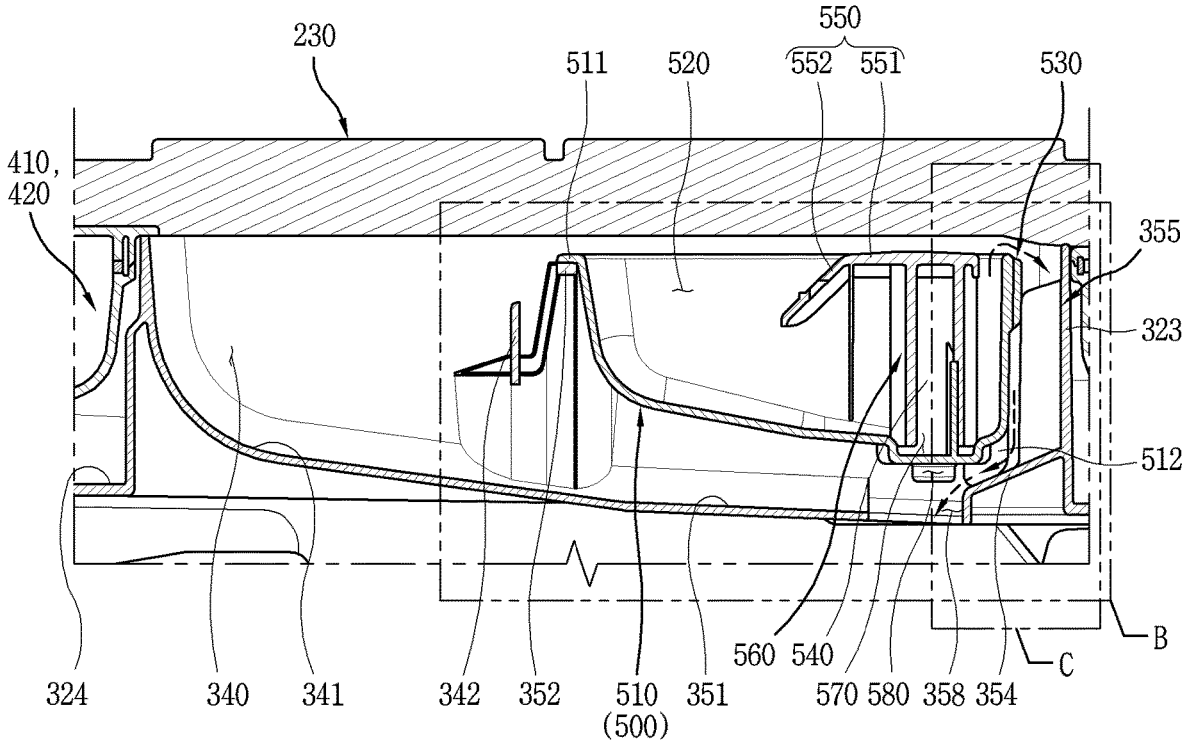
FIG. 21 is a cross-sectional view illustrating an overflow state of the clothes treatment agent inside the clothes treatment agent housing coupled to the drawer of FIG. 6.

The siphon portion 540 discharges the clothes treatment agent or fluid supplied to the clothes treatment agent housing 500 into the discharge passage 580 using a siphon effect (see FIG. 21). The siphon portion 540 may be provided with a hollow portion in which the clothes treatment agent or fluid flows. The hollow portion may communicate with the collecting portion 570 and the discharge passage 580.

The process in which the fluid flows from one space to another by the siphon effect is a well-known technique, so a description thereof will be omitted.

The siphon portion 540 is located in the inner space of the clothes treatment agent housing 500. In the embodiment, the siphon portion 540 is located between the second part 510*b* and the third part 510*c*. In addition, a lower end portion of the siphon portion 540 is located on the discharge passage 580.

With the configuration, the clothes treatment agent or the fluid collected by the collecting portion 554 along the first to third parts 510*a*, 510*b*, and 510*c* may be discharged to the outside of the clothes treatment agent housing 500 through the discharge passage 580 by the siphon portion 540.

The siphon portion 540 extends in the lengthwise direction, namely, in the up and down direction in the embodiment. The siphon cover portion 550 is located on an upper side of the siphon portion 540. In addition, the siphon portion 540 is inserted into the siphon coupling portion 560.

The siphon cover portion 550 is configured to shield the upper side of the siphon portion 540. The siphon cover portion 550 may be configured to seal an upper opening of the hollow portion formed in the siphon portion 540. Accordingly, the fluid or clothes treatment agent does not flow into the hollow portion inside the siphon portion 540 through the upper opening.

The siphon cover portion 550 includes a first cover surface 551 and a second cover surface 552. The first cover surface 551 is configured to shield the hollow portion. The second cover surface 552 extends from a front end of the first cover surface 551 at a predetermined angle with respect to the first cover surface 551. In one embodiment, the predetermined angle may be an obtuse angle.

The second cover surface 552 may be provided with an arbitrary symbol thereon to indicate the maximum amount of clothes treatment agents to be introduced.

The siphon portion 540 is inserted into the siphon coupling portion 560. The siphon coupling portion 560 extends in the lengthwise direction, namely, in the up and down direction in the embodiment. The siphon coupling portion 560 is provided with a hollow portion formed therethrough. The siphon portion 540 is inserted into the siphon coupling portion 560.

The siphon coupling portion 560 and the siphon cover portion 550 may be integrally formed with each other. When the siphon portion 540 is inserted into the siphon coupling portion 560, the upper side of the siphon portion 540 may be shielded by the siphon cover portion 550. Accordingly, the siphon portion 540 is not exposed to the outside.

The collecting portion 570 is a space in which the clothes treatment agent or fluid supplied to the inner space of the clothes treatment agent housing 500 is collected. The collecting portion 570 is located between the second part 510*b* and the third part 510*c*. The collecting portion 570 may be formed to be lower than the second part 510*b* and the third part 510*c* in height.

As described above, the first part 510*a* and the second part 510*b* of the outer circumferential surface 510 are formed to be inclined downward from the front side of the siphon portion 540. In addition, the third part 510*c* of the outer circumferential surface 510 is formed to be inclined downward from the rear side of the siphon portion 540.

Accordingly, the clothes treatment agent or fluid supplied to the inner space of the clothes treatment agent housing 500 may flow toward the collecting portion 570.

The collecting portion 570 communicates with the siphon portion 540. The clothes treatment agent or fluid collected in the collecting portion 570 may flow to the discharge passage 580 by the siphon portion 540.

The discharge passage 580 is a flow path through which the clothes treatment agent or fluid collected in the collecting portion 570 is discharged to the outside of the clothes treatment agent housing 500.

The discharge passage 580 communicates with the siphon portion 540. The clothes treatment agent or fluid collected in the collecting portion 570 is discharged through the discharge passage 580 via the hollow portion formed through the inside of the siphon portion 540.

The discharge passage 580 communicates with the discharge space portion 358. The clothes treatment agent or fluid discharged through the discharge passage 580 may be supplied to the tub 170 through the fluid outlet port 359 via the discharge space portion 358.

(6) Description of Support Member 600

Figure 16:
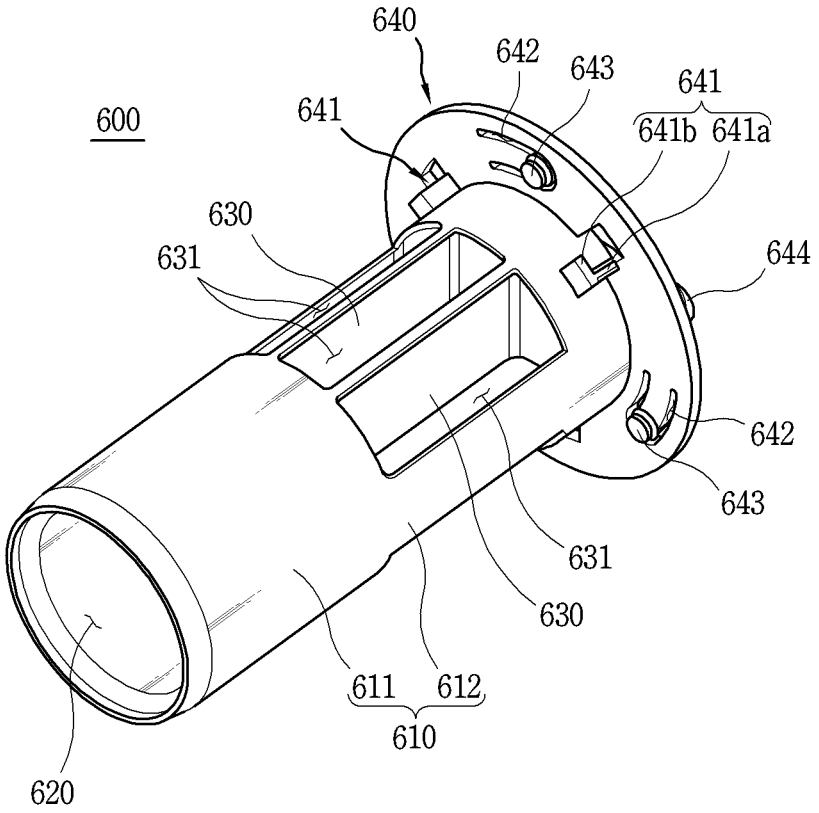
FIG. 16 is a perspective view illustrating a support member provided in the clothes treating machine of FIG. 4.
Figure 17:
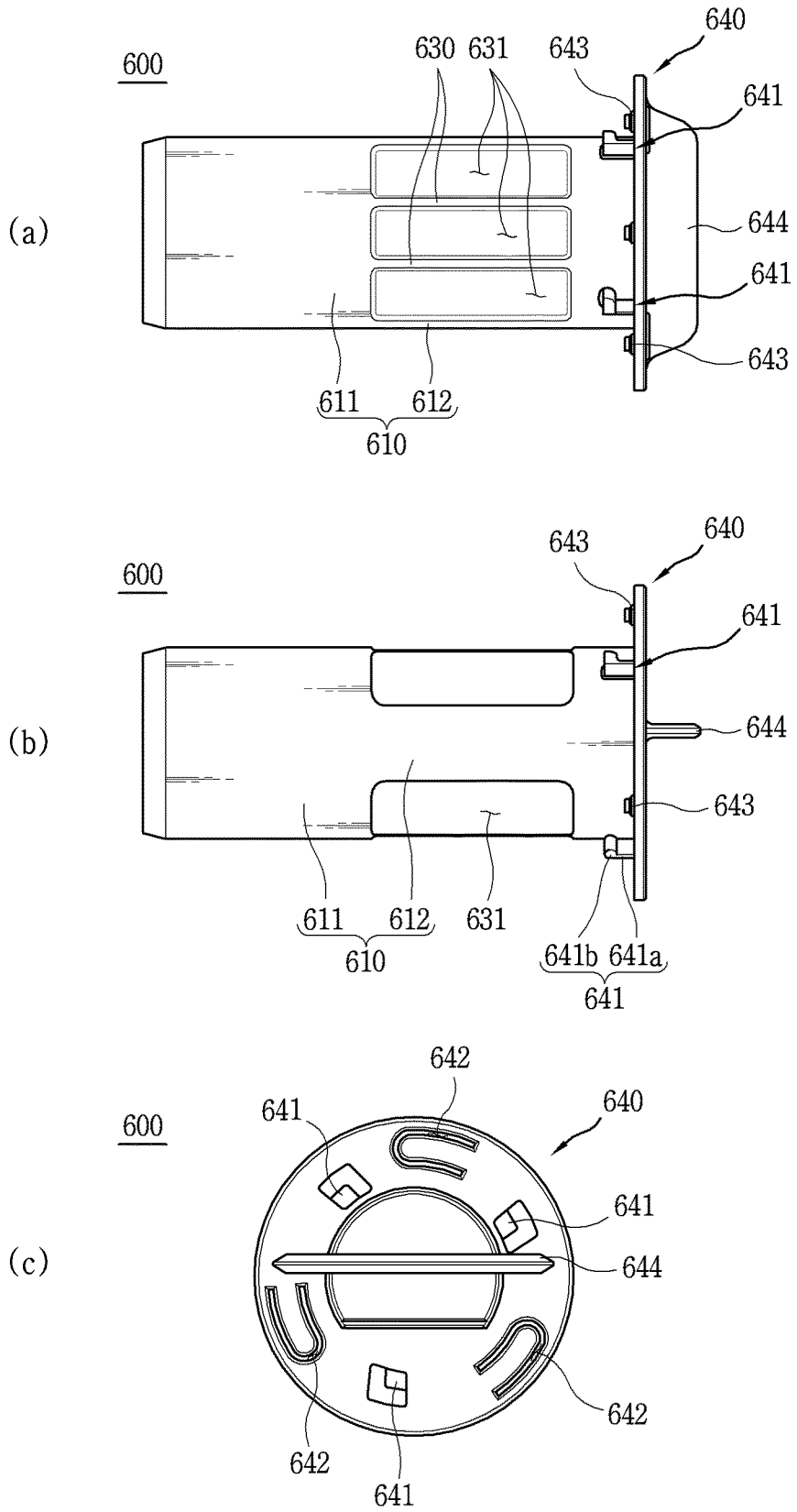
FIG. 17 is a planar view (a), a lateral view (b), and a rear view (c) of the support member of FIG. 16.

Hereinafter, the drawer 600 provided in the clothes treating machine 10 according to the embodiment of the present disclosure will be described in detail with reference to FIGS. 16 and 17.

The support member 600 is configured to support the dispenser assembly 200 at the rear side. The support member 600 may be coupled to the rear protrusion 212 of the dispenser assembly 200.

The support member 600 is coupled through the rear surface 130 of the housing 100. After the support member 600 is inserted through the rear surface 130, it may be rotated to be coupled to the rear surface 130 (see FIG. 4).

The dispenser assembly 200 can be stably supported by the support member 600.

The support member 600 includes a support body portion 610, a support hollow portion 620, a support rib portion 630, and a support head portion 640.

The support body portion 610 defines the body of the support member 600. The support body portion 610 extends by a predetermined distance in the lengthwise direction. In addition, the support body portion 610 is formed to have a circular cross section. That is, the support body portion 610 has a cylindrical shape. The shape of the support body 610 may change to a polygonal column, an elliptical column, or the like.

The support body portion 610 is rotatably coupled through the support member insertion hole 131 of the rear surface 130.

The support body portion 610 includes a first body part 611 and a second body part 612.

The sum of extended distances of the first body part 611 and the second body part 612 is preferably equal to or greater than the sum of a distance between one end of the rear protrusion 212 and the rear surface 130 and a protruded length of the rear protrusion 212.

The first body part 611 extends by a predetermined distance from one end of the support body portion 610 opposite to the support head portion 640, namely, from the front end in the embodiment.

The first body part 611 defines a body of one side of the support body portion 610 in the lengthwise direction. The support hollow portion 620 is formed inside the first body portion 611 in a penetrating manner. The rear protrusion 212 of the frame unit 210 may be inserted into the support hollow portion 620.

The second body part 612 extends by a predetermined distance from one end of the first body part 611 facing the support head portion 640, namely, from the rear end in the embodiment.

The second body part 612 defines a body of another side of the support body portion in the lengthwise direction. The second body part 612 extends by a predetermined distance from one end of the first body part 611 facing the support head portion 640, namely, from the rear end in the embodiment. The support rib portion 630 is formed on an outer circumference of the second body part 612.

The support head portion 640 is coupled to one end of the second body portion 612 opposite to the first body part 611.

The rear protrusion 212 is inserted into the support hollow portion 620. An opening is formed on one side of the support hollow portion 620, namely, on one side opposite to the support head portion 640 in the embodiment in a manner of being recessed by a predetermined distance. The rear protrusion 212 may be inserted into the support hollow portion 620 through the opening.

The support hollow portion 620 is formed by being recessed in the lengthwise direction into one end portion of the first body part 611 facing the rear protrusion 212 by a predetermined distance. The support hollow portion 620 extends within the first body part 611 by the predetermined distance in the lengthwise direction.

That is, the support hollow portion 620 is a portion recessed by the predetermined distance in the lengthwise direction into the one end portion of the first body part 611 opposite to the support head portion 640.

The support hollow portion 620 may extend up to a boundary between the first body part 611 and the second body part 612. That is, the support hollow portion 620 is not formed inside the second body part 612. This results from that the support space portion 631 is recessed into an outer circumference of the second body part 612.

The shape and extended distance of the support hollow portion 620 may be determined to correspond to the shape and protruded length of the rear protrusion 212.

The support rib portion 630 is configured to reinforce rigidity of the support body portion 610. In addition, the support rib portion 630 is configured to reduce an overall weight of the support body portion 610.

The support rib portion 630 is formed on the outer circumference of the second body part 612. The support rib portion 630 may be provided in plurality formed on the outer circumference of the second body part 612 in a circumferential direction.

The support rib portion 630 may extend in the lengthwise direction. In the embodiment, the support rib portion 630 extends by a predetermined distance in the lengthwise direction of the second body part 612.

The support rib portion 630 may be formed in a plate-like shape. That is, the support rib portion 630 may be narrow in width in the left and right direction, high in height in the up and down direction, and long in length in the back and forth direction.

Support space portions 631 are formed at both sides of the support rib portion 630 in a direction perpendicular to the lengthwise direction of the support rib portion 630, namely, at right and left sides in the embodiment.

The support space portion 631 is recessed by a predetermined distance into the outer circumference of the second body part 612. The support space portion 631 may be provided in plurality. The plurality of support space portions 631 may be spaced apart from one another by predetermined distances.

The support rib portion 630 is located between the support space portions 631 adjacent to each other. In other words, it may be said that the support rib portion 630 partitions the support space portions 631.

The support space portion 631 may extend in the lengthwise direction. In the embodiment, the support space portion 631 extends by a predetermined distance in the lengthwise direction of the second body part 612.

The extended distances of the support rib portion 630 and the support space portion 631 are preferably determined to be shorter than the extended distance of the second body part 612. That is, the support rib portion 630 and the support space portion 631 are preferably formed only on the outer circumference of the second body part 612.

This results from the fact that the support hollow portion 620 is formed through the inside of the first body part 611 in the lengthwise direction. That is, the support hollow portion 620 and the support space portion 631 are not in communication with each other.

The support head portion 640 is a portion that is gripped by the user to couple the support member 600 to the rear surface 130 after inserting the support member 600 through the rear surface 130. The support head portion 640 is located on one end of the second body part 612 opposite to the first body part 611.

When the support member 600 is inserted through the rear surface 130, the support head portion 640 is located outside the rear surface 130. That is, the support head portion 640 is exposed to the outside of the housing 100. Therefore, the user can grip the support head portion 640 to rotate the support head portion 640, or insert or separate the support member 600 into or from the rear surface 130.

In the embodiment, the support head portion 640 is formed in a circular plate shape. The shape of the support head portion 640 may change to any shape that the user can grip.

The support head portion 640 includes a coupling protrusion 641, a direction indicating groove 642, a guide protrusion 643, and a grip protrusion 644.

The coupling protrusion 641 is a portion where the support member 600 inserted through the support member insertion hole 131 is coupled to the rear surface 130. The coupling protrusion 641 may be coupled to the support member coupling portion 132*a* as the support member 600 is rotated.

When the support member 600 is inserted through the support member insertion hole 131, the coupling protrusion 641 is inserted into the support member coupling hole 132. When the support member 600 is rotated, the coupling protrusion 641 is rotated together and coupled to the support member coupling hole 132*a* formed on one end portion of the support member coupling hole 132.

The coupling protrusion 641 may be provided in any shape that can be coupled to and separated from a groove or another protrusion. In one embodiment, the coupling protrusion 641 and the support member coupling portion 132*a* may be coupled to each other in a snapping manner.

The coupling protrusion 641 is provided in plurality radially on an inner side of one surface of the support head portion 640 facing the support body portion 610 in a circumferential direction. The plurality of coupling protrusions 641 are spaced apart from one another by predetermined distances. In the embodiment, the coupling protrusion 641 is provided by three, but the number may vary.

The coupling protrusion 641 and the guide protrusion 643 may be alternately arranged on the one surface of the support head portion 640 along the circumferential direction.

The coupling protrusion 641 includes a first protrusion 641*a* and a second protrusion 641*b*.

The first protrusion 641*a* protrudes from the one surface of the support head portion 640 facing the support body portion 610 by a predetermined distance at a predetermined angle with respect to the one surface. A cross-sectional area of the first protrusion 641*a* is preferably smaller than that of the support member coupling hole 132.

The second protrusion 641*b* protrudes from one end portion of the first protrusion 641*a* at a predetermined angle with respect to the first protrusion 641*a*. In one embodiment, the second protrusion 641*b* may protrude at an acute angle with respect to the first protrusion 641*a*.

When the support member 600 is rotated in one direction, the second protrusion 641*b* may also be rotated so as to be coupled to the support member coupling portion 132*a*. When the support member 600 is rotated in a direction different from the one direction, the second protrusion 641*b* may also be rotated so as to be released from the support member coupling portion 132*a*.

The direction indicating groove 642 allows the user to recognize a rotating direction of the support member 600. That is, the direction indicating groove 642 may indicate either a direction in which the support member 600 is to be coupled to the rear surface 130 or a direction in which the support member 600 is to be separated from the rear surface 130.

The direction indicating groove 642 may be formed through the support head portion 640. The direction indicating groove 642 may be formed to surround the guide protrusion 643.

The direction indicating groove 642 may be configured to indicate a clockwise or counterclockwise direction. In the embodiment, the direction indicating groove 642 is configured to indicate a counterclockwise direction.

The direction indicating groove 642 is provided in plurality formed on a radially inner side of the support head portion 640 in the circumferential direction. The plurality of direction indicating grooves 642 are spaced apart from one another by predetermined distances. In the embodiment, the direction indicating groove 642 is provided by three, but the number may vary.

By virtue of the direction indicating groove 642, the user can recognize the rotating direction of the support member 600 and can easily manipulate the support member 600.

The guide protrusion 643 is moved in response to the rotation of the support member 600 to limit a rotation path and a rotation distance of the support member 600.

The guide protrusion 643 protrudes by a predetermined distance from the one surface of the support head portion 640 facing the support body portion 610. The guide protrusion 643 may be surrounded by the direction indicating groove 642.

The guide protrusion 643 is provided in plurality on a radially inner side of the one surface of the support body portion 640 in the circumferential direction. The plurality of guide protrusions 643 are spaced apart from one another by predetermined distances. In the embodiment, the guide protrusion 643 is provided by three, but the number may vary.

The grip protrusion 644 is a portion gripped by the user. The user can easily rotate the support member 600 by gripping the grip protrusion 644. In addition, the user can grip the grip protrusion 644 to insert the support member 600 into the rear surface 130 or separate it from the rear surface 130.

The grip protrusion 644 protrudes by a predetermined distance from another surface opposite to the one surface of the support head portion 640 facing the support body portion 610.

In the embodiment, the grip protrusion 644 extends in a radial direction of the support head portion 640. The grip protrusion 644 may be formed in any shape that the user can grip.

3. Description of Process of Limiting Direction and Order of Detaching Storage Unit 400 According to Embodiment of the Present Disclosure The clothes treating machine 10 according to the embodiment of the present disclosure is configured to limit a direction in which the storage unit 400 is inserted into the drawer 300 and a direction in which the storage unit 400 is detached from the drawer 300.

Hereinafter, a process of detaching the storage unit 400 according to an embodiment of the present disclosure will be described in detail with reference to FIG. 18.

Figure 18:
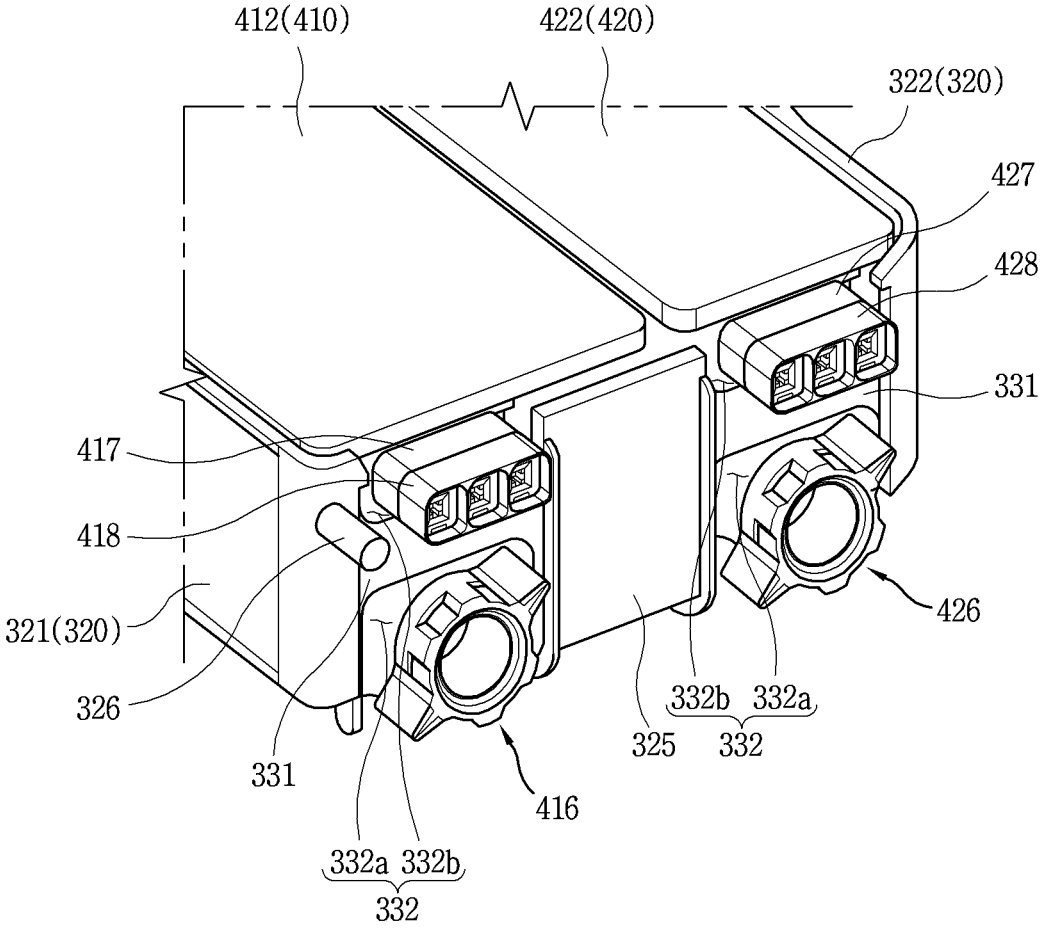
FIG. 18 is a rear perspective view illustrating a state in which the storage container is coupled to the drawer of FIG. 6.

FIG. 18 illustrates a rear side of the drawer frame 320 in a state in which the storage unit 400 has been accommodated.

The rear end part 330 is disposed on the rear side of the drawer frame 320. The rear end part 330 includes the partition member 331. The partition member 331 partitions the opening 332 formed on the rear end part 330 into the check valve opening 332*a* at the lower side and the sensor opening 332*b* at the upper side. That is, the partition member 331 blocks the communication between the check valve opening 332*a* and the sensor opening 332*b*.

The check valve 416, 426 is provided on the rear lower side of the storage unit. The check valve 416, 426 protrudes by a predetermined distance.

Therefore, the check valve 416, 426 located in the check valve opening 332*a* cannot pass through the sensor opening 332*b* due to the partition member 331. The rear side of the storage unit 400 where the check valve 416, 426 is located cannot be inserted later or separated earlier than the front side.

As a result, in order for the storage unit 400 to be accommodated in the drawer 300, the rear side of the storage unit 400 should be inserted first. On the other hand, in order for the storage unit 400 to be detached from the drawer 300, the rear side of the storage unit 400 should be separated later.

Specifically, when it is intended to perpendicularly insert the storage unit 400, the check valve 416, 426 passing through the upper sensor opening 332*b* is stopped by the partition member 331.

Similarly, when it is intended to insert the storage unit 400 from its one side in the lengthwise direction, namely, from the front side in the embodiment, the check valve 416, 426 passing through the upper sensor opening 332*b* is stopped by the partition member 331.

This is because, as described above, the check valve opening 332*a* and the sensor opening 332*b* do not communicate with each other by the partition member 331.

Therefore, the rear side of the storage unit 400 should first be inserted into the drawer 300 while maintaining a state in which the upper side of the storage unit 400 is located higher than the rear side of the storage unit 400.

That is, the sensor portion 417, 427 is first inserted into the sensor opening 332*b*, and then the check valve 416, 426 is inserted into the check valve opening 332*a*.

In other words, the storage unit 400 is inserted into the space of the drawer frame 320 in a state where a distance between one side of the storage unit 400 in the lengthwise direction on which the check valve 416, 426 is located, namely, the rear side of the storage unit 400 in the embodiment, and one side of the drawer frame 320 on which the rear end part 330 is located, namely, the rear side of the drawer frame 320 in the embodiment, is shorter than a distance between another side of the storage unit 400 in the lengthwise direction, namely, the front side of the storage unit 400 in the embodiment, and another side of the drawer frame 320 in the lengthwise direction, namely, the front side of the drawer frame 320 in the embodiment.

Alternatively, the storage unit 400 is inserted into the space of the drawer frame 320 in a state in which the another side of the storage unit 400 in the lengthwise direction, namely, the front side of the storage unit 400 in the embodiment, is spaced farther apart from the drawer frame 320 than the one side of the storage unit 400 in the lengthwise direction having the check valve 416, 426, namely, the rear side of the storage unit 400 in the embodiment.

In other words, the storage unit 400 is inserted into the space of the drawer frame 320 in a manner that one surface in the lengthwise direction, namely, a lower surface in the embodiment, forms an acute angle with the bottom portion 324 formed on one surface of the drawer frame 320, namely, on the lower side in the embodiment, at a vertex which corresponds to one side of the storage unit 400 where the check valve 416, 426 is located.

Accordingly, the leakage of the clothes treatment agent through the through hole 415, 425 formed on the front side of the storage unit 400 can be prevented during the process of inserting the storage unit 400 into the drawer 300.

In addition, when desiring to perpendicularly detach the storage unit 400, the check valve 416, 426 located in the lower check valve opening 332*a* is stopped by the partition member 331.

Similarly, when desiring to detach the storage unit 400 starting from its rear side, the check valve 416, 426 located in the lower check valve opening 332*a* is stopped by the partition member 331.

Therefore, the rear side of the storage unit 400 should first be detached from the drawer 300 while maintaining a state in which the upper side of the storage unit 400 is located higher than the lower side of the storage unit 400.

On the other hand, the check valve 416, 426 is first separated from the check valve opening 332*a*, and then the sensor portion 417, 427 is separated from the sensor opening 332*b*.

Even in this case, the storage unit 400 is separated from the space of the drawer frame 320 in a state where a distance between one side of the storage unit 400 in the lengthwise direction on which the check valve 416, 426 is located, namely, the rear side of the storage unit 400 in the embodiment, and one side of the drawer frame 320 on which the rear end part 330 is located, namely, the rear side of the drawer frame 320 in the embodiment, is shorter than a distance between another side of the storage unit 400 in the lengthwise direction, namely, the front side of the storage unit 400 in the embodiment, and another side of the drawer frame 320 in the lengthwise direction, namely, the front side of the drawer frame 320 in the embodiment.

Alternatively, the storage unit 400 is separated from the space of the drawer frame 320 in a state in which the another side of the storage unit 400 in the lengthwise direction, namely, the front side of the storage unit 400 in the embodiment, is spaced farther apart from the drawer frame 320 than the one side of the storage unit 400 in the lengthwise direction having the check valve 416, 426, namely, the rear side of the storage unit 400 in the embodiment.

In other words, the storage unit 400 is separated from the space of the drawer frame 320 in a manner that one surface in the lengthwise direction, namely, a lower surface in the embodiment, forms an acute angle with the bottom portion 324 formed on one surface of the drawer frame 320, namely, on the lower side in the embodiment, at a vertex which corresponds to one side of the storage unit 400 where the check valve 416, 426 is located Accordingly, the through hole 415, 425 formed through the front side of the storage unit 400 faces an upper side or a direction forming a predetermined inclination with the upper side during the process of detaching the storage unit 400 from the drawer 300.

Therefore, a phenomenon in which the clothes treatment agent accommodated in the storage unit 400 leaks through the through hole 415, 425 during the insertion and separation of the storage unit 400 can be prevented.

4. Description of Process of Minimizing Residual of Clothes Treatment Agent Inside Storage Unit 400 According to Embodiment of the Present Disclosure In the clothes treating machine 10 according to the embodiment of the present disclosure, the residual of the clothes treatment agent accommodated in the storage unit 400 can be minimized.

Hereinafter, a process of minimizing the residual of the clothes treatment agent in the inner space of the storage unit 400 according to an embodiment of the present disclosure will be described in detail, with reference to FIGS. 19 and 20.

The clothes treatment agent accommodated in the inner space of the storage body portion 411, 421 flows to the rear space of the storage body portion 411, 421 along the discharge inclined portion 430.

The discharge inclined portion 430 includes the first bottom surface 431 inclined toward the rear side, and the second bottom surface 432 and the third bottom surface 433 located lower than the first bottom surface 431. In addition, the second bottom surface 432 is located lower than the third bottom surface 433 in height.

The first joint surface 434 connecting the first bottom surface 431 and the third bottom surface 433 is formed such that the rear side is lower than the front side in height. Likewise, the second joint surface 435 connecting the second bottom surface 432 and the third bottom surface 433 is also formed such that the rear side is lower than the front side in height.

That is, the discharge inclined portion 430 is formed to be inclined from the front side to the rear side. Accordingly, the clothes treatment agent may flow from the front side to the rear side along the discharge inclined portion 430.

The discharge inclined portion 430 is provided with the first bottom surface 431, the first joint surface 434, the third bottom surface 433, the second joint surface 435, and the second bottom surface 432, which are sequentially disposed from one side of the discharge inclined portion 430 facing the grip portion 310 to another side opposite to the one side.

Accordingly, the clothes treatment agent flows sequentially along the first bottom surface 431, the first joint surface 434, the second collection space portion 437, and the second joint surface 435, so as to be introduced into the second bottom surface 432, that is, the first collection space portion 436.

The first collection space portion 436 is located in the rearmost side of the discharge inclined portion 430. Therefore, the clothes treatment agent is finally collected in the first collection space portion 436.

The check valve 416, 426 is partially accommodated in the first collection space portion 436. The intake port 416*d*, 426*d* is formed through one side, namely, a lower side of the check valve cylinder portion 416*a*, 426*a* facing the second bottom surface 432.

The first collection space portion 436 and the inner space of the check valve cylinder portion 416*a*, 426*a* communicate with each other through the intake port 416*d*, 426*d*. Accordingly, the clothes treatment agent collected in the first collection space portion 436 can flow into the inner space of the check valve cylinder portion 416*a*, 426*a* via the intake port 416*d*, 426*d*.

Meanwhile, the primary pump valve 224 is partially accommodated in the inner space of the check valve cylinder portion 416*a*, 426*a*. The inlet port 224*d* is formed through the primary valve cylinder portion 224*a* accommodated in the inner space of the check valve cylinder portion 416*a*, 426*a*.

The inlet port 224*d* is located on one side, namely, a lower side of the primary valve cylinder portion 224*a* facing the intake port 416*d*, 426*d*.

When the primary pump valve 224 is inserted into the check valve 416, 426, the inner space of the check valve cylinder portion 416*a*, 426*a* communicates with the inner space of the primary valve cylinder portion 224*a* through the inlet port 224*d*.

Accordingly, the clothes treatment agent introduced into the inner space of the check valve cylinder portion 416*a*, 426*a* can flow into the inner space of the primary valve cylinder portion 224*a* through the inlet port 224*d*.

At this time, when the clothes treatment agent pump unit 220 is operated, pressure for sucking an external fluid is generated in the inner space of the check valve cylinder portion 416*a*, 426*a*, the inner space inside the primary valve cylinder portion 224*a*, and the inner space of the secondary valve cylinder portion 225*a*.

Accordingly, the clothes treatment agent collected in each collection space portion 436 and 437, particularly, the first collection space portion 436 can flow to the clothes treatment agent supply unit 240 communicating with the discharge portion 226 by the negative pressure.

In summary, the clothes treatment agent accommodated in the storage unit 400 flows to the first collection space portion 436 where the check valve 416, 426 is located along the discharge inclined portion 430. Accordingly, even when the amount of clothes treatment agents accommodated is sufficient, the clothes treatment agent can be automatically supplied to the drawer 300 effectively.

The discharge inclined portion 430 is configured such that its height is lowered toward the rear side. Therefore, the clothes treatment agent is collected by gravity in the first collection space portion 436 formed in the rearmost side of the storage container 410, 420.

Accordingly, the clothes treatment agent is collected in the first collection space portion 436 without being scattered in the storage container 410, 420. Accordingly, the residual clothes treatment agent can be collected smoothly.

The first collection space portion 436 communicates with the check valve 416, 426, the primary pump valve 224, and the secondary pump valve 225. When negative pressure is generated in response to the operation of the clothes treatment agent pump unit 220, the clothes treatment agent collected in the first collection space portion 436 may flow to the clothes treatment agent pump unit 220 through those components (dotted arrow in FIG. 20).

Accordingly, the collected clothes treatment agent can be supplied to the clothes treatment agent supply unit 240.

Therefore, the amount of clothes treatment agents remaining inside the storage container 410, 420 can be minimized, thereby minimizing contamination due to the remaining clothes treatment agent.

5. Description of Process of Preventing Residual Due to Overflow from Clothes Treatment Agent Housing 500 According to Embodiment of the Present Disclosure The clothes treating machine 10 according to the embodiment of the present disclosure is configured such that the clothes treatment agent or fluid overflowed from the clothes treatment agent housing 500 does not remain in the inner space of the drawer 300.

Hereinafter, a process of preventing the overflowed clothes treatment agent or fluid from remaining in the inner space of the drawer 300 according to the embodiment of the present disclosure will be described in detail with reference to FIGS. 21 to 23.

The clothes treatment agent housing 500 is accommodated in the housing accommodation part 350 of the drawer 300. At this time, the clothes treatment agent housing 500 may be accommodated in the drawer 300 in a manner of being spaced a predetermined distance apart from the lower surface 351 and the inner wall 323 of the rear side.

Specifically, the support protrusion surface 511 disposed on the front side of the clothes treatment agent housing 500 is supported by the support rod 352. In addition, the lower side of the clothes treatment agent housing 500 is supported by the support pin 353.

Further, the alignment pin 512 protrudes from the rear lower side of the clothes treatment agent housing 500. When the alignment pin 512 is inserted into the alignment pin insertion groove 354*a*, the lower side of the outer circumferential surface 510 of the clothes treatment agent housing 500 is spaced a predetermined distance apart from the upper surface of the support boss portion 354.

On the other hand, the protruding portion 355 protrudes by a predetermined distance from the second plane portion, which is located at the rear, of the second plane portions of the inner wall 323 surrounding the housing accommodation part 350. The first surface 355*a* of the protruding portion 355 extends in the up and down direction, and the second surface 355*b* is formed to be inclined downward.

In addition, the spacing protrusion 530 protrudes by a predetermined distance from the third part 510*c* of the outer circumferential surface 510 located at the rear side. The spacing protrusion 530 is brought into contact with the first surface 355*a* of the protruding portion 355.

Therefore, the rear side of the housing accommodation part 350 is spaced apart from the second plane portion, which is located at the rear, of the second plane portions of the inner wall 323 by the protruded distance of the protruding portion 355 and the protruded distance of the spacing protrusion 530.

The space defined by the spacing configuration is defined as the space portion 356. The space portion 356 communicates with the discharge space portion 358 by a space defined between the alignment pin 512 and the support boss portion 354.

Accordingly, the clothes treatment agent or fluid overflowed from the clothes treatment agent housing 500 can flow to the discharge space portion 358 through the space portion 356. The clothes treatment agent or fluid flowed to the discharge space portion 358 can be supplied to the tub 170.

As a result, the clothes treatment agent or fluid overflowed from the clothes treatment agent housing 500 is not introduced into the storage unit 400 located adjacent to the clothes treatment agent housing 500.

Figure 22:
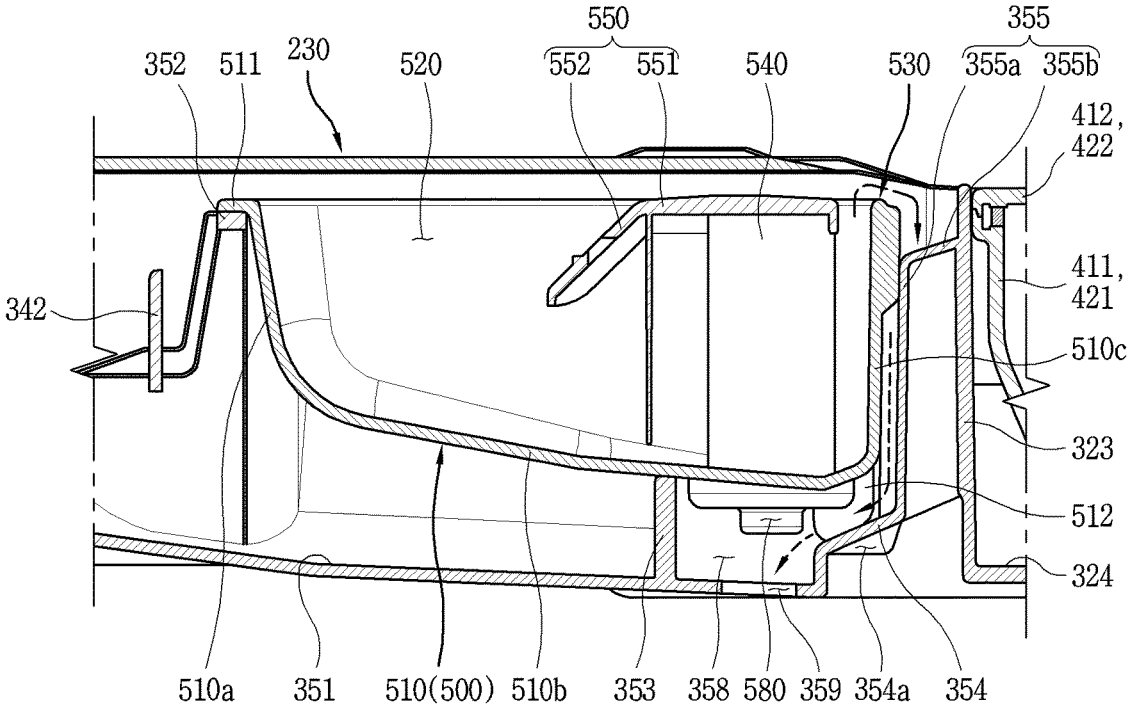
FIG. 22 is an enlarged cross-sectional view of a part B of FIG. 21.
Figure 23:
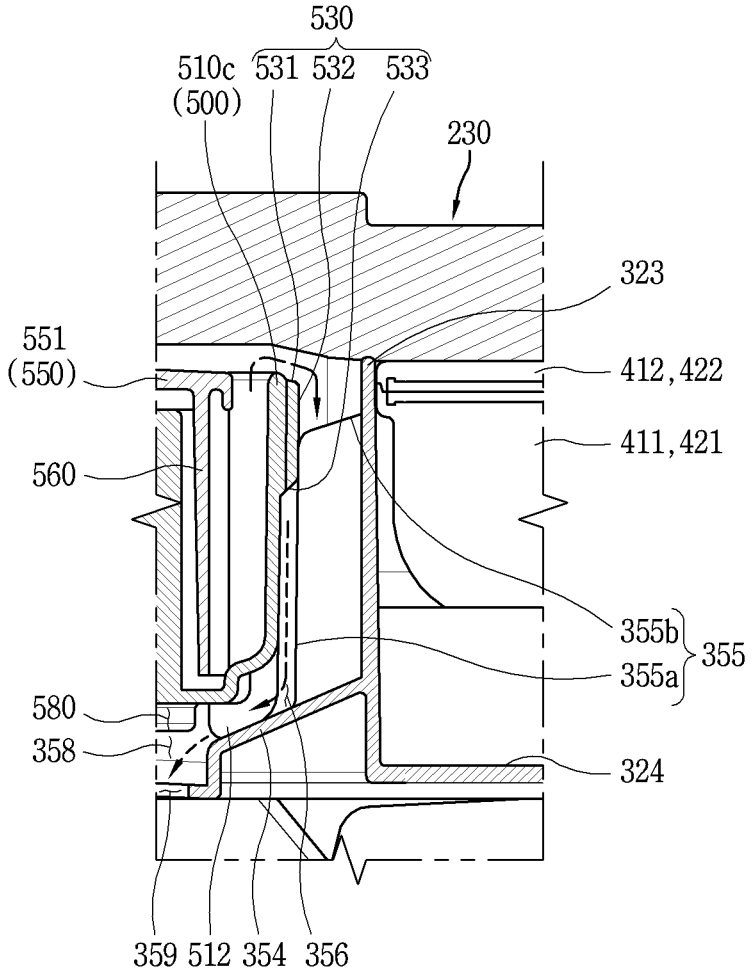
FIG. 23 is an enlarged cross-sectional view of part C of FIG. 21.

Therefore, even when the clothes treatment agent or fluid is excessively supplied to the clothes treatment agent housing 500, the overflowed clothes treatment agent or fluid can all be discharged to the tub 170 (refer to dotted arrows in FIGS. 21 to 23). Accordingly, the overflowed clothes treatment agent or fluid does not remain in the inner space of the drawer 300.

This may result in preventing contamination of the components of the drawer 300 due to the overflowed clothes treatment agent or fluid.

6. Description of Process of Supporting Dispenser Assembly 200 by Support Member 600 According to Embodiment of the Present Disclosure The clothes treating machine 10 according to the embodiment of the present disclosure includes the support member 600 for stably supporting the dispenser assembly 200.

Hereinafter, the process in which the dispenser assembly 200 of the clothes treating machine 10 is supported according to the embodiment of the present disclosure will be described in detail with reference to FIGS. 24 to 26.

As described above, the support member insertion hole 131 is formed through the rear surface 130. The support body portion 610 of the support member 600 is coupled through the support member insertion hole 131.

In addition, the support member coupling hole 132 and the support member guide hole 133 are provided in plurality formed on the radially outer side of the support member insertion hole 131 along the circumferential direction. The coupling protrusion 641 is inserted into the support member coupling hole 132, and the guide protrusion 643 is inserted into the support member guide hole 133.

The support member coupling hole 132 and the support member guide hole 133 may each be formed in an arcuate shape. In addition, the plurality of support member coupling holes 132 and support member guide holes 133 may be alternately arranged along the circumferential direction.

The support member coupling portion 132*a* is formed on one end portion of each support member coupling hole 132 in the circumferential direction. The coupling protrusion 641 of the support member 600 is coupled to the support member coupling portion 132*a*. The coupling may be achieved by rotating the inserted support member 600.

Figure 25:
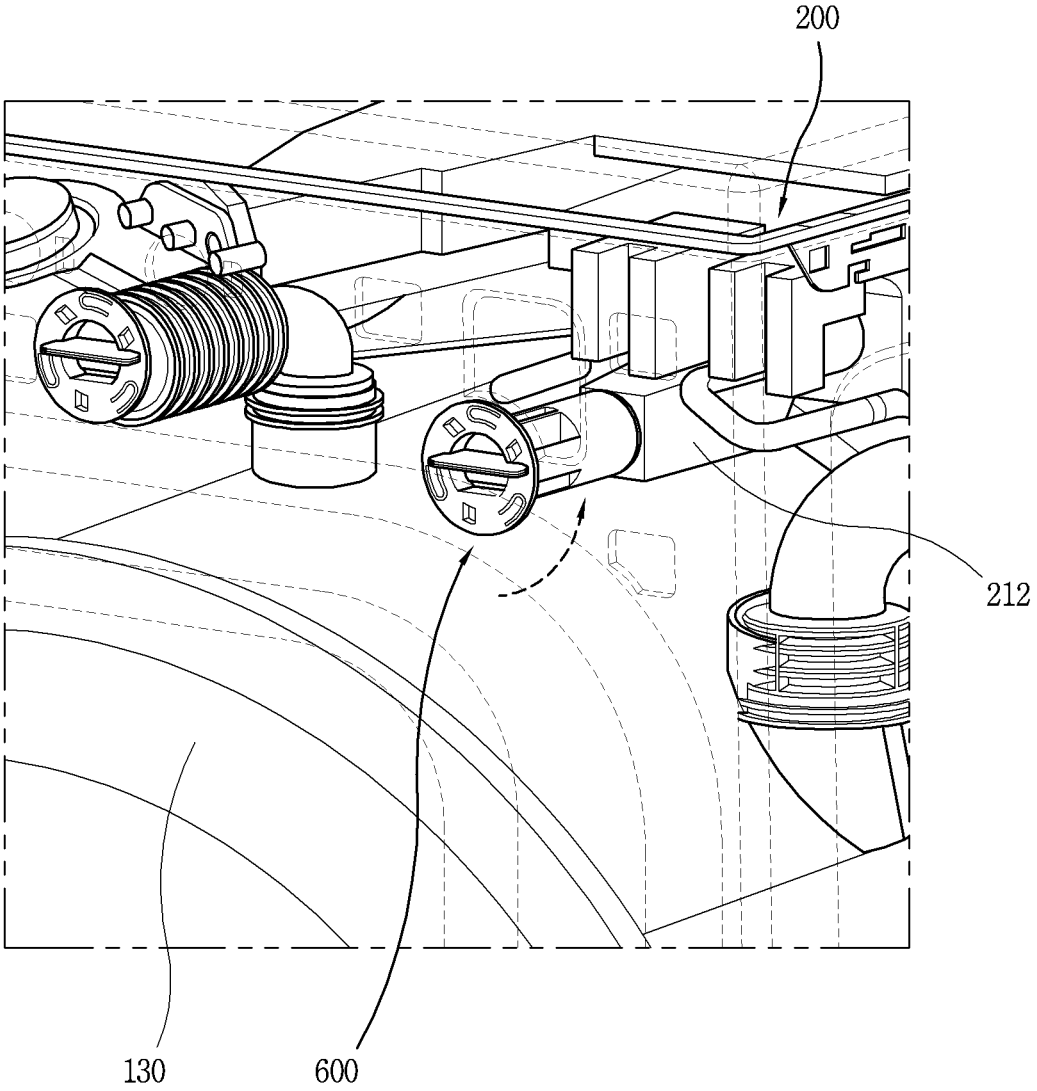
FIG. 25 is a rear perspective view illustrating a state in which the support member of FIG. 16 is coupled to the housing.
Figure 26:
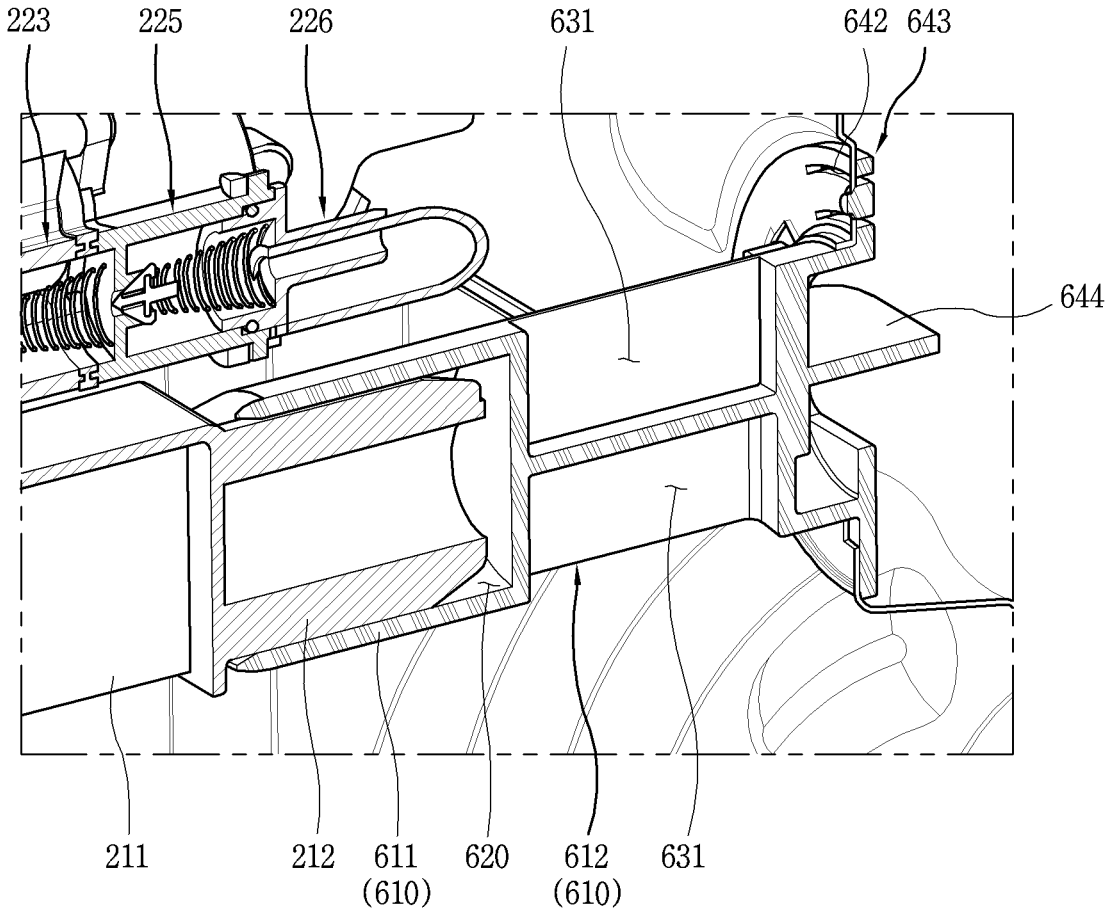
FIG. 26 is a partially-enlarged cross-sectional view of FIG. 25.

Referring to FIG. 25, a state in which the support member 600 is inserted into the rear surface 130 through the process is illustrated.

First, the support body portion 610 is inserted through the support member insertion hole 131. The support body portion 610 may be inserted through the rear surface 130 until the rear protrusion 212 is completely inserted into the support hollow portion 620.

In one embodiment, when the insertion of the support body portion 610 is completed, one end of the rear protrusion 212 may be spaced a predetermined distance apart from one end of the support hollow portion 620 facing the second body portion 612, namely, from a boundary between the first body portion 611 and the second body portion 612.

At this time, the coupling protrusion 641 is inserted into the support member coupling hole 132, and the guide protrusion 643 is inserted into the support member guide hole 133.

The user easily rotates the support member 600 by gripping the grip protrusion 644. In the embodiment, the direction indicating groove 642 is formed in the counterclockwise direction, and thus the support member 600 can be rotated in the counterclockwise direction.

The coupling protrusion 641 is rotated along the support member coupling hole 132. In addition, the guide protrusion 643 is rotated along the support member guide hole 133. By virtue of the guide protrusion 643, the support member 600 can be rotated without being linearly moved.

The rotational movement may proceed until the coupling protrusion 641 is coupled to the support member coupling portion 132*a*.

When the coupling protrusion 641 is coupled to the support member coupling portion 132*a*, the rotation of the support member 600 is terminated. In one embodiment, the coupling protrusion 641 and the support member coupling portion 132*a* may be fitted to each other in a snapping manner.

In addition, it will be understood that the process is performed in reverse so that the support member 600 can be separated.

Hereinafter, the state in which the support member 600 is completely coupled to the rear surface 130 and the rear protrusion 212 will be described in more detail with reference to FIG. 26.

The rear protrusion 212 is inserted into the support hollow portion 620. The end portion of the rear protrusion 212 may be spaced a predetermined distance apart from the boundary between the first body portion 611 and the second body portion 612 in which the support hollow portion 620 is formed. In another embodiment, the end portion of the rear protrusion 212 may be inserted into the support hollow portion 620 until it contacts the boundary.

The plurality of tooth portions 212*a* is formed on the outer circumference of the rear protrusion 212. The tooth portions 212*a* can reinforce rigidity of the rear protrusion 212 in the lengthwise direction.

In addition, the rear protrusion 212 is configured to increase in diameter in a direction toward the lower body portion 211 from one end thereof. Accordingly, the rear protrusion 212 can be easily inserted into the support hollow portion 620.

The support rib portion 630 is formed on an outer circumference of the second body part 612. The support rib portion 630 may reinforce rigidity of the support body portion 610 in the lengthwise direction.

One surface of the support head portion 640 facing the support body portion 610 is in contact with the rear surface 130. Therefore, the support member 600 can be restricted from being fluctuated in the up and down direction, resulting in stably maintaining the coupled state between the rear protrusion 212 and the support member 600.

In addition, the support member 600 is located in a space portion, in which no other members are located, in the inner space S of the housing 100. That is, the support member 600 does not interfere with other components provided in the inner space S of the housing 100.

As described above, the dispenser assembly 200 may be supported by the housing frame 110 on the front side and the right side, and by the support member 600 on the rear side. Therefore, compared to the case where only the front side and the right side of the dispenser assembly 200 are supported, the support member 600 can be stably supported so as to be kept located on its original position.

Moreover, several components, such as the clothes treatment agent pump unit 220 and the like, which have great weights, are provided at the rear side of the dispenser assembly 200. Considering this, the dispenser assembly 200 can be more stably supported by the support member 600 in the inner space S of the housing 100.

Therefore, even if a predetermined vibration occurs as the clothes treating machine 10 is operated, the dispenser assembly 200 can be stably kept located on its original position. As a result, the clothes treatment agent or fluid can be stably supplied to the tub 170. Accordingly, clothes treatment efficiency of the clothes treating machine 10 can be improved.

Although described above with reference to the preferred embodiments of the present disclosure, it will be understood that various changes and modifications can be made by those skilled in the art within the scope of the claims.

What is claimed is:

1. A support member for a dispenser assembly of a clothes treating machine, the support member comprising:

a support body portion that extends in a lengthwise direction; and a support head portion located at a first end portion of the support body portion in the lengthwise direction, wherein the support body portion defines a support hollow portion that is recessed from a second end portion of the support body portion and that extends toward the first end portion of the support body portion by a predetermined distance in the lengthwise direction, and wherein the support hollow portion is configured to receive a rear protrusion of the dispenser assembly, the rear protrusion being positioned inside a housing of the clothes treating machine.

2. The support member of claim 1, wherein the support body portion comprises:

a first body part that extends from the second end portion in the lengthwise direction by the predetermined distance; and a second body part that extends from the first body part to the support head portion.

3. The support member of claim 2, wherein the second body part defines a support space recessed from an outer circumference of the second body part.

4. The support member of claim 3, wherein the second body part comprises a plurality of support rib portions that divide the support space into a plurality of support space portions, that are spaced part from one another along the outer circumference of the second body part, and that are configured to reinforce rigidity of the support body portion.

5. The support member of claim 4, wherein the plurality of support space portions and the plurality of support rib portions extend in the lengthwise direction.

6. The support member of claim 1, wherein the support head portion comprises a coupling protrusion that protrudes from a first side of the support head portion facing the support body portion, the coupling protrusion being configured to couple to the housing of the clothes treating machine.

7. The support member of claim 6, wherein the coupling protrusion comprises:

a first protrusion that protrudes toward the support body portion; and a second protrusion that extends from an end portion of the first protrusion, the second protrusion defining at a predetermined angle with respect to the first protrusion.

8. The support member of claim 1, wherein the support head portion comprises a grip protrusion that protrudes from a side of the support head portion facing opposite to the support body portion, the grip protrusion being configured to be gripped by a user.

9. The support member of claim 1, wherein the support head portion comprises a guide protrusion that protrudes from a side of the support head portion facing the support body portion, the guide protrusion being configured to be inserted into a support member guide hole defined at the housing of the clothes treating machine and to limit rotation of the support head portion and the support body portion with respect to the housing of the clothes treating machine.

10. The support member of claim 1, wherein the support head portion is configured to be coupled to a rear surface of the housing, and wherein the support body portion is spaced apart from the rear surface of the housing in the lengthwise direction such that the support hollow portion receives the rear protrusion of the dispenser assembly inside the housing.

11. A clothes treating machine comprising:

a housing;

a tub located in the housing;

a drum rotatably disposed in the tub;

a dispenser assembly accommodated in the housing and configured to communicate with the tub and to supply a clothes treatment agent into the tub, the dispenser assembly comprising a rear protrusion that protrudes rearward and is positioned inside the housing; and a support member coupled to a rear surface of the housing to support the dispenser assembly, the support member comprising:

a support body portion that extends in a lengthwise direction, and a support head portion located at a first end portion of the support body portion in the lengthwise direction, wherein the support body portion defines a support hollow portion that is recessed from a second end portion of the support body portion, that extends toward the first end portion of the support body portion by a predetermined distance in the lengthwise direction, and that is coupled to the dispenser assembly, and wherein the support hollow portion is configured to receive the rear protrusion of the dispenser assembly positioned inside the housing.

12. The clothes treating machine of claim 11, wherein the rear protrusion and the support hollow portion have a circular cross section, and wherein the rear protrusion is rotatably inserted into the support hollow portion.

13. The clothes treating machine of claim 11, wherein the support body portion comprises:

a first body part that extends from the second end portion of the support body portion in the lengthwise direction by the predetermined distance, the first body part defining the support hollow portion; and a second body part that extends from the first body part to the support head portion, the second body part defining a support space portion recessed from an outer circumference of the second body part.

14. The clothes treating machine of claim 13, wherein the second body part comprises a plurality of support rib portions that divide the support space portion into a plurality of support space portions, that extend in the lengthwise direction, and that are spaced apart from one another along the outer circumference of the second body part, and wherein each of the plurality of support rib portions is disposed between two of the plurality of support space portions and configured to reinforce rigidity of the support body portion.

15. The clothes treating machine of claim 11, wherein the support head portion comprises a coupling protrusion that protrudes from a first side of the support head portion facing the support body portion, wherein the housing comprises a support member coupling portion disposed at the rear surface of the housing and configured to couple to the coupling protrusion of the support head portion, and wherein the coupling protrusion is configured to be coupled to the support member coupling portion based on the support member being inserted into the rear surface of the housing and rotated relative to the housing.

16. The clothes treating machine of claim 11, further comprising:

a drawer configured to be inserted into the dispenser assembly and to accommodate the clothes treatment agent therein, the drawer being configured to communicate with the tub and supply the clothes treatment agent into the tub; and a clothes treatment agent housing that defines an inner space configured to accommodate the clothes treatment agent, the clothes treatment agent housing having an opening in communication with the inner space, wherein the drawer comprises:

a drawer frame that extends in the lengthwise direction and defines a first inner space, an inner wall that faces the first inner space and divides the first inner space into at least two spaces, the at least two spaces comprising a clothes treatment agent housing accommodation space that is surrounded by the inner wall and configured to accommodate the clothes treatment agent housing, and a protruding portion that protrudes from a first side of the inner wall and is configured to, based on the clothes treatment agent housing being accommodated in the clothes treatment agent housing accommodation space, contact the clothes treatment agent housing to separate the clothes treatment agent housing from the first side of the inner wall.

17. The clothes treating machine of claim 11, further comprising:

a drawer configured to be inserted into the dispenser assembly, the drawer defining a drawer space therein; and a storage container that is configured to be inserted into the drawer space, that extends in the lengthwise direction, and that defines an inner space configured to accommodate the clothes treatment agent, wherein the storage container comprises a discharge inclined portion that extends from a first side of the storage container to a second side of the storage container in the lengthwise direction, that is inclined with respect to the lengthwise direction, and that is configured to guide the clothes treatment agent accommodated in the storage container from the first side of the storage container to the second side of the storage container.

18. The clothes treating machine of claim 17, wherein the storage container further comprises a storage cover portion that faces the discharge inclined portion and that is configured to cover the inner space of the storage container, wherein the discharge inclined portion comprises:

a first bottom surface that extends from the first side of the storage container toward the second side of the storage container; and a second bottom surface that is connected to the first bottom surface and extends to the second side of the storage container, and wherein a maximum distance between the storage cover portion and the first bottom surface is less than a minimum distance between the storage cover portion and the second bottom surface.

19. The clothes treating machine of claim 11, further comprising:

a drawer that defines an inner space configured to accommodate the clothes treatment agent therein, the drawer being configured to be inserted into the dispenser assembly and to communicate with the tub to supply the clothes treatment agent into the tub, the drawer comprising:

a drawer frame that extends in the lengthwise direction and defines the inner space of the drawer, and a rear end portion that faces the rear surface of the housing and defines an opening in communication with the inner space of the drawer; and a storage container that is configured to be inserted into the inner space of the drawer and defines a storage space configured to accommodate the clothes treatment agent, the storage container comprising a check valve that protrudes from a side of the storage container in the lengthwise direction.

20. The clothes treating machine of claim 19, wherein the rear end portion of the drawer comprises a partition member located in the opening, and the partition member extending in a widthwise direction of the drawer frame and partitioning the opening into a lower opening and an upper opening arranged in a height direction of the drawer frame, and wherein the check valve is configured to, based on the storage container being inserted into the drawer, be located at the lower opening and protrude toward the housing relative to the partition member.

* * * * *